US008056619B2

(12) United States Patent
Patel et al.

(10) Patent No.: US 8,056,619 B2
(45) Date of Patent: Nov. 15, 2011

(54) ALIGNING INDUCTIVE COUPLERS IN A WELL

(75) Inventors: Dinesh R. Patel, Sugar Land, TX (US); Donald W. Ross, Houston, TX (US); Anthony F. Veneruso, Paris (FR); Fabien F. Cens, Massy (FR); John R. Lovell, Houston, TX (US); Ian Stuart Mackay, Perth (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 232 days.

(21) Appl. No.: 12/199,246

(22) Filed: Aug. 27, 2008

(65) Prior Publication Data

US 2009/0066535 A1 Mar. 12, 2009

Related U.S. Application Data

(63) Continuation-in-part of application No. 11/688,089, filed on Mar. 19, 2007, now Pat. No. 7,735,555.

(60) Provisional application No. 60/787,592, filed on Mar. 30, 2006, provisional application No. 60/745,469, filed on Apr. 24, 2006, provisional application No. 60/747,986, filed on May 23, 2006, provisional application No. 60/805,691, filed on Jun. 23, 2006, provisional application No. 60/865,084, filed on Nov. 9, 2006, provisional application No. 60/866,622, filed on Nov. 21, 2006, provisional application No. 60/867,276, filed on Nov. 27, 2006, provisional application No. 60/890,630, filed on Feb. 20, 2007, provisional application No. 61/013,542, filed on Dec. 13, 2007.

(51) Int. Cl.
*E21B 17/02* (2006.01)
*G01V 3/28* (2006.01)

(52) U.S. Cl. ..... 166/65.1; 166/242.7; 340/854.8

(58) Field of Classification Search ..... 166/242.6, 166/65.1, 255.2, 255.3, 242.7; 340/854.8
See application file for complete search history.

(56) References Cited

U.S. PATENT DOCUMENTS

| | | | | |
|---|---|---|---|---|
| 4,027,286 | A * | 5/1977 | Marosko | 340/825.73 |
| 4,806,928 | A | 2/1989 | Veneruso | |
| 4,901,069 | A | 2/1990 | Veneruso | |
| 5,052,941 | A | 10/1991 | Hernandez | |
| 5,278,550 | A | 1/1994 | Rhein | |
| 5,521,592 | A | 5/1996 | Veneruso | |
| 5,730,219 | A | 3/1998 | Tubel | |
| 5,971,072 | A | 10/1999 | Huber | |
| 6,006,832 | A | 12/1999 | Tubel | |
| 6,046,685 | A | 4/2000 | Tubel | |
| 6,119,780 | A | 9/2000 | Christmas | |
| 6,176,308 | B1 | 1/2001 | Pearson | |

(Continued)

FOREIGN PATENT DOCUMENTS

EP 1158138 11/2001

(Continued)

*Primary Examiner* — Kenneth L Thompson
(74) *Attorney, Agent, or Firm* — Brandon Clark; Rodney Warfford; Tim Curington

(57) ABSTRACT

An apparatus that is usable with a well includes a first equipment section that includes a first inductive coupler and a second equipment section that includes a second inductive coupler. The second equipment section is adapted to be run downhole into the well after the first equipment section is run downhole into the well to engage the first equipment section. A mechanism of the apparatus indicates when the first inductive coupler is substantially aligned with the second inductive coupler.

23 Claims, 41 Drawing Sheets

U.S. PATENT DOCUMENTS

| | | | | |
|---|---|---|---|---|
| 6,209,648 | B1 | 4/2001 | Ohmer | |
| 6,302,203 | B1 | 10/2001 | Rayssiguier | |
| 6,305,469 | B1 * | 10/2001 | Coenen et al. | 166/250.01 |
| 6,360,820 | B1 | 3/2002 | Laborde | |
| 6,378,610 | B2 | 4/2002 | Rayssiguier | |
| 6,513,599 | B1 | 2/2003 | Bixenman | |
| 6,515,592 | B1 | 2/2003 | Babour | |
| 6,568,469 | B2 | 5/2003 | Ohmer | |
| 6,577,244 | B1 | 6/2003 | Clark | |
| 6,684,952 | B2 | 2/2004 | Brockman | |
| 6,695,052 | B2 | 2/2004 | Branstetter | |
| 6,727,827 | B1 | 4/2004 | Edwards | |
| 6,766,857 | B2 | 7/2004 | Bixenman | |
| 6,768,700 | B2 | 7/2004 | Veneruso | |
| 6,856,255 | B2 | 2/2005 | Chalitsios | |
| 6,903,660 | B2 | 6/2005 | Clark | |
| 6,913,083 | B2 | 7/2005 | Smith | |
| 6,950,034 | B2 | 9/2005 | Pacault | |
| 6,975,243 | B2 | 12/2005 | Clark | |
| 6,978,833 | B2 | 12/2005 | Salamitou | |
| 7,040,415 | B2 | 5/2006 | Boyle | |
| 7,055,604 | B2 | 6/2006 | Jee | |
| 7,063,143 | B2 * | 6/2006 | Tilton et al. | 166/242.6 |
| 7,079,952 | B2 | 7/2006 | Thomas | |
| 7,083,452 | B2 | 8/2006 | Eriksson | |
| 7,158,049 | B2 | 1/2007 | Hoefel | |
| 7,165,618 | B2 | 1/2007 | Brockman | |
| 7,168,487 | B2 | 1/2007 | Salamitou | |
| 7,168,510 | B2 | 1/2007 | Boyle | |
| 7,187,297 | B2 | 3/2007 | Clark | |
| 2003/0137302 | A1 | 7/2003 | Clark | |
| 2003/0137429 | A1 | 7/2003 | Clark | |
| 2003/0141872 | A1 | 7/2003 | Clark | |
| 2003/0221829 | A1 | 12/2003 | Patel | |
| 2004/0010374 | A1 | 1/2004 | Raghuraman | |
| 2004/0194950 | A1 | 10/2004 | Restarick | |
| 2005/0087368 | A1 * | 4/2005 | Boyle et al. | 175/57 |
| 2006/0065444 | A1 | 3/2006 | Hall | |
| 2006/0086498 | A1 | 4/2006 | Wetzel | |
| 2007/0216415 | A1 | 9/2007 | Clark | |
| 2007/0289779 | A1 | 12/2007 | Howard | |

FOREIGN PATENT DOCUMENTS

| | | |
|---|---|---|
| GB | 2345137 | 6/2000 |
| GB | 2360532 | 9/2001 |
| GB | 2364724 | 2/2002 |
| GB | 2392461 | 3/2004 |
| GB | 2401889 | 11/2004 |
| GB | 2407334 | 4/2005 |
| GB | 2419619 | 5/2006 |
| RU | 2136856 | 9/1999 |
| RU | 2146759 | 3/2000 |
| RU | 2171363 | 7/2001 |
| RU | 2239041 | 10/2004 |
| WO | 0171155 | 9/2001 |
| WO | 03023185 | 3/2003 |

* cited by examiner

ALIGNING INDUCTIVE COUPLERS IN A WELL

CROSS-REFERENCE TO RELATED APPLICATIONS

This application is a continuation-in-part of U.S. patent application Ser. No. 11/688,089, entitled, "COMPLETION SYSTEM HAVING A SAND CONTROL ASSEMBLY, AN INDUCTIVE COUPLER, AND A SENSOR PROXIMATE TO THE SAND CONTROL ASSEMBLY," which was filed on Mar. 19, 2007, now U.S. Pat. No. 7,735,555 and claims the benefit under 35 U.S.C. §119(e) of the following provisional patent applications: U.S. Ser. No. 60/787,592, entitled "METHOD FOR PLACING SENSOR ARRAYS IN THE SAND FACE COMPLETION," filed Mar. 30, 2006; U.S. Ser. No. 60/745,469, entitled "METHOD FOR PLACING FLOW CONTROL IN A TEMPERATURE SENSOR ARRAY COMPLETION," filed Apr. 24, 2006; U.S. Ser. No. 60/747,986, entitled "A METHOD FOR PROVIDING MEASUREMENT SYSTEM DURING SAND CONTROL OPERATION AND THEN CONVERTING IT TO PERMANENT MEASUREMENT SYSTEM," filed May 23, 2006; U.S. Ser. No. 11/735,521, entitled MEASURING A CHARACTERISTIC OF A WELL PROXIMATE A REGION TO BE GRAVEL PACKED filed Apr. 16, 2007; U.S. Ser. No. 60/805,691, entitled "SAND FACE MEASUREMENT SYSTEM AND RE-CLOSEABLE FORMATION ISOLATION VALVE IN ESP COMPLETION," filed Jun. 23, 2006; U.S. Ser. No. 11/746,967, entitled PROVIDING A STRING HAVING AN ELECTRIC PUMP AND AN INDUCTIVE COUPLER filed May 10, 2007; U.S. Ser. No. 60/865,084, entitled "WELDED, PURGED AND PRESSURE TESTED PERMANENT DOWNHOLE CABLE AND SENSOR ARRAY," filed Nov. 9, 2006; U.S. Ser. No. 11/767,908, entitled PROVIDING A SENSOR ARRAY filed Jun. 25, 2007; U.S. Ser. No. 60/866,622, entitled "METHOD FOR PLACING SENSOR ARRAYS IN THE SAND FACE COMPLETION," filed Nov. 21, 2006; U.S. Ser. No. 60/867,276, entitled "METHOD FOR SMART WELL," filed Nov. 27, 2006; U.S. Ser. No. 11/830,025, entitled COMMUNICATING ELECTRICAL ENERGY WITH AN ELECTRICAL DEVICE IN A WELL filed Jul. 30, 2007; and U.S. Ser. No. 60/890,630, entitled "METHOD AND APPARATUS TO DERIVE FLOW PROPERTIES WITHIN A WELLBORE," filed Feb. 20, 2007; U.S. Ser. No. 11/768,022, entitled DETERMINING FLUID AND/OR RESERVOIR INFORMATION USING AN INSTRUMENTED COMPLETION filed Jun. 25, 2007. This application also claims the benefit under 35 U.S.C. §119(e) of U.S. Provisional Patent Application Ser. No. 61/013,542, entitled, "DETECTING MOVEMENT IN WELL EQUIPMENT FOR MEASURING RESERVOIR COMPLETION," which was filed on Dec. 13, 2007 and U.S. Ser. No. 12/173,546, entitled SYSTEM AND METHOD FOR DETECTING MOVEMENT IN WELL EQUIPMENT filed Jul. 15, 2008. Each of the above applications is hereby incorporated by reference in its entirety.

TECHNICAL FIELD

The invention generally relates to aligning inductive couplers in a well.

BACKGROUND

Inductive couplers may be used in a well for purposes of wirelessly transmitting power and/or data between downhole components. The inductive couplers typically are constructed so that a coil of an inner inductive coupler is positioned within a coil of an outer inductive coupler. A time-varying current typically is communicated through the one of the coils, which causes a time-varying electromagnetic field to be generated, which induces a corresponding current in the coil of the other inductive coupler.

The efficiency of the inductive coupling is a function of how closely the coils are placed together. One of the inductive couplers may be part of an upper completion assembly, which is landed in a lower completion assembly that contains the other inductive coupler. Due to the tolerances of the well equipment, it may be challenging to position the coils of the inductive couplers so that optimum inductive coupling is achieved. One way to ensure that inductive coupling occurs is to make the coil of one of the inductive couplers significantly longer than the coil of the other inductive coupler. Thus, at least a portion of the longer coil is surrounded by or surrounds (depending on whether the longer coil is the inner or outer coil) the shorter coil. However, such an approach may be relatively inefficient, as excessive energy may be dissipated due to a significant portion of the electromagnetic field straying outside of the shorter coil.

Thus, there exists a continuing need for better ways to align inductive couplers in a well.

SUMMARY

In an embodiment of the invention, an apparatus that is usable with a well includes a first equipment section that includes a first inductive coupler and a second equipment section that includes a second inductive coupler. The second equipment section is adapted to be run downhole into the well after the first equipment section is run downhole into the well to engage the first equipment section. A mechanism of the apparatus indicates when the first inductive coupler is substantially aligned with the second inductive coupler.

In another embodiment of the invention, a technique that is usable with a well includes, after a first equipment section is installed in a well, running a second equipment section into the well to engage the first equipment section. The technique also includes providing feedback that indicates whether a first inductive coupler of the first equipment section is substantially aligned with a second inductive coupler of the second equipment section.

Advantages and other features of the invention will become apparent from the following drawing, description and claims.

DETAILED DESCRIPTION

Figure 1A:
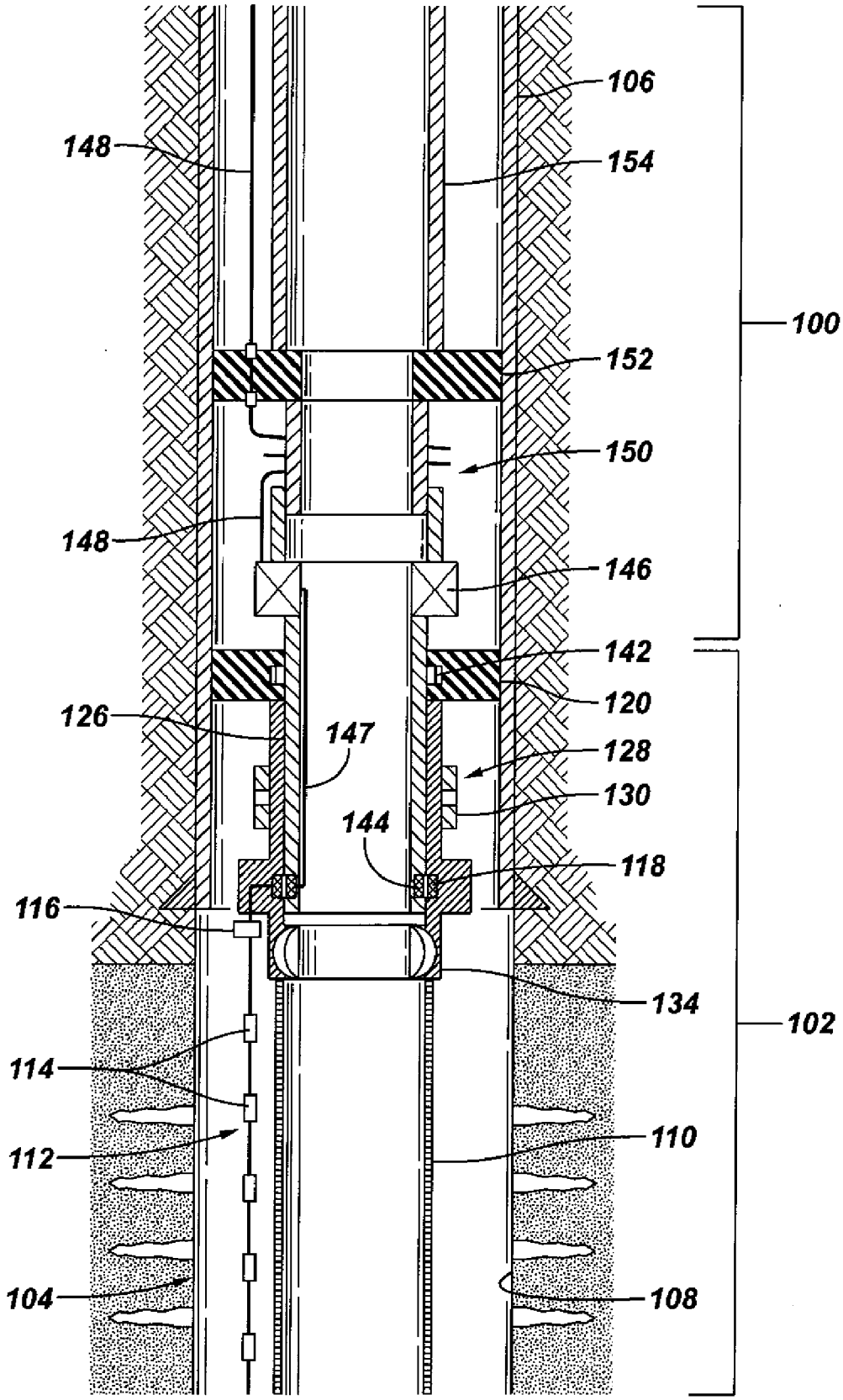
FIG. 1A illustrates a two-stage completion system having an inductively coupled wet connect mechanism for deployment in a well, in accordance with an embodiment.

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a completion system is provided for installation in a well, where the completion system allows for real-time monitoring of downhole parameters, such as temperature, pressure, flow rate, fluid density, reservoir resistivity, oil/gas/water ratio, viscosity, carbon/oxygen ratio, acoustic parameters, chemical sensing (such as for scale, wax, asphaltenes, deposition, pH sensing, salinity sensing), and so forth. The well can be an offshore well or a land-based well. The completion system includes a sensor assembly (such as in the form of a sensor array of multiple sensors) that can be placed at multiple locations across a sand face of a well in some embodiments. A "sand face" refers to a region of the well that is not lined with a casing or liner. In other embodiments, the sensor assembly can be placed in a lined or cased section of the well. "Real-time monitoring" refers to the ability to observe the downhole parameters during some operation performed in the well, such as during production or injection of fluids or during an intervention operation. The sensors of the sensor assembly are placed at discrete locations at various points of interest. Also, the sensor assembly can be placed either outside or inside a sand control assembly, which can include a sand screen, a slotted or perforated liner, or a slotted or perforated pipe.

The sensors can be placed proximate to a sand control assembly. A sensor is "proximate to" a sand control assembly if it is in a zone in which the sand control assembly is performing control of particulate material. The sensors may be protected from abrasion by a clamp which is mechanically attached to the sand control assembly. This clamp can further provide mechanical protection against vibration or erosion. The clamping mechanism can also provide electrical grounding between the sensor and the completion housing.

In some embodiments, a completion system having at least two stages (an upper completion section and a lower completion section) is used. The lower completion section is run into the well in a first trip, where the lower completion section includes the sensor assembly. An upper completion section is then run in a second trip, where the upper completion section is able to be inductively coupled to the first completion section to enable communication and power between the sensor assembly and another component that is located uphole of the sensor assembly. The inductive coupling between the upper and lower completion sections is referred to as an inductively coupled wet connect mechanism between the sections. "Wet connect" refers to electrical coupling between different stages (run into the well at different times) of a completion system in the presence of well fluids. The inductively coupled wet connect mechanism between the upper and lower completion sections enables both power and signaling to be established between the sensor assembly and uphole components, such as a component located elsewhere in the wellbore at the earth surface.

The term two-stage completion should also be understood to include those completions where additional completion components are run in after the first upper completion, such as commonly used in some cased-hole frac-pack applications. In such wells, inductive coupling may be used between the lowest completion component and the completion component above, or may be used at other interfaces between completion components. A plurality of inductive couplers may also be used in the case that there are multiple interfaces between completion components.

Induction is used to indicate transference of a time-changing electromagnetic signal or power that does not rely upon a closed electrical circuit, but instead includes a component that is wireless. For example, if a time-changing current is passed through a coil, then a consequence of the time variation is that an electromagnetic field will be generated in the medium surrounding the coil. If a second coil is placed into that electromagnetic field, then a voltage will be generated on that second coil, which we refer to as the induced voltage. The efficiency of this inductive coupling increases as the coils are placed closer, but this is not a necessary constraint. For example, if time-changing current is passed through a coil is wrapped around a metallic mandrel, then a voltage will be induced on a coil wrapped around that same mandrel at some distance displaced from the first coil. In this way, a single transmitter can be used to power or communicate with multiple sensors along the wellbore. Given enough power, the transmission distance can be very large. For example, solenoidal coils on the surface of the earth have been used to inductively communicate with subterranean coils deep within a wellbore. Also note that the coils do not have to be wrapped as solenoids. Another example of inductive coupling occurs when a coil is wrapped as a toroid around a metal mandrel, and a voltage is induced on a second toroid some distance removed from the first. Nonetheless, the efficiency of the inductive coupling increases as the two components become closer together, so that in a preferred embodiment the two coils will be close to one another in the final assembly.

In alternative embodiments, the sensor assembly can be provided with the upper completion section rather than with the lower completion section. In yet other embodiments, a single-stage completion system can be used.

Although reference is made to upper completion sections that are able to provide power to lower completion sections through inductive couplers, it is noted that lower completion sections can obtain power from other sources, such as batteries, or power supplies that harvest power from vibrations (e.g., vibrations in the completion system). Examples of such systems have been described in U.S. Publication No. 2006/0086498. Power supplies that harvest power from vibrations can include a power generator that converts vibrations to power that is then stored in a charge storage device, such as a battery. In the case that the lower completion obtains power from other sources, the inductive coupling will still be used to facilitate communication across the completion components. The inductive coupling could also be used in this scenario to transmit power from the lower completion to the upper.

Figure 2:
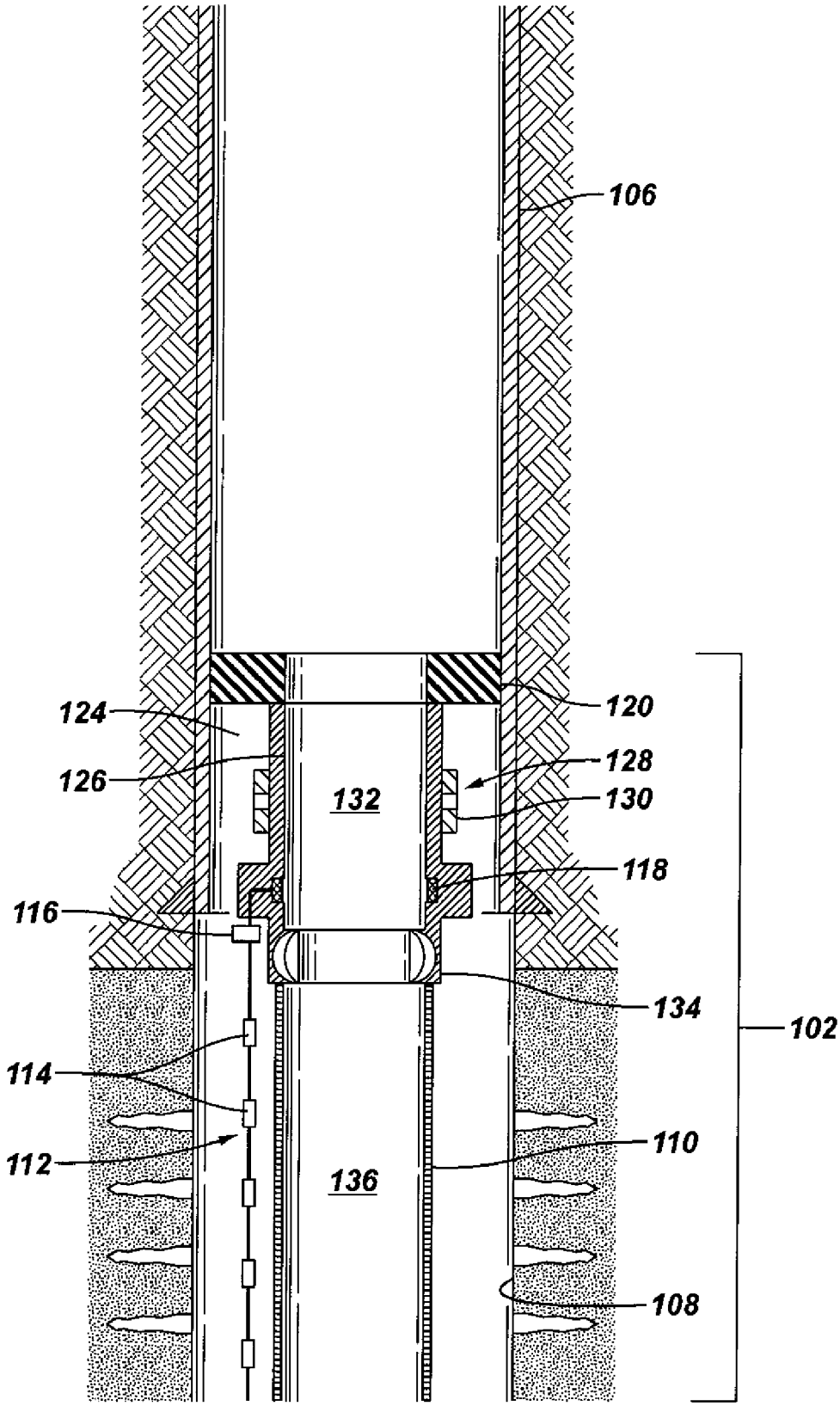
FIG. 2 illustrates a lower completion section of the two-stage completion system of FIG. 1A, according to an embodiment.
Figure 3:
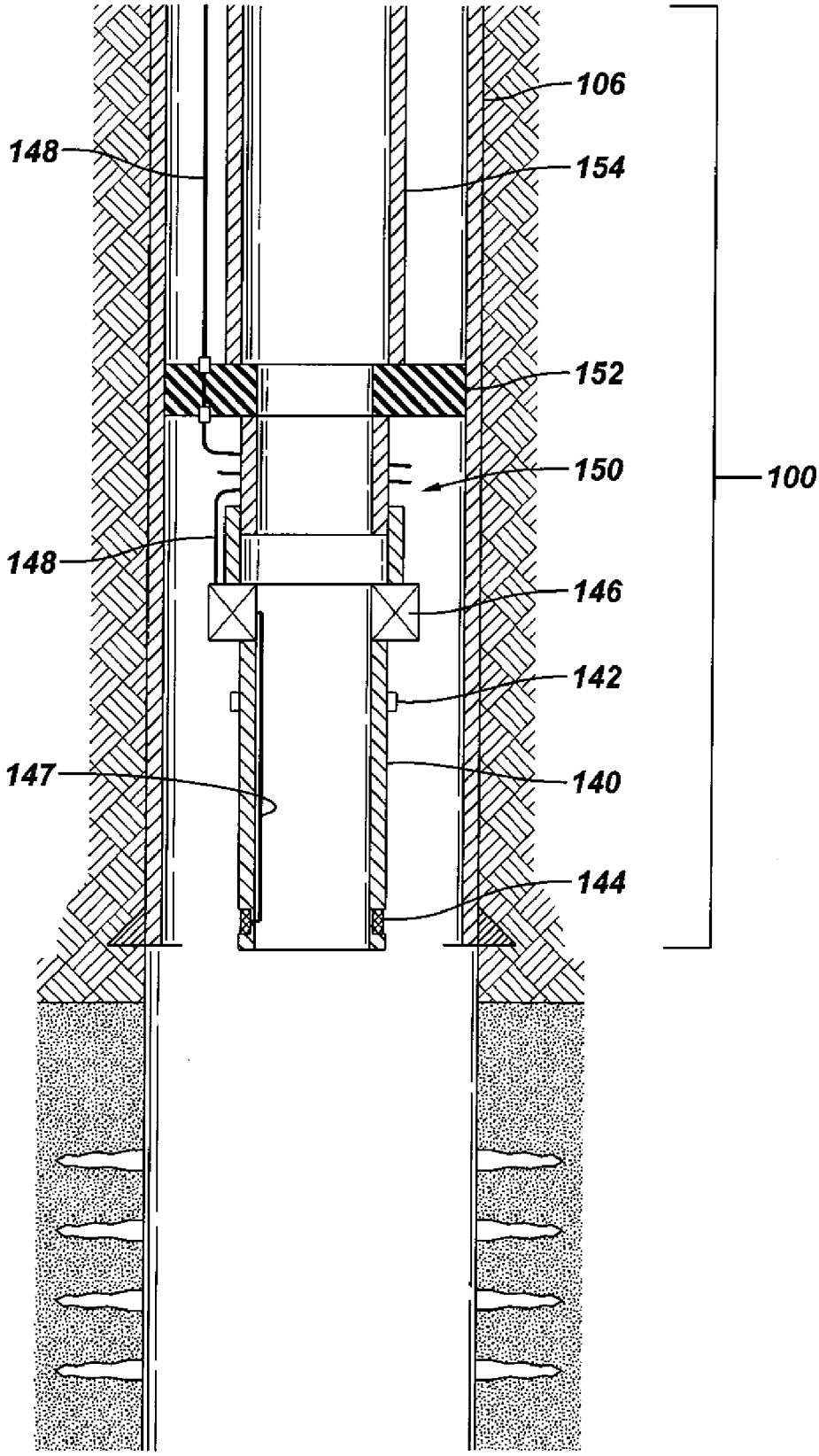
FIG. 3 illustrates an upper completion section of the two-stage completion system of FIG. 1A, according to an embodiment.

Reference is made to FIGS. 1A, 2, and 3 in the ensuing discussion of a two-stage completion system according to an embodiment. FIG. 1A shows the two-stage completion system with an upper completion section 100 (FIG. 3) engaged with a lower completion section 102 (FIG. 2).

The two-stage completion system is a sand face completion system that is designed to be installed in a well that has a region 104 that is un-lined or un-cased ("open hole region") As shown in FIG. 1A, the open hole region 104 is below a lined or cased region that has a liner or a casing 106. In the open hole region, a portion of the lower completion section 102 is provided proximate to a sand face 108.

To prevent passage of particulate material, such as sand, a sand screen 110 is provided in the lower completion section 102. Alternatively, other types of sand control assemblies can be used, including slotted or perforated pipes or slotted or perforated liners. A sand control assembly is designed to filter particulates to prevent such particulates from flowing from the surrounding reservoir into a well.

In accordance with some embodiments, the lower completion section 102 has a sensor assembly 112 that has multiple sensors 114 positioned at various discrete locations across the sand face 108. In some embodiments, the sensor assembly 112 is in the form of a sensor cable (also referred to as a "sensor bridle"). The sensor cable 112 is basically a continuous control line having portions in which sensors 114 are provided. The sensor cable 112 is "continuous" in the sense that the sensor cable provides a continuous seal against fluids, such as wellbore fluids, along its length. Note that in some embodiments, the continuous sensor cable can actually have discrete housing sections that are sealably attached together. In other embodiments, the sensor cable can be implemented with an integrated, continuous housing without breaks. The continuous sensor bridle can be deployed on the exterior of a sand control packer and passed between swellable packers, as disclosed in U.S. patent application Ser. No. 12/101,198, entitled, "SPOOLABLE SENSORS AND FLOW ISOLATION", which was filed on Apr. 11, 2008, and is hereby incorporated by reference in its entirety. Alternatively, the continuous sensor bridle may be spliceable into sections of bridle to facilitate creating a sensor assembly passing through a packer, in which case rig splicing techniques are used to reassemble the sections back into one continuous bridle.

In the lower completion section 102, the sensor cable 112 is also connected to a controller cartridge 116 that is able to communicate with the sensors 114. The controller cartridge 116 is able to receive commands from another location (such as at the earth surface or from another location in the well, e.g., from control station 146 in the upper completion section 100). These commands can instruct the controller cartridge 116 to cause the sensors 114 to take measurements or send measured data. Also, the controller cartridge 116 is able to store and communicate measurement data from the sensors 114. Thus, at periodic intervals, or in response to commands, the controller cartridge 116 is able to communicate the measurement data to another component (e.g., control station 146) that is located elsewhere in the wellbore or at the earth surface. Generally, the controller cartridge 116 includes a processor and storage. The communication between sensors 114 and control cartridge 116 can be bi-directional or can use a master-slave arrangement.

The controller cartridge 116 is electrically connected to a first inductive coupler portion 118 (e.g., a female inductive coupler portion) that is part of the lower completion section 102. As discussed further below, the first inductive coupler portion 118 allows the lower completion section 102 to electrically communicate with the upper completion section 100 such that commands can be issued to the controller cartridge 116 and the controller cartridge 116 is able to communicate measurement data to the upper completion section 100.

In embodiments in which power is generated or stored locally in the lower completion section, the controller cartridge 116 can include a battery or power supply.

As further depicted in FIGS. 1A and 2, the lower completion section 102 includes a packer 120 (e.g., gravel pack packer) that when set seals against casing 106. The packer 120 isolates an annulus region 124 under the packer 120, where the annulus region 124 is defined between the outside of the lower completion section 102 and the inner wall of the casing 106 and the sand face 108.

A seal bore assembly 126 extends below the packer 120, where the seal bore assembly 126 is to sealably receive the upper completion section 100. The seal bore assembly 126 is further connected to a circulation port assembly 128 that has a slidable sleeve 130 that is slidable to cover or uncover circulating ports of the circulating port assembly 128. During a gravel pack operation, the sleeve 130 can be moved to an open position to allow gravel slurry to pass from the inner bore 132 of the lower completion section 102 to the annulus region 124 to perform gravel packing of the annulus region 124. The gravel pack formed in the annulus region 124 is part of the sand control assembly designed to filter particulates.

In the example implementation of FIGS. 1A and 2, the lower completion section 102 further includes a mechanical fluid loss control device, e.g., formation isolation valve 134, which can be implemented as a ball valve. When closed, the ball valve isolates a lower part 136 of the inner bore 132 from the part of the inner bore 132 above the formation isolation valve 134. When open, the formation isolation valve 134 can provide an open bore to allow flow of fluids as well as passage of intervention tools. Although the lower completion section 102 depicted in the example of FIGS. 1A and 2 includes various components, it is noted that in other implementations, some of these components can be omitted or replaced with other components.

As depicted in FIGS. 1A and 2, the sensor cable 112 is provided in the annulus region 124 outside the sand screen 110. By deploying the sensors 114 of the sensor cable 112 outside the sand screen 110, well control issues and fluid losses can be avoided by using the formation isolation valve 134. Note that the formation isolation valve 134 can be closed for the purpose of fluid loss control during installation of the two-stage completion system.

As depicted in FIGS. 1A and 3, the upper completion section 100 has a straddle seal assembly 140 for sealing engagement inside the seal bore assembly 126 (FIG. 2) of the lower completion section 102. As depicted in FIG. 1A, the outer diameter of the straddle seal assembly 140 of the upper completion section 100 is slightly smaller than the inner diameter of the seal bore assembly 126 of the lower completion section 102. This allows the upper completion section straddle seal assembly 140 to sealingly slide into the lower completion section seal bore assembly 126 (which is depicted in FIG. 1A). In an alternate embodiment the straddle seal assembly can be replaced with a stinger that does not have to seal.

As depicted in FIG. 3, arranged on the outside of the upper completion section straddle seal assembly 140 is a snap latch connector assembly 142 that allows for engagement with the packer 120 of the lower completion section 102. When the snap latch connector assembly 142 is engaged in the packer 120, as depicted in FIG. 1A, the upper completion section 100 is securely engaged with the lower completion section 102. In other implementations, other engagement mechanisms can be employed instead of the snap latch connector assembly 142.

Proximate to the lower portion of the upper completion section 100 (and more specifically proximate to the lower portion of the straddle seal assembly 140) is a second inductive coupler portion 144 (e.g., a male inductive coupler portion). When positioned next to each other, the second inductive coupler portion 144 and first inductive coupler portion 118 (as depicted in FIG. 1A) form an inductive coupler that allows for inductively coupled communication of data and power between the upper and lower completion sections.

An electrical conductor 147 (or conductors) extends from the second inductive coupler portion 144 to the control station 146, which includes a processor and a power and telemetry module (to supply power and to communicate signaling with the controller cartridge 116 in the lower completion section 102 through the inductive coupler). The control station 146 can also optionally include sensors, such as temperature and/or pressure sensors.

The control station 146 is connected to an electric cable 148 (e.g., a twisted pair electric cable) that extends upwardly to a contraction joint 150 (or length compensation joint). At the contraction joint 150, the electric cable 148 can be wound in a spiral fashion (to provide a helically wound cable) until the electric cable 148 reaches an upper packer 152 in the upper completion section 100. The upper packer 152 is a ported packer to allow the electric cable 148 to extend through the packer 152 to above the ported packer 152. The electric cable 148 can extend from the upper packer 152 all the way to the earth surface (or to another location in the well).

In another embodiment, the control station 146 can be omitted, and the electrical cable 148 can run from the second inductive coupler portion 144 (of the upper completion section 100) to a control station elsewhere in the well or at the earth surface.

The contraction joint 150 is optional and can be omitted in other implementations. The upper completion section 100 also includes a tubing 154, which can extend all the way to the earth surface. The upper completion section 100 is carried into the well on the tubing 154.

In operation, the lower completion section 102 is run in a first trip into the well and is installed proximate to the open hole section of the well. The packer 120 (FIG. 2) is then set, after which a gravel packing operation can be performed. To perform the gravel packing operation, the circulating port assembly 128 is actuated to an open position to open the port(s) of the circulating port assembly 128. A gravel slurry is then communicated into the well and through the open port(s) of the circulating port assembly 128 into the annulus region 124. The annulus region 124 is then filled with slurry until the annulus region 124 is gravel packed.

Next, in a second trip, the upper completion section 100 is run into the well and attached to the lower completion section 102. Once the upper end lower completion sections are engaged, communication between the controller cartridge 116 and the control station 146 can be performed through the inductive coupler that includes the inductive coupler portions 118 and 144. The control station 146 can send commands to the controller cartridge 116 in the lower completion section 102, or the control station 146 can receive measurement data collected by the sensors 114 from the controller cartridge 116.

Figure 1B:
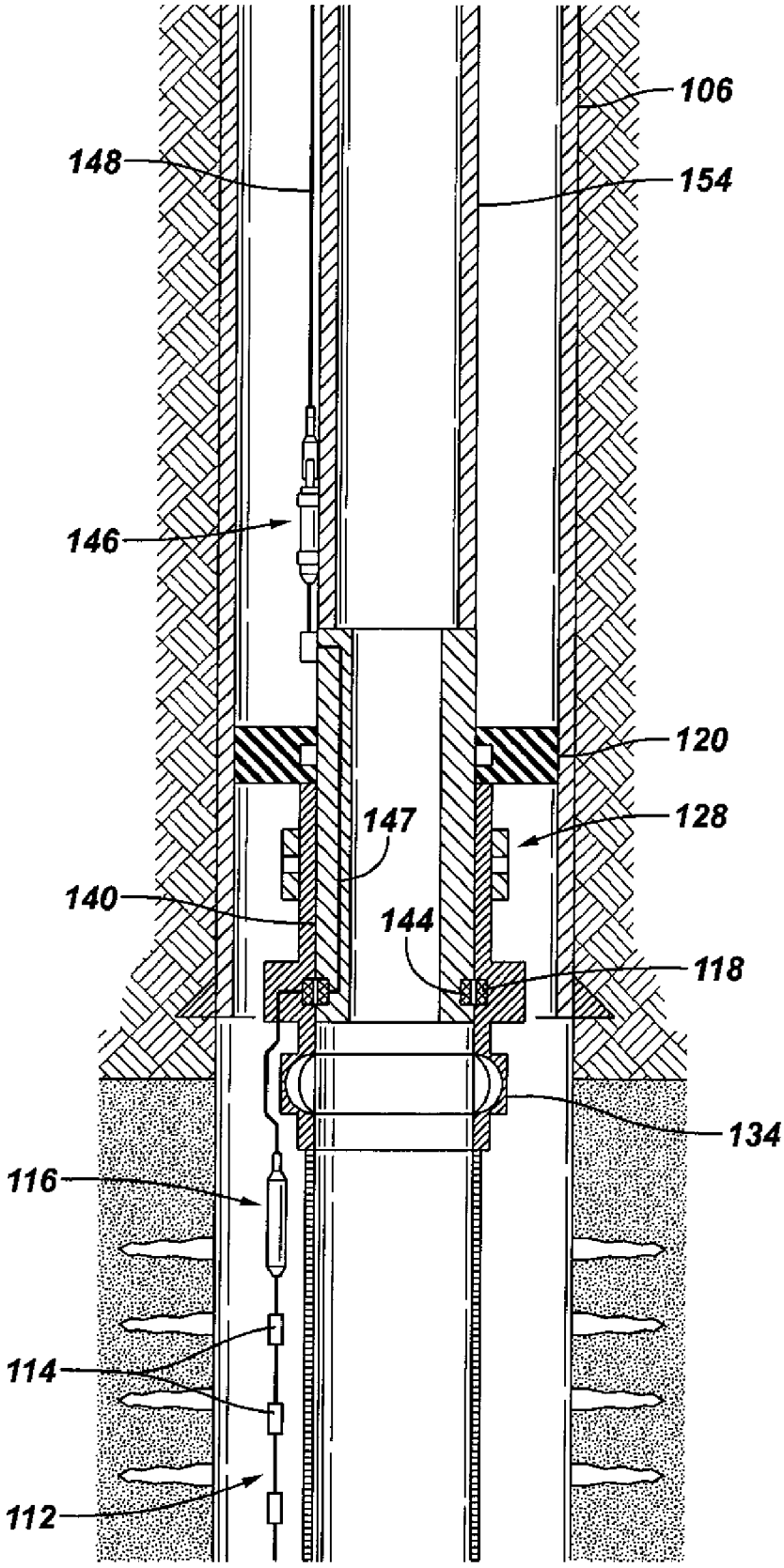
FIG. 1B provides a slightly different view of the completion system of FIG. 1A.

FIG. 1B shows a slightly different view of the two-stage completion system depicted in FIG. 1A. In FIG. 1B, the sensor cable 112, controller cartridge 116, and control station 146 are depicted with slightly different views. Functionally, the completion system of FIG. 1B is similar to the completion system of FIG. 1A.

Figure 1C:
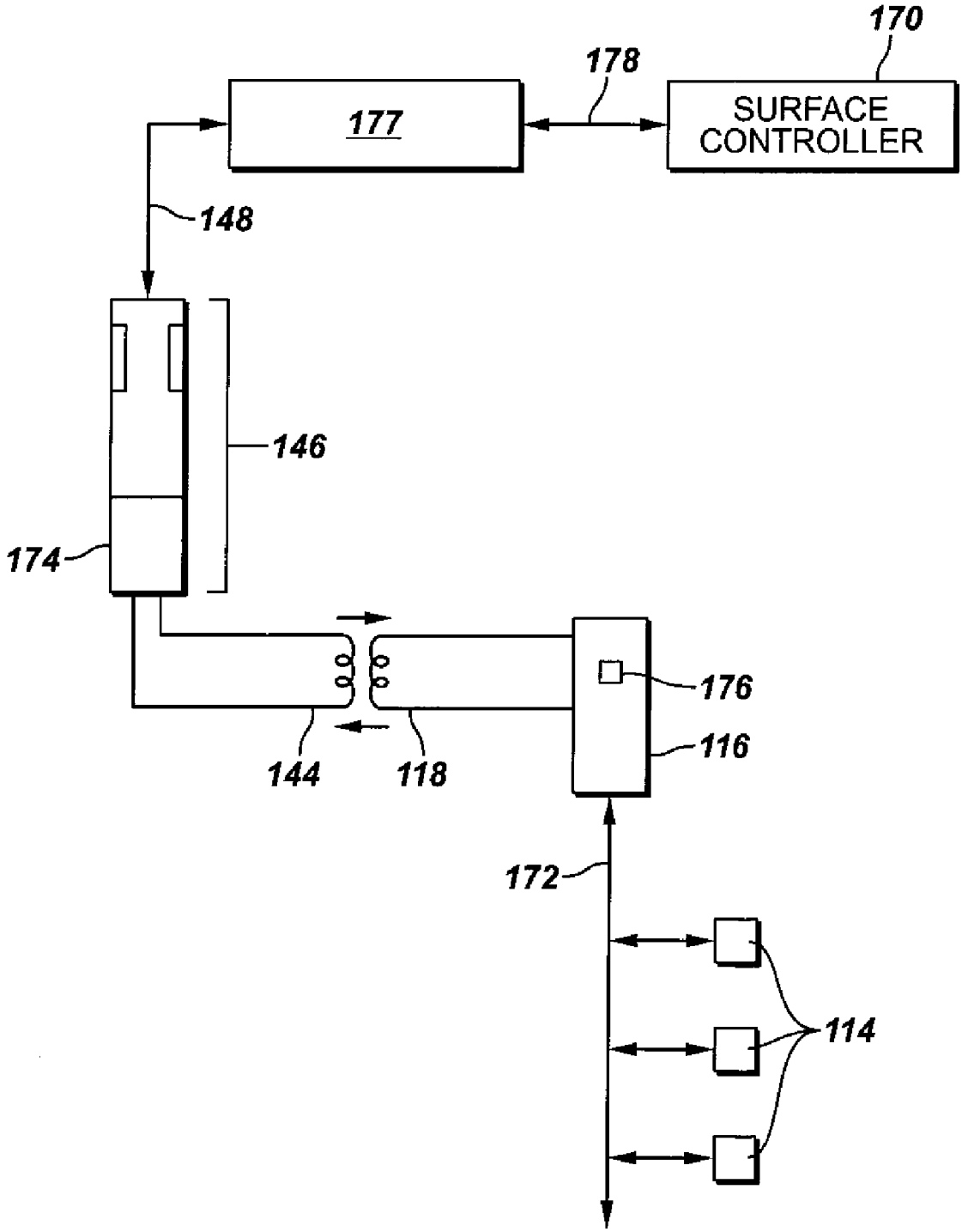
FIG. 1C is a schematic diagram of the electrical chain in the completion system of FIG. 1A.

FIG. 1C is a schematic diagram of an example electrical chain between the sensors 114 that are part of the lower completion section 102 and a surface controller 170 (provided at the earth surface). The sensors 114 communicate over a bus 172 that is part of the sensor cable 112 to the controller cartridge 116. Communication between the controller cartridge 116 and a control station interface 174 (part of control station 146) occurs through inductive coupler portions 118 and 144 (as discussed above). A switch 176 can be provided in the controller cartridge 176 to control whether or not communication is enabled through the inductive coupler portions 118 and 144. The switch 176 is controllable by the control station 146 or in response to commands sent from the surface controller 170 through the control station 146. Note that, as discussed above, the control station 146 can be omitted in some implementations, with the surface controller 170 being able to communicate with the controller cartridge 116 without the control station 146.

The control station 146 communicates power and signaling over electrical cable 148 to a communications bus interface 177. In one implementation, the communications bus interface 177 can be a ModBus interface, which is able to communicate over a ModBus communications link 178 with the surface controller 170. The ModBus communications link 178 can be a serial link implemented with RS-422, RS-485, and/or RS-232, or alternatively, the ModBus communications link 178 can be a TCP/IP (Transmission Control Protocol/Internet Protocol). The ModBus protocol is a standard communications protocol in the oilfield industry and specifications are broadly available, for example on the Internet at www.modbus.org. In alternative implementations, other types of communications links can be employed.

In one implementation, the sensors 114 can be implemented as slave devices that are responsive to requests from the control station 146. Alternatively, the sensors 114 can be able to initiate communications with the control station 146 or with the surface controller 170.

In one embodiment, communications through the inductive coupler portions 118 and 144 is accomplished using frequency modulation of data signals around a particular frequency carrier. The frequency carrier has sufficient power to supply power to the controller cartridge 116 and the sensors 114. Alternatively, the controller cartridge 176 and sensors 114 can be powered by a battery.

The sensors 114 can be scanned periodically, such as once every predefined time interval. Alternatively, the sensors 114 are accessed in response to a specific request (such as from the control station 146 or surface controller 170) to retrieve measurement data.

Figure 1D:
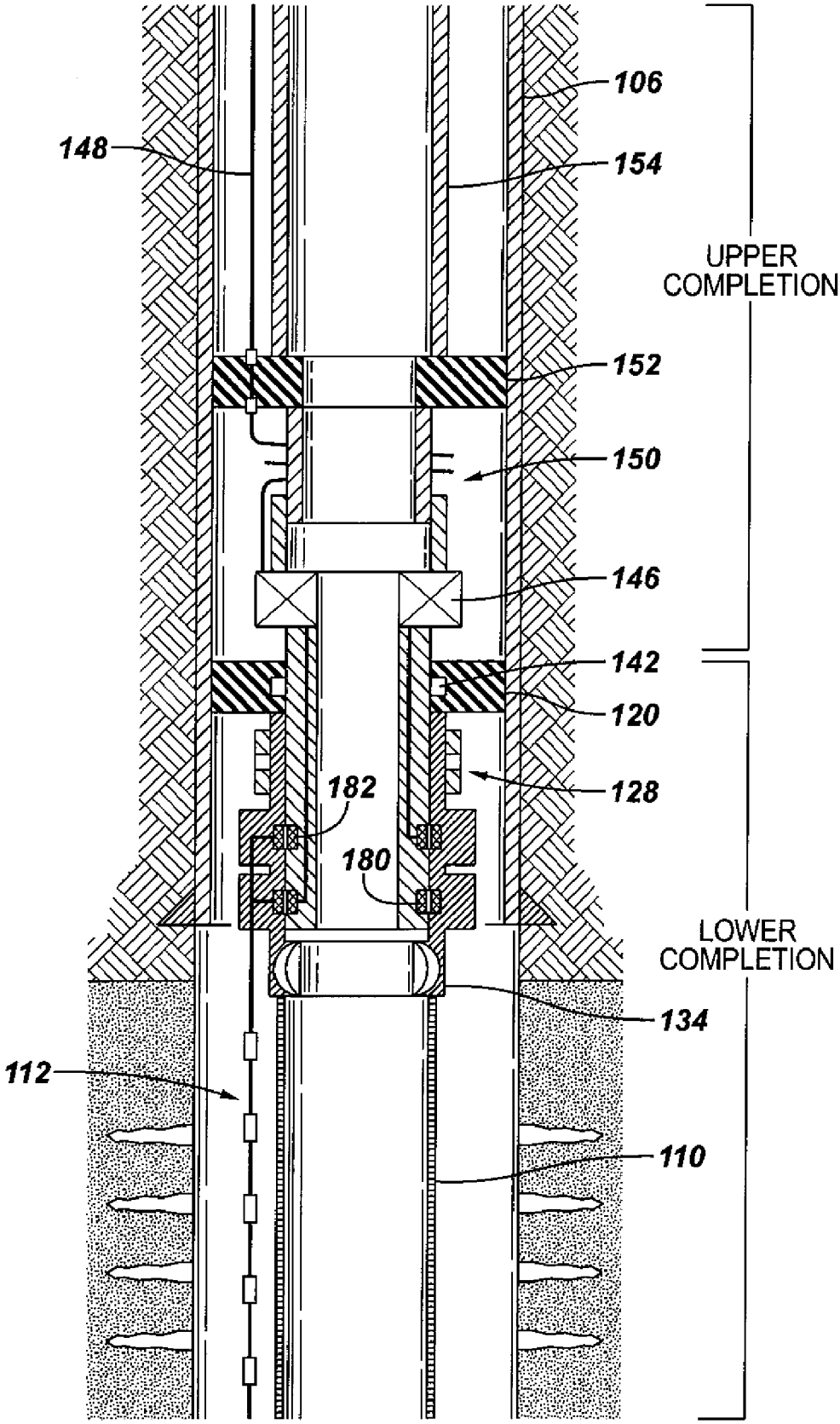
FIGS. 1D-1E illustrate other embodiments of a two-stage completions system.

FIG. 1D illustrates yet another variant of the two-stage completion system. In the FIG. 1A embodiment, a single inductive coupler is used to provide for both power and signal (data) communication. However, according to FIG. 1D, two inductive couplers are employed, an inductive coupler 180 for power and an inductive coupler 182 for data communication.

Figure 1E:
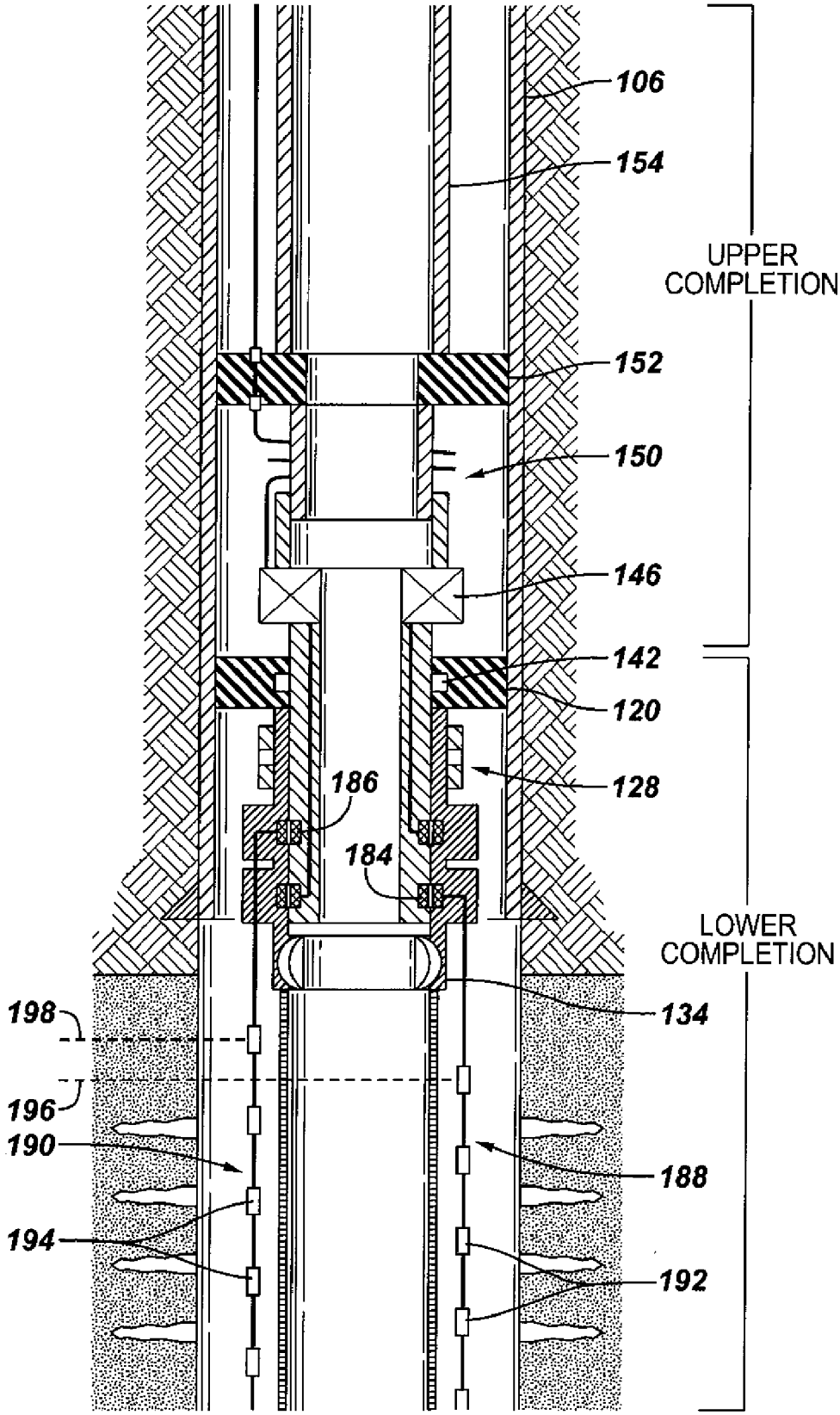

FIG. 1E shows another embodiment that uses two inductive couplers 184 and 186, where the first inductive coupler 184 is used for power and data communication with a first sensor cable 188, and the second inductive coupler 186 is used to provide power and data communication with a second sensor cable 190. The use of two inductive couplers and two corresponding sensor cables in the FIG. 1E embodiment provides for redundancy in case of failure of one of the sensor cables or one of the inductive couplers. The sensor cables 188 and 190 are generally parallel to each other. However, the sensors 192 of the sensor cable 188 are offset along the longitudinal direction of the wellbore with respect to sensors 194 of the sensor cable 190. In other words, in the longitudinal direction, each sensor 192 is positioned between two successive sensors 194 (see dashed line 196 in FIG. 1E). Similarly, each sensor 194 is positioned between two successive sensors 192 (see dashed line 198 in FIG. 1E). By providing longitudinal offsets of sensors 192 and 194, the sensors 192 and 194 are able to collect measurements at different depths in the wellbore. In this manner, the effective density of sensors in the region of interest is increased if both sensor cables 188 and 190 are operational.

In another embodiment, the sensor cables 188 and 190 can be run in series instead of in parallel as depicted in FIG. 1E. In yet another arrangement, instead of both cables 188 and 190 being sensor cables, one of the cables can be a cable used to provide control, such as to control a flow control device (or alternatively, one of the cables can be a combination sensor and control cable).

In the embodiments discussed above, a sensor cable provides electrical wires that interconnect the multiple sensors in a collection or array of sensors. In an alternative implementation, wires between sensors can be omitted. In this case, multiple inductive coupler portions can be provided for corresponding sensors, with the upper completion section providing corresponding inductive coupler portions to interact with the inductive coupler portions associated with respective sensors to communicate power and data with the sensors.

Moreover, even though reference has been made to communicating data between the sensors and another component in the well, it is noted that in alternative implementations, and in particular in implementations where sensors are provided with their own power sources downhole, the sensors can be provided with just enough micro-power that the sensors can make measurements and store data over a relatively long period of time (e.g., months). Later, an intervention tool can be lowered to communicate with the sensors to retrieve the collected measurement data. In one embodiment, the communication between the intervention tool would be accomplished using inductive coupling, wherein one inductive coupler portion is permanently installed in the completion, and the mating inductive coupler portion is on the intervention tool. The intervention tool could also replenish (e.g., charge) the downhole power sources.

Figure 4:
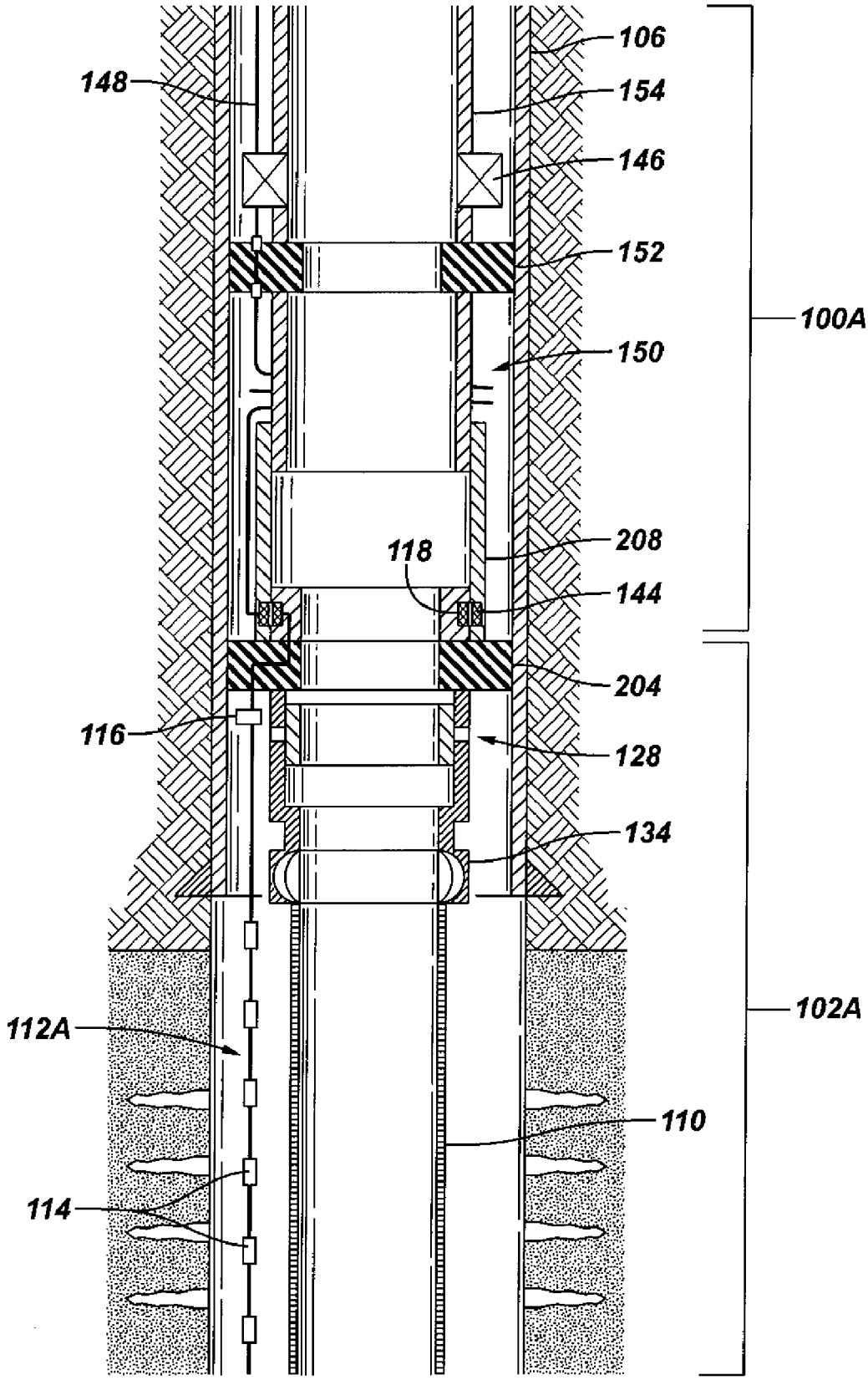
FIGS. 4-6 illustrate different embodiments of two-stage completion systems having inductively coupled wet connect mechanisms.

FIG. 4 illustrates a different embodiment of a two-stage completion system in which the positions of the inductive coupler portions and of the control station have been changed. The completion system includes an upper completion section 100A and a lower completion section 102A. In the FIG. 4 embodiment, the first inductive coupler portion 118 is provided above a packer 204 (a ported packer) of the lower completion section 102A. The first inductive coupler portion 118 can in turn be electrically connected to the controller cartridge 116 (located below the packer 204), which is connected to a sensor cable 112A. The sensor cable 112A has a portion that passes through a port of the ported packer 204 to allow communication between sensors 114 and the controller cartridge 116.

The upper completion section 100A has a lower section 208 that provides the second inductive coupler portion 144 for communicating with the first inductive coupler portion 118 when the upper completion section 100A is engaged with the lower completion section 102A.

In the embodiment of FIG. 4, the control station 146 is provided above the ported packer 152 (as compared to the position of the control station 146 below the ported packer 152 in FIGS. 1A and 3).

The remaining components depicted in FIG. 4 are the same as or similar to corresponding components in FIGS. 1A, 2, and 3 and thus are not further described.

Figure 5:
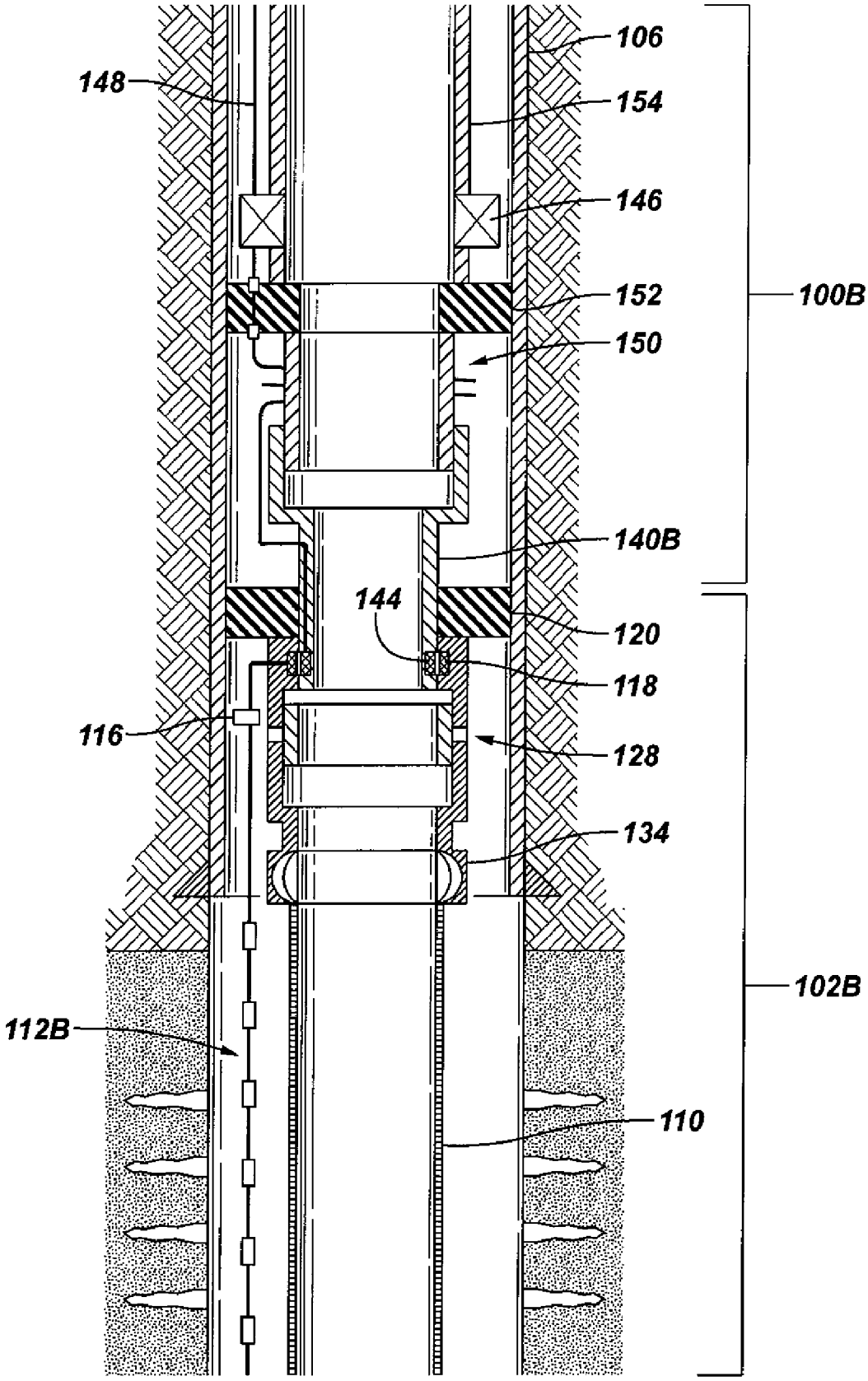

FIG. 5 shows yet another variant of the two-stage completion system that includes an upper completion section 100B and a lower completion section 102B. In this embodiment, a sensor cable 112B similar to the sensor cable 112 of FIG. 1A extends further up in the lower completion section 102B to the controller cartridge 116 that is in turn connected to the first inductive coupler portion 118. The first inductive coupler portion 118 is placed further up in the lower completion section 102B (as compared to the lower completion section 102 of FIG. 1A) such that a straddle seal assembly 140B of the upper completion section 100B does not have to extend deeply into the lower completion section 102B. As a result, when inserted into the lower completion section 102B, the straddle seal assembly 140B of the upper completion section 100B does not extend past the circulating port assembly 128, such that the circulating port 128 is not blocked when the upper completion section 100B is engaged with the lower completion section 102B. In the FIG. 5 embodiment, the inductive coupler portions 118 and 144 are positioned above the circulating port assembly 128.

In the arrangement of FIG. 5, the control station 146 is also provided above the ported packer 152 as in the FIG. 4 embodiment.

Figure 6:
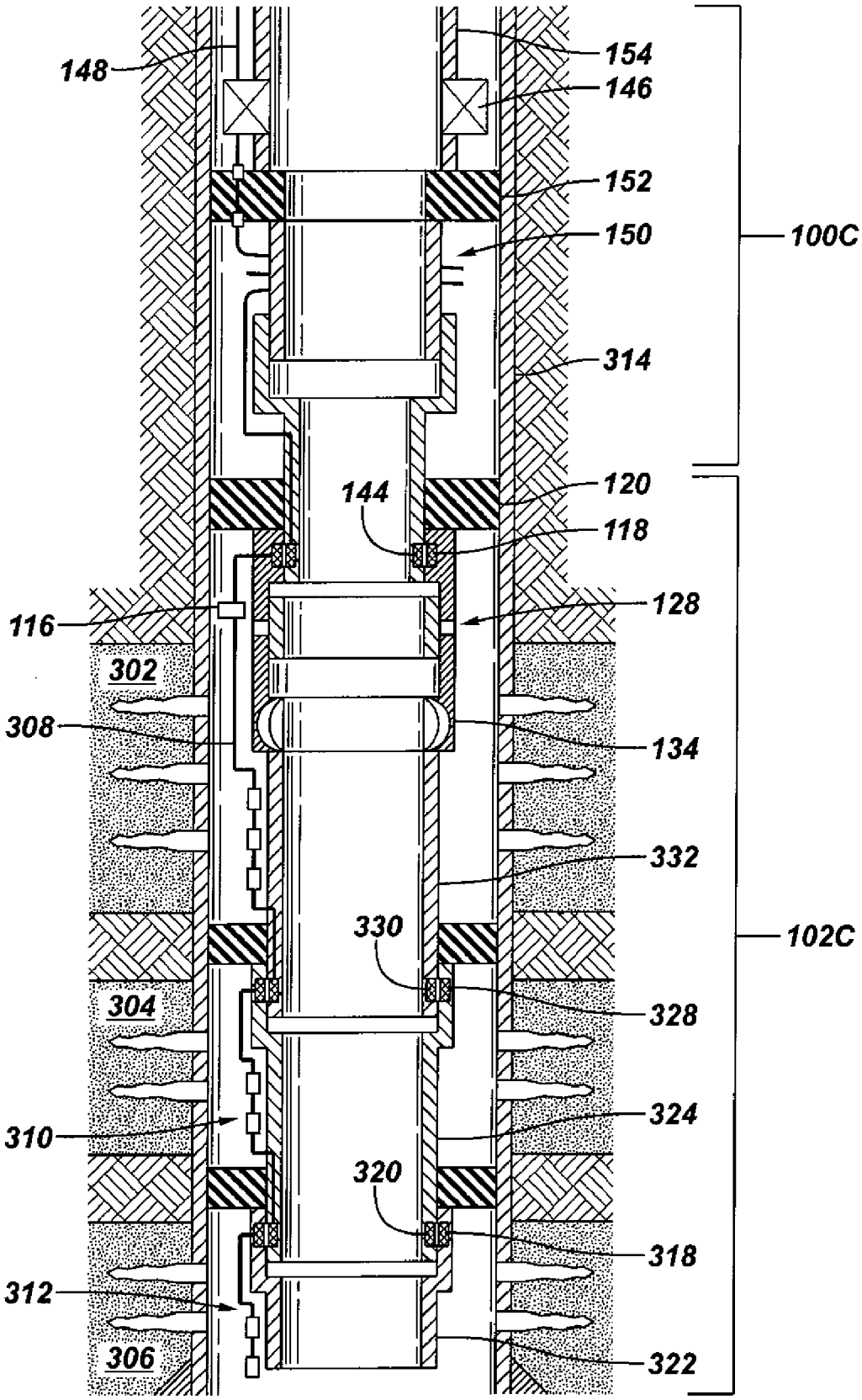

FIG. 6 shows a multi-stage completion system according to another embodiment that includes an upper completion section 100C and a lower completion section 102C that has multiple parts for multiple zones in the well. As depicted in FIG. 6, three producing zones (or injection zones) 302, 304, and 306 are depicted. The lower completion section 102C has three sets of sensor cables 308, 310, and 312 that are similar in arrangement to the sensor cable 112 of FIG. 1. Each sensor cable 308, 310, 312 has multiple sensors provided at discrete locations in respective zones 302, 304, 306. In the arrangement of FIG. 6, the zones 302, 304, and 306 are all lined with casing 314, unlike the open hole section depicted in FIG. 1. The casing 314 is perforated in each of the zones 302, 304, and 306 to enable communication between the well and reservoirs adjacent the well.

The lower completion section 102C includes a first lower packer 316 that provides isolation between zones 304 and 306, and a second lower packer 318 that provides isolation between zones 304 and 302. The lowermost sensor cable 312 is electrically connected to a first set of inductive coupler portions 318 and 320. The inductive coupler portion 318 is attached to a pipe section or screen that is attached to the first lower packer 316. On the other hand, the inductive coupler portion 320 is attached to another pipe section 324 or screen that extends upwardly to attach to another pipe section 326.

In the second zone 304, a second set of inductive coupler portions 328 and 330 are provided, where the inductive coupler portion 328 is attached to pipe section 326. On the other hand, the inductive coupler portion 330 is attached to pipe section 332 that extends upwardly to the formation isolation valve 134 of the lower completion section 102C. The remaining parts of the lower completion section 102C are similar to or the same as the lower completion section 102B of FIG. 5. The upper completion section 100C that is engaged with the lower completion section 102C is also similar to or the same as the upper completion section 100B of FIG. 5.

In operation, the lower completion section 102C is installed in different trips, with the lowermost part of the lower completion section 102C (that corresponds to the lowermost zone 306) installed first, followed by the second part of the lower completion zone 102C that is adjacent the second zone 304, followed by the part of the lower completion section 102C adjacent the zone 302.

Power and data communication between the controller cartridge 116 and the sensors of the sensor cables 310 and 312 is performed through the inductive couplers corresponding to portions 328, 330, and 318, 320.

Figure 7:
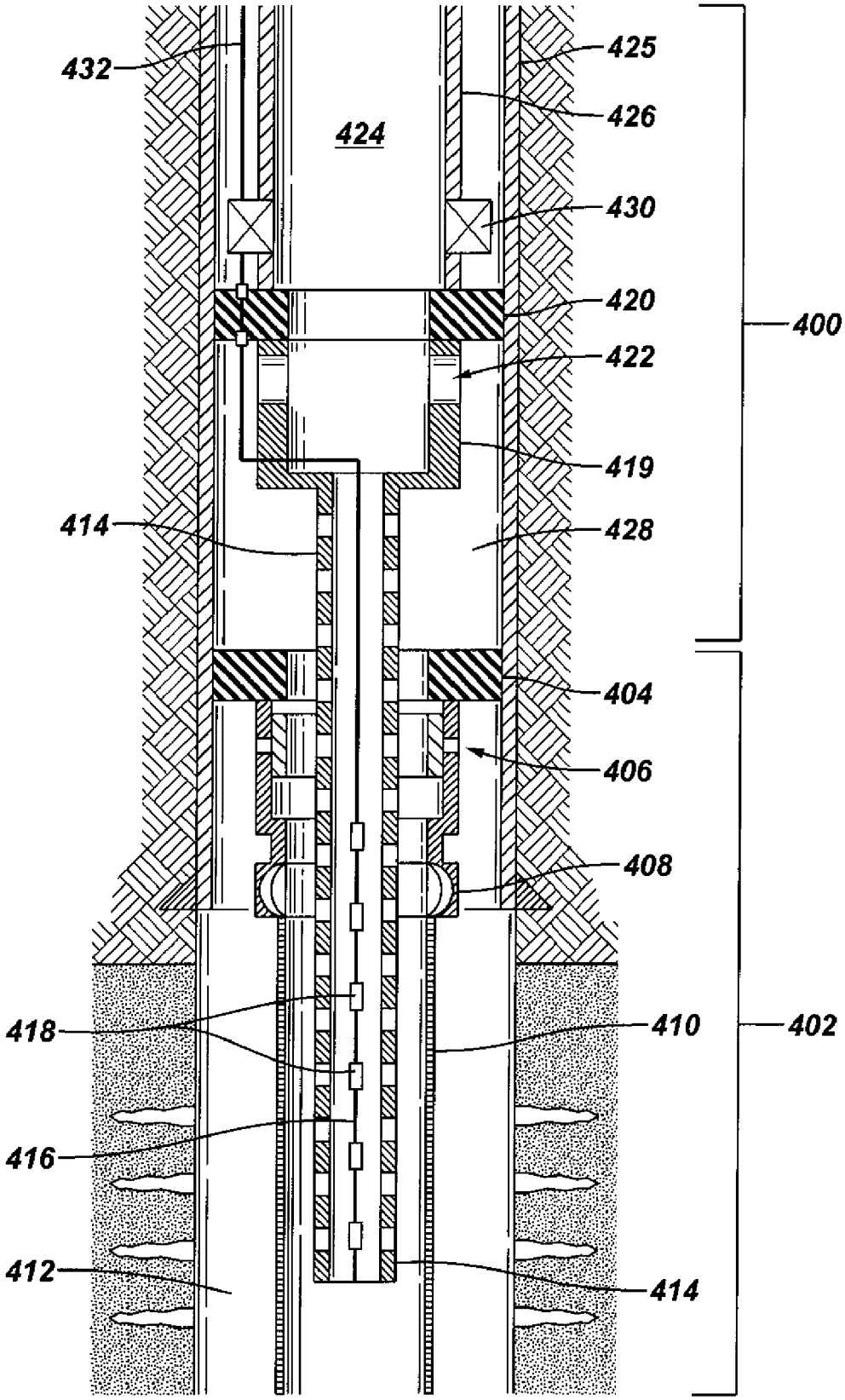
FIGS. 7, 8A, and 12 illustrate different embodiments of two-stage completion systems that do not use inductive couplers but which use stingers to deploy sensors.

FIG. 7 shows a two-stage completion system according to yet another embodiment that includes a lower completion section 402 and an upper completion section 400. A casing 425 lines a portion of the well. In the FIG. 7 embodiment, an inductively coupled wet connect mechanism is not employed, unlike the embodiments of FIGS. 1A-6. In FIG. 7, the lower completion section 402 includes a gravel pack packer 404 that is attached to a circulating port assembly 406. The lower completion section 402 also includes a formation isolation valve 408 below the circulating port assembly 406. A sand screen 410 is attached below the formation isolation valve 408 for sand control or control of other particulates. The lower completion section 402 is positioned proximate to an open hole zone 412 in which production (or injection) is performed.

Note that in the FIG. 7 embodiment, the lower completion section 402 does not include an inductive coupler portion. In the FIG. 7 embodiment, the upper completion section 400 has a stinger 414 that is made up of a slotted pipe having multiple slots to allow communication between the inner bore of the stinger 414 and the outside of the stinger 414. The stinger 414 extends into the lower completion section 402 in the proximity of the open hole zone 412.

Within the stinger 414 is arranged a sensor cable 416 having multiple sensors 418 at discrete locations across the zone 412. The sensor cable 416 extends upwardly in the stinger 414 until it exits the upper end of the stinger 414. The sensor cable 416 extends radially through a slotted pup joint 419 to a ported packer 420 of the upper completion section 400. The slotted pup joint 419 has slots 422 to allow communication between the inner bore 424 of a tubing 426 and the region 428 that is outside the upper completion section 400 and underneath the packer 420.

In the upper completion section 400, a control station 430 is provided above the packer 420. The sensor cable 416 extends through the ported packer 420 to the control station 430. The control station 430 in turn communicates over an electric cable 432 to an earth surface location or some other location in the well.

Unlike the embodiments depicted in FIG. 1A-6, the sensors 418 of the FIG. 7 embodiment are arranged inside the sand control assembly (rather than outside the sand control assembly). However, use of the stinger 414 allows for convenient placement of the sensors 418 across the sand face adjacent the sand screen 410.

In operation, the lower completion section 402 of FIG. 7 is first installed in the well adjacent the zone 412. Following gravel packing, the upper completion section 400 is run into the well, with the stinger 414 inserted into the lower completion section 402 such that the sensors 418 of the sensor cable 416 are positioned proximate to the zone 412 at various discrete locations. In some embodiment the lower completion section may not require gravel packing; instead, the lower completion section may include an expandable screen, cased and perforated hole, slotted liner, or open hole.

Figure 8A:
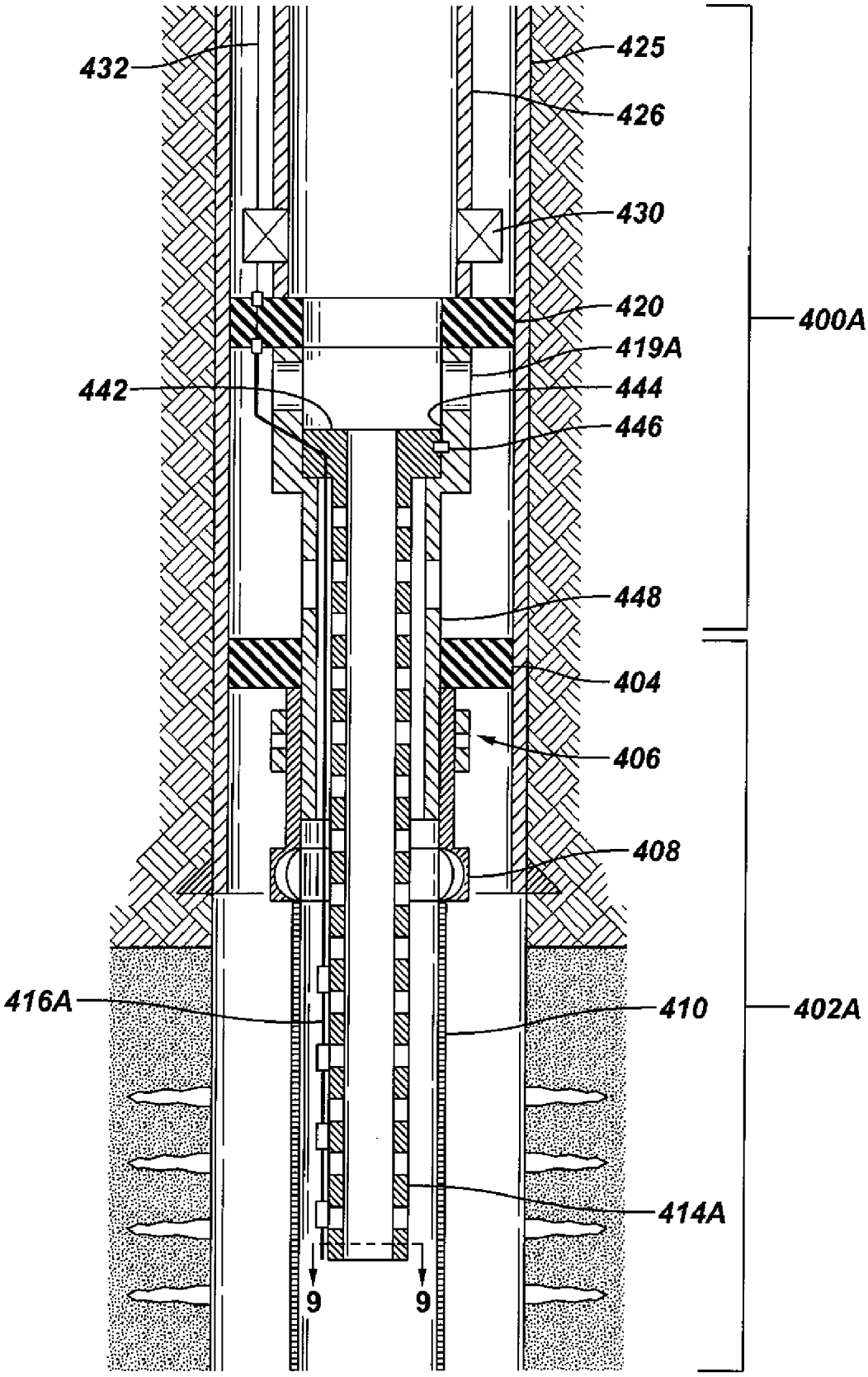
Figure 9:
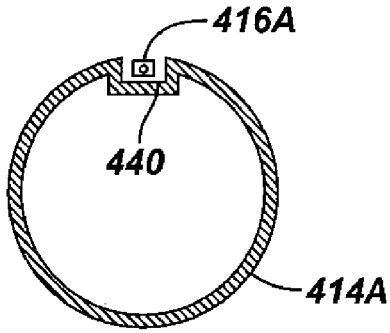
FIG. 9 is a cross-sectional view of a portion of a stinger and sensor cable in the completion system of FIG. 8A, according to an embodiment.

FIG. 8A shows yet another arrangement of a two-stage completion system having an upper completion section 400A and lower completion section 402A in which an inductively coupled wet connect mechanism is not used. A retrievable stinger 414A that is part of the upper completion section 400A is inserted into the lower completion section 402A. The lower completion section 402A is similar to or identical to the lower completion section 402 of FIG. 7. However, the stinger 414A in FIG. 8A has a longitudinal groove on its outer surface in which a sensor cable 416A is positioned. A cross-sectional view of a portion of the stinger 414A with the sensor cable 416A is depicted in FIG. 9. As shown in FIG. 9, a longitudinal groove (or dimple) 440 is provided in the outer surface of the stinger 414A such that the sensor cable 416A can be positioned in the groove 440.

Referring again to FIG. 8A, the sensor cable 416A extends upwardly until it reaches a stinger hanger 442 that rests in a stinger receptacle 444 of a slotted pup joint 419A. The sensor cable 416A extends radially through the stinger hanger 442 and the slotted pup joint 419A into a region outside the outer surface of the upper completion section 400A. The sensor cable 416A extends through the ported packer 420 to the control station 430.

Basically, the difference between the FIG. 8A embodiment and the FIG. 7 embodiment is that the sensor cable 416A is arranged outside the stinger 414A (rather than inside the stinger). Also, the stinger 414A is retrievable since it rests inside the stinger receptacle 444 on a stinger hanger 442. (FIG. 7 shows a fixed stinger that is part of the upper completion section 400). An intervention tool can be run into the well to engage the stinger hanger 442 of FIG. 8A to retrieve the stinger hanger 442 with the stinger 414A from the well. As depicted in FIG. 8A, a latching mechanism 446 is provided to engage the stinger hanger 442 to the stinger receptacle 444. In one example implementation, the latching mechanism 446 can be a snap latch mechanism.

Another difference between the upper completion section 400A of FIG. 8A and the upper completion section 400 of FIG. 7 is that the upper completion section 400A has a slotted pipe section 448 extending below the stinger receptacle 444. The slotted pipe section 448 extends into the lower completion section 402A, as depicted in FIG. 8A.

Figure 8B:
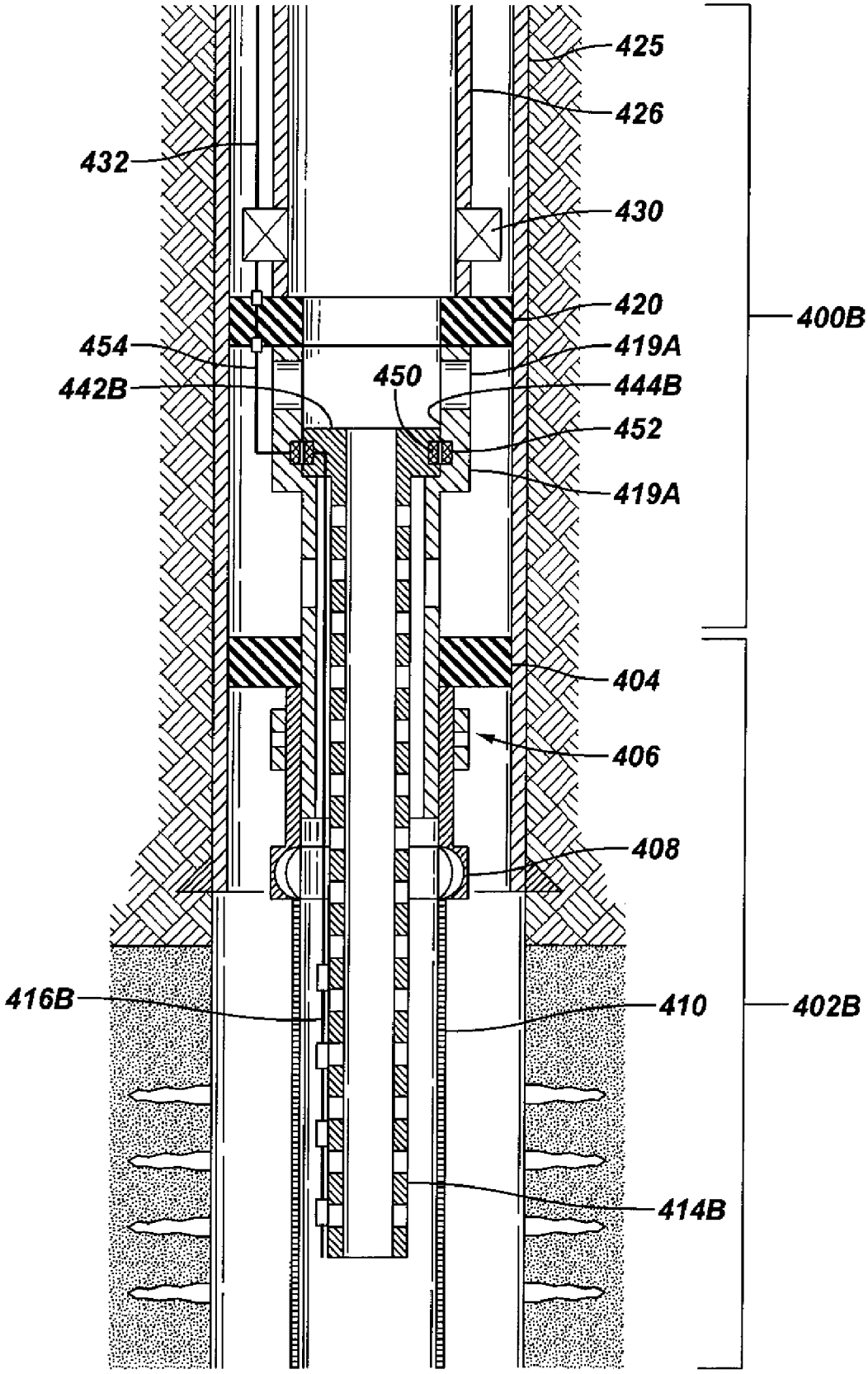
FIG. 8B illustrates a variant of the FIG. 8A embodiment that includes an inductive coupler.

FIG. 5B illustrates another variant of the two-stage completion system that also employs a retrievable stinger 414B. The stinger 414B extends from a stinger hanger 442B that rests in a stinger receptacle 444B. The difference between the FIG. 8B embodiment and the FIG. 8A embodiment is that the stinger hanger 442B has a first inductive coupler portion 450 (male inductive coupler portion) that is able to be inductively coupled to the second inductive coupler portion 452 (female inductive coupler portion) inside the stinger receptacle 444B. A sensor cable 416B (which also runs outside the stinger 414B but in a longitudinal groove) extends upwardly and is connected to the first inductive coupler portion 450 in the stinger hanger 442B. When the stinger hanger 442B is installed inside the stinger receptacle 444B, the first and second inductive coupler portions 450 and 452 are positioned adjacent each other so that electrical signaling and power can be inductively coupled between the inductive coupler portions 450 and 452.

The second inductive coupler portion 452 is connected to an electric cable 454, which passes through the ported packer 420 to the control station 430 above the packer 420.

In operation, the lower completion section 402B is first run into the well, followed by the upper completion section 400B in a separate trip. Then, the stinger 414B is run into the well, and installed in the stinger receptacle 444B of the upper completion section 400B.

Figure 10:
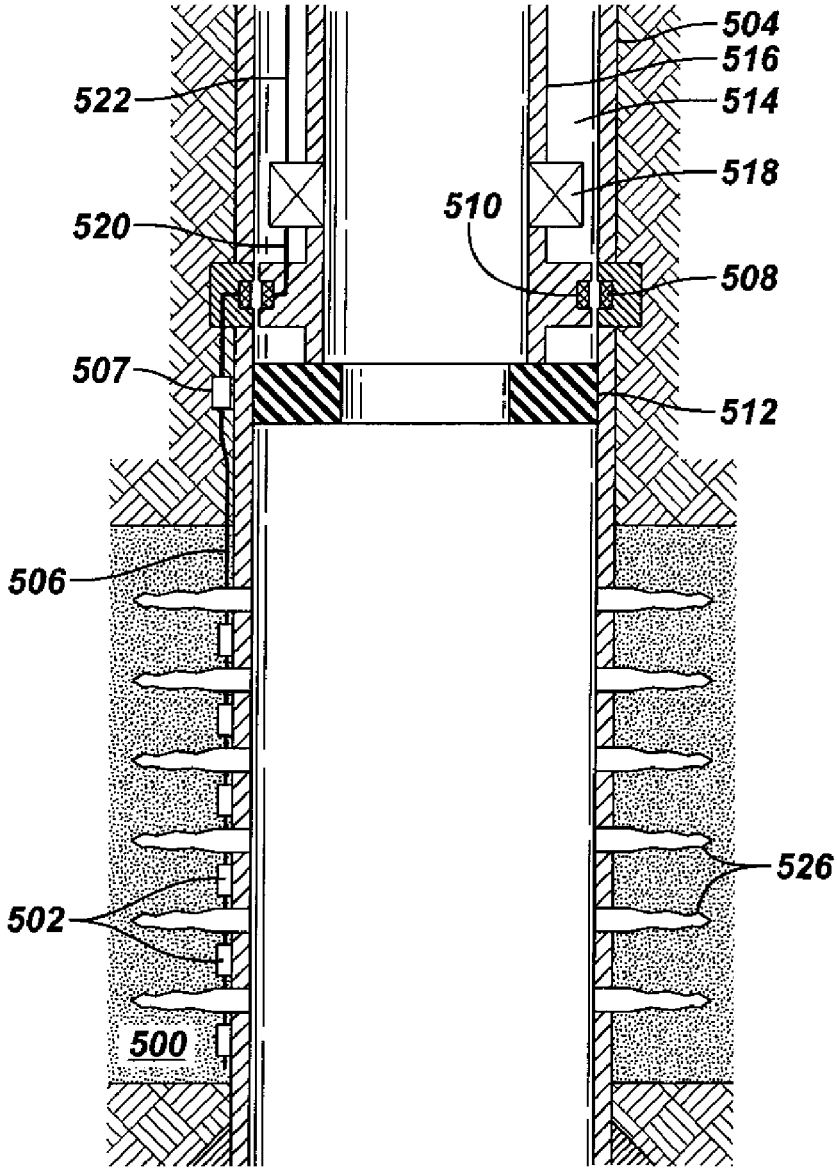
FIGS. 10 and 11 depict a completion system in which sensors and an inductive coupler portion are arranged outside a casing, according to other embodiments.

FIG. 10 illustrates yet another embodiment of another completion system that provides sensors in a producing (or injection) zone. In the embodiment of FIG. 10, sensors 502 are provided outside a casing 504 that lines the well. The sensors 502 are also part of a sensor cable 506. The sensors 502 are provided at various discrete locations outside the casing 504. The sensor cable 506 runs upwardly to a first inductive coupler portion 508 (female inductive coupler portion) through a controller cartridge 507. The first inductive coupler portion 508 interacts with a second inductive coupler portion 510 (male inductive coupler portion) to communicate power and data. The first inductive coupler portion 508 is located outside the casing 504, whereas the second inductive coupler portion 510 is located inside the casing 504.

Inside the casing 504, a packer 512 is set to isolate an annulus region 514 that is above the packer 512 and between a tubing 516 and the casing 504. The second inductive coupler portion 510 is electrically connected to a control station 518 over an electric cable section 520. In turn, the control station 518 is connected to another electric cable 522 that can extend to the earth surface or elsewhere in the well.

In operation, the casing 504 is installed into the well with the sensor cable 506 and first inductive coupler portion 508 provided with the casing 504 during installation. Subsequently, after the casing 504 has been installed, the completion equipment inside the casing can be installed, including those depicted in FIG. 10. Prior to or after installation of the components depicted in FIG. 10, a perforating gun (not shown) can be lowered into the well to the producing (or injection) zone 500. The perforating gun can then be activated to produce perforations 526 through the casing 504 and into the surrounding formation. Directional perforation can be performed to avoid damage to the sensor cable 506 that is located outside the casing 504.

Figure 11:
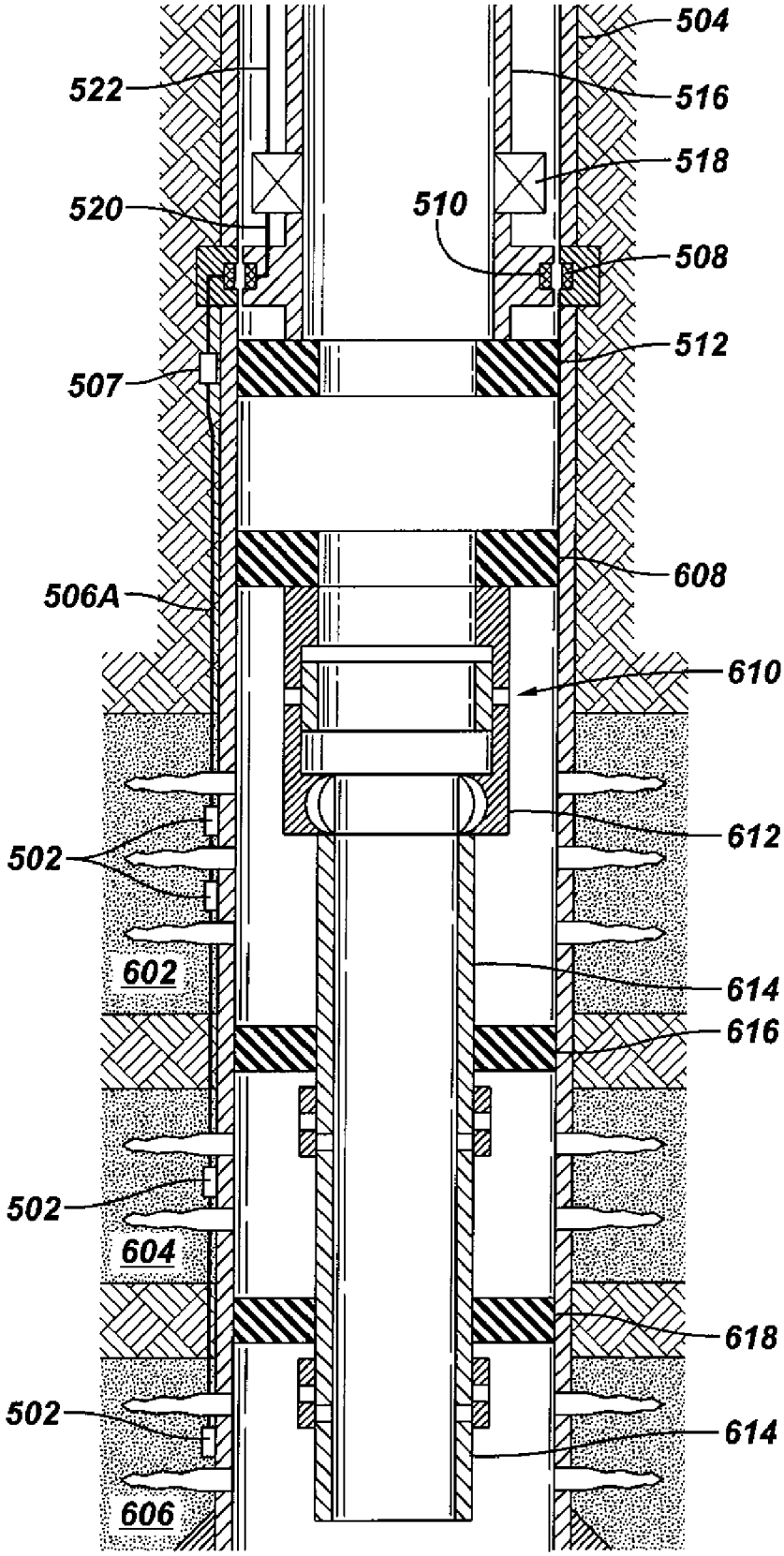

FIG. 11 illustrates yet another different arrangement of the completion system, which is similar to the completion system of FIG. 10 except that the completion system of FIG. 11 has multiple stages to correspond to multiple different zones 602, 604, and 606. In the embodiment of FIG. 11, a sensor cable 506A is also provided outside the casing 504, with the sensor cable 506A having sensors 502 provided at various locations in the different zones 602, 604, and 606. The sensor cable 506A extends to the first inductive coupler portion 508 through the controller cartridge 507.

The completion system of FIG. 11 also includes the packer 512, the second inductive coupler portion 510 inside the casing 504, control station 518, and electric cable sections 520 and 522, as in the FIG. 10 embodiment. The FIG. 11 embodiment differs from the FIG. 10 embodiment in that additional completion equipment is provided below the packer 512. In FIG. 11, a gravel pack packer 608 is provided, with a circulating port assembly 610 provided below the gravel pack packer 608. A formation isolation valve 612 is also provided below the circulating port assembly 610.

Further equipment below the formation isolation valve 612 include sand screens 614 and isolation packers 616 and 618 to isolate the zones 602, 604, and 606.

Figure 12:
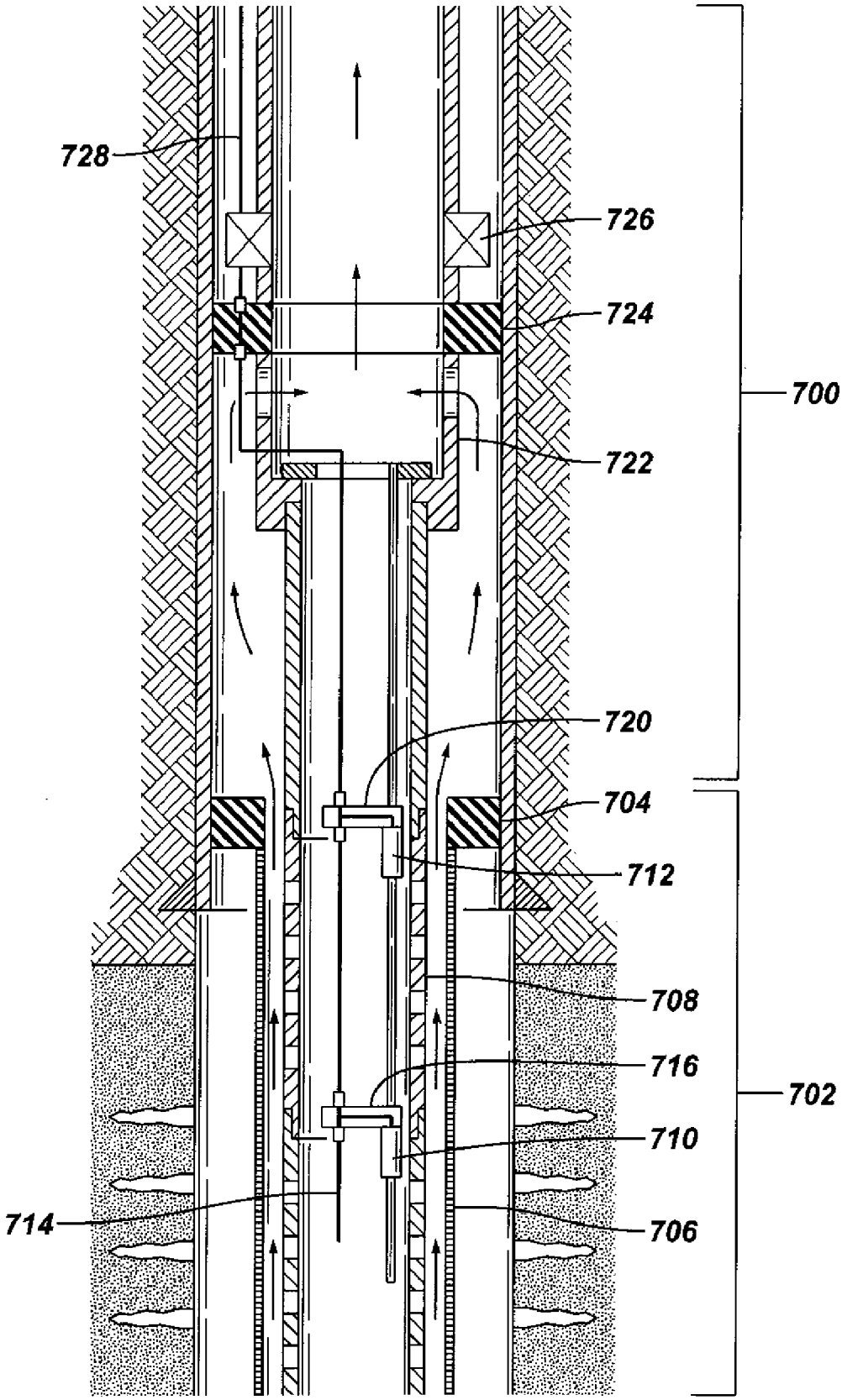

FIG. 12 illustrates another embodiment of a completion system that uses a stinger design and that does not use an inductively coupled wet connect mechanism. The completion system includes an upper completion section 700 and a lower completion section 702. In FIG. 12, a gravel pack packer 704 is set in a producing (or injection) zone, with a sand screen 706 attached below the packer 704. The gravel pack packer 704 and screen 706 are part of the lower completion section 702.

The upper completion section 700 includes a stinger 708 (which includes a perforated pipe). Within the inner bore of the stinger 708 are arranged various sensors 710 and 712. The sensors 710 and 712 are connected by Y-connections to an electric cable 714. The electric cable 714 runs through Y-connect bulkheads 716 and 720 and exits the upper end of the stinger 708. The electric cable 714 extends radially through a ported sub 722 and then passes through a ported packer 724 of the upper completion section 700 to a control station 726. The control station 726 in turn is connected by an electric cable 728 to the earth surface or to another location in the well.

Figure 13:
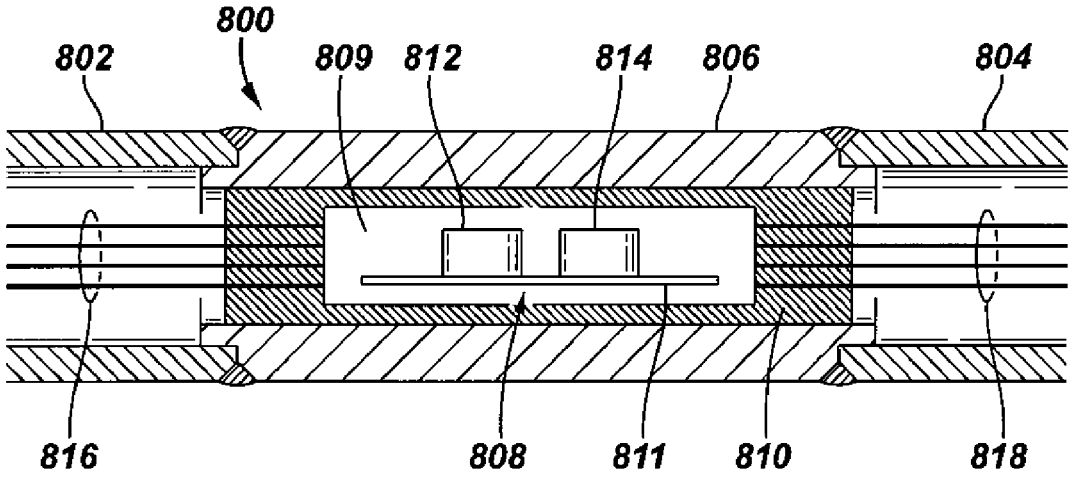
FIGS. 13 and 14 illustrate different embodiments of portions of sensor cables usable in the various completion systems.

FIG. 13 shows a portion of a sensor cable 800 according to an embodiment, which can be any one of the sensor cables mentioned above. The sensor cable 800 includes outer housing sections 802 and 804, which are sealably connected to a sensor housing structure 806 that houses a sensor support 810 and a sensor 808. The sensor 808 is positioned in a chamber 809 of the sensor support 810. The sensor support housing 806 and the housing sections 802 and 804 of the sensor cable 800 can be formed of metal. The housing sections 802, 804 can be welded to sensor support housing 806 to provide a sealing engagement (to keep wellbore fluids from entering the sensor cable 800). The sensor support 810 can also be formed of a metal to act as a chassis. As an example, the metal used to form the sensor support 810 can be aluminum. Similarly, the metal used to form the housing sections 802, 804 and sensor support housing 806 can also be aluminum. If the sensor 808 is a temperature sensor, then aluminum is a relatively good thermal coupler to allow for accurate temperature measurement. However, in other implementations, other types of metal can be used. Also, non-metallic materials can also be used to implement elements 802, 804, 806, and 810.

As further depicted in FIG. 13, the sensor 808 includes a sensor chip 812 (e.g., a sensor chip to measure temperature) and a communications interface 814 (electrically connected to the sensor chip 812) to enable communication with electrical wires 816 and 818 that extend in the sensor cable 800. In one example implementation, the communications interface 814 is an I2C interface. Alternatively, other types of communications interfaces can be used with the sensor 808. The sensor chip 812 and interface 814 can be mounted on a circuit board 811 in one implementation.

The portion depicted in FIG. 13 is repeated along the length of the sensor cable 800 to provide multiple sensors 808 along the sensor cable 800 at various discrete locations. In accordance with some embodiments, the sensor cable 800 is implemented with bi-directional twisted pair wires, which have relatively high immunity to noise. Signals on twisted pair wires are represented by voltage differences between two wires. The successive housing sections 802, 804 and sensor housing structures 806 are collectively referred to as the "outer liner" of the sensor cable 800.

A benefit of using welding in the sensor cable is that O-ring or discrete metal seals can be avoided. However, in other implementations, O-ring or metal seals can be used. In an alternative implementation, instead of using welding to weld the housing sections 802, 804 with the sensor support housing 806, other forms of sealing engagement or attachment can be provided between the housing sections 802, 804, and sensor support housing 806.

Figure 14:
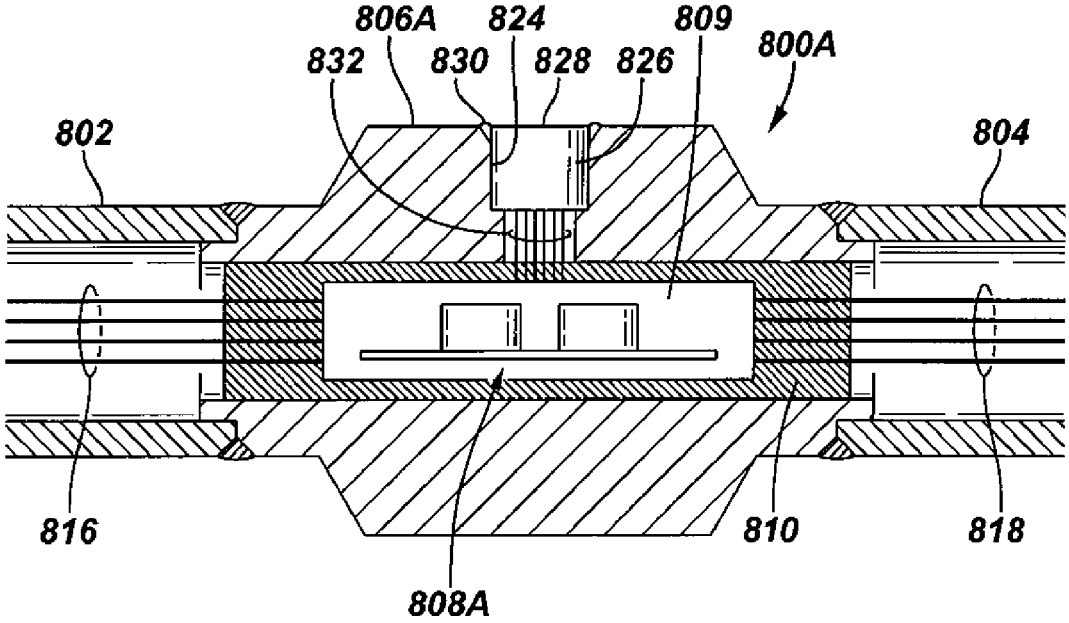

FIG. 14 illustrates a sensor cable 800A according to a different embodiment. In this embodiment, housing sections 802, 804 of the sensor cable 800A are sealably connected to a sensor support housing 806A that has an outer diameter wider than the outer diameter of the housing sections 802, 804. In other words, the sensor support housing 806A protrudes radially outwardly with respect to the housing sections 802, 804. As with the sensor cable 800 of FIG. 13, the housing sections 802, 804 can be welded to the sensor support housing 806A to provide sealing engagement. Alternatively, other forms of sealing engagement or attachment can be employed. The enlarged diameter or width of the sensor support housing 806A allows for a cavity 824 to be defined in the sensor support housing 806A. The cavity 824 can be used to receive a pressure and temperature sensor element 826, which can be used to detect both pressure and temperature (or just one of pressure and temperature) or any other type of sensors. An outer surface 828 of the sensor element 826 is exposed to the external environment outside the sensor cable 800A. The sensor element 826 is sealably attached to the sensor support housing 806A by connections 830, which can be welded connections or other types of sealing connections.

Wires 832 connect the sensor element 826 to sensor 808A contained in the sensor support 810 inside the sensor support housing 806A. The wires 832 connect the sensor element 826 to the sensor chip 812 of the sensor 808A, which sensor chip 812 is able to detect pressure and temperature based on signals from the sensor element 826.

Figure 15:
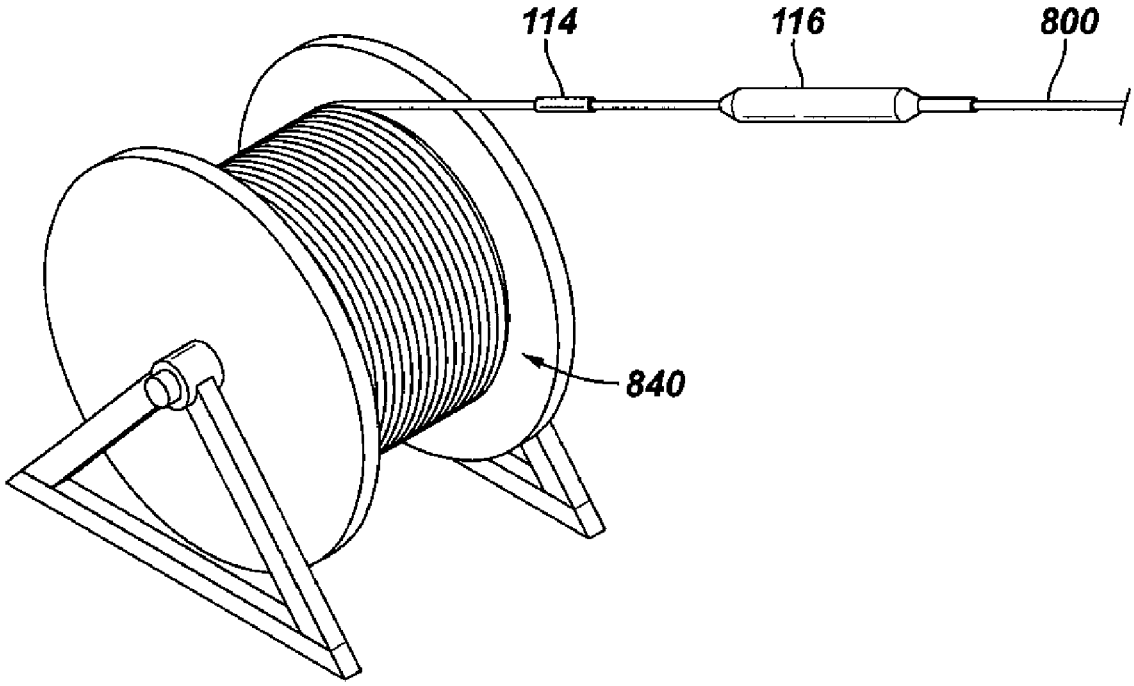
FIG. 15 illustrates a spool on which a sensor cable is wound, according to an embodiment.

FIG. 15 shows a sensor cable 800 that is deployed on a spool 840. As depicted in FIG. 15, the sensor cable 800 includes the controller cartridge 116 and a sensor 114. Additional sensors 114 that are part of the sensor cable 800 are wound onto the spool 840. To deploy the sensor cable 800, the sensor cable 800 is unwound until a desired length (and number of sensors 114) has been unwound, and the sensor cable 800 can be cut and attached to a completion system.

Figure 16:
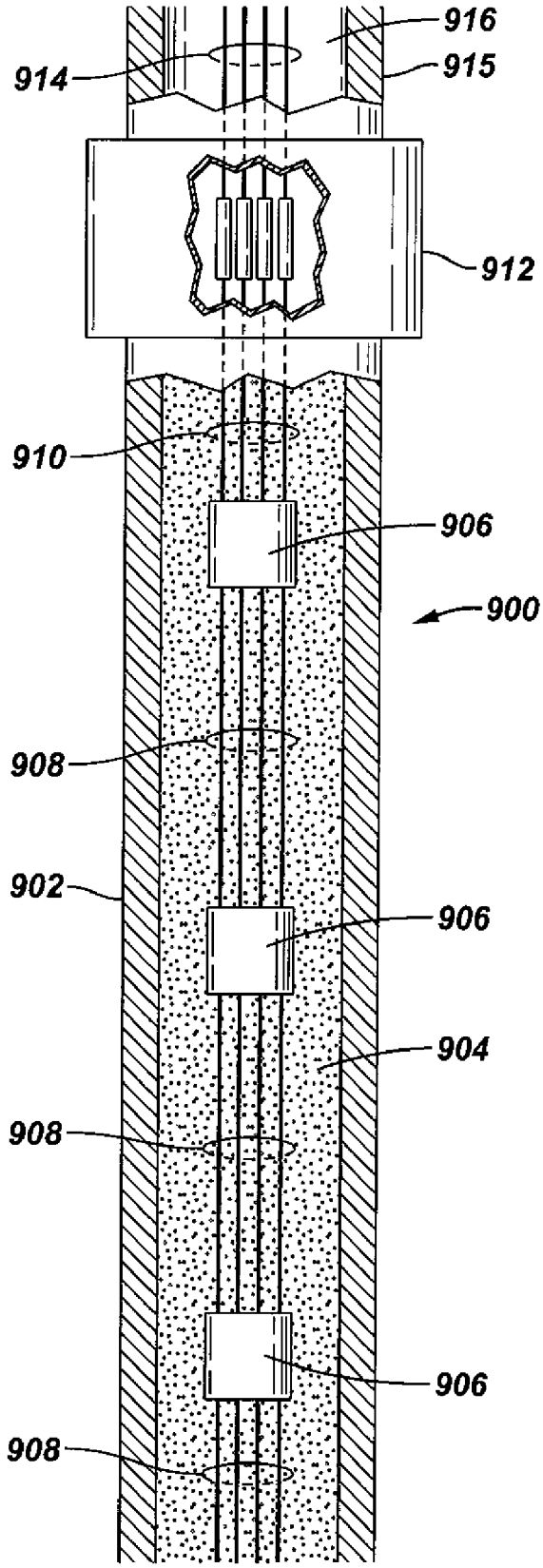
FIGS. 16-18 illustrate other types of sensor cables, according to further embodiments.

FIG. 16 shows an alternative embodiment of a sensor cable 900, which is made up of a control line 902 (which can be formed of a metal such as steel, for example). Note that the control line 902 is a continuous control line that includes multiple sensors. The control line 902 has an inner bore 904 in which sensors 906 are provided, where the sensors 906 are interconnected by electrical wires 908. In accordance with some embodiments, the inner bore 904 of the control line 902 is filled with a non-electrically conductive liquid to provide efficient heat transfer between the outside of the control line 902 and the sensors 906. The non-electrically conductive liquid (or other fluid) in the inner bore 904 is thermally conductive to provide the heat transfer Also, the fluid in the control line 902 allows for averaging of temperature over a certain length of the control line 902, due to the thermally conductive characteristics of the fluid.

In accordance with some embodiments, the sensors 906 can be implemented with resistance temperature detectors (RTDs). RTDs are thin film devices that measure temperature based on correlation between electrical resistance of electrically-conductive materials and changing temperature. In many cases, RTDs are formed using platinum due to platinum's linear resistance-temperature relationship. However, RTDs formed of other materials can also be used. Precision RTDs are widely available within the industry, for example, from Heraeus Sensor Technology, Reinhard-Heraeus-Ring 23, D-63801 Kleinostheim, Germany.

The use of inductive coupling according to some embodiments enables a significant variety of sensing techniques, not just temperature measurements. Pressure, flow rate, fluid density, reservoir resistivity, oil/gas/water ratio, viscosity, carbon/oxygen ratio, acoustic parameters, chemical sensing (such as for scale, wax, asphaltenes, deposition, pH sensing, salinity sensing), and so forth can all receive power and/or data communication through inductive coupling. It is desirable that sensors be of small size and have relatively low power consumption. Such sensors have recently become available in the industry, such as those described in WO 02/077613. Note that the sensors may be directly measuring a property of the reservoir, or the reservoir fluid, or they may be measuring such properties through an indirect mechanism. For example, in the case that geophones or acoustic sensors are located along the sand face and where such sensors measure acoustic energy generated in the formation, that energy may come from the release of stress caused by the cracking of rock formation in a hydraulic fracturing of a nearby well. This information in turn is used to determine mechanical properties of the reservoir, such as principle stress directions, as has been described, for example, in U.S. Publication No. 2003/0205376.

The uppermost sensor 906 depicted in FIG. 16 is connected by wires 910 to a splice structure 912, which interconnects the wires 910 to wires 914 inside a control line 915 that leads to a controller cartridge (not shown in FIG. 16). Note that the splice structure 912 is provided to isolate the fluids in the control line bore 904 from a chamber 916 in the control line 915.

Figure 17:
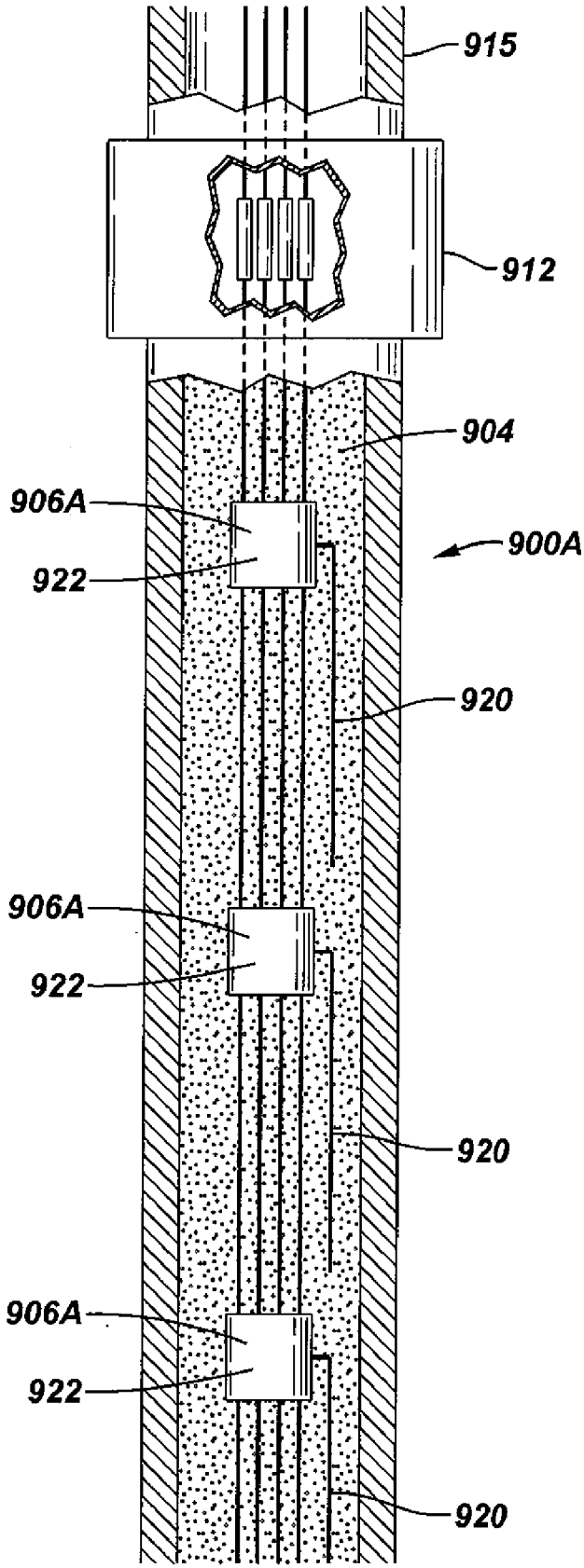

FIG. 17 illustrates a different arrangement of a sensor cable 900A. The sensor cable 900A also includes the control line 902 that defines the inner bore 904 containing a non-electrically conductive fluid. However, the difference between the sensor cable 900A of FIG. 17 and the sensor cable 900 of FIG. 16 is the use of modified sensors 906A in FIG. 17. The sensors 906A include an RTD wire filament 920 (which has a resistance that varies with temperature). The filament 920 is connected to an electronic chip 922 for detecting the resistance of the RTD wire filament 920 to enable temperature detection.

Figure 18:
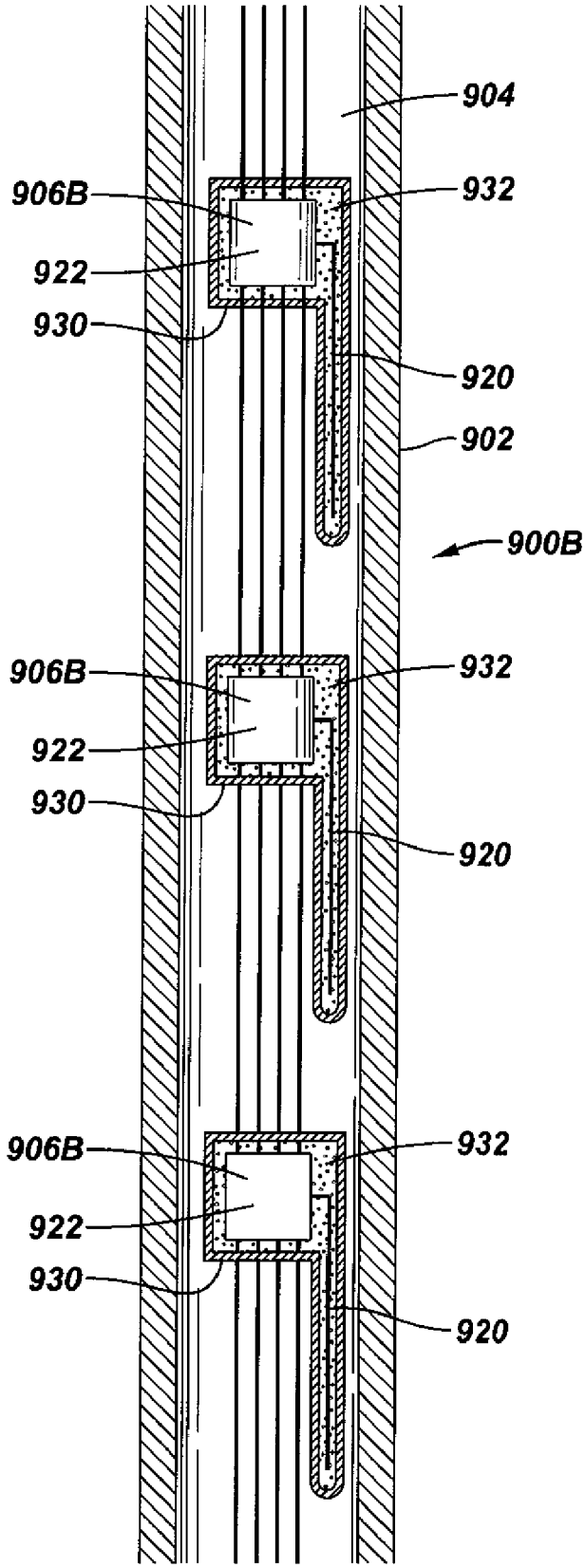

FIG. 18 illustrates yet another arrangement of a sensor cable 900B. In this embodiment, the control line 902 does not contain a liquid (rather, the inner bore 904 of the control line 902 contains air or some other gas). The sensor cable 900B includes sensors 906B have an encapsulating structure 930 to contain a non-electrically conductive liquid 932 in which the RTD filament wire 920 and electronic chip 922 are provided.

Figure 19:
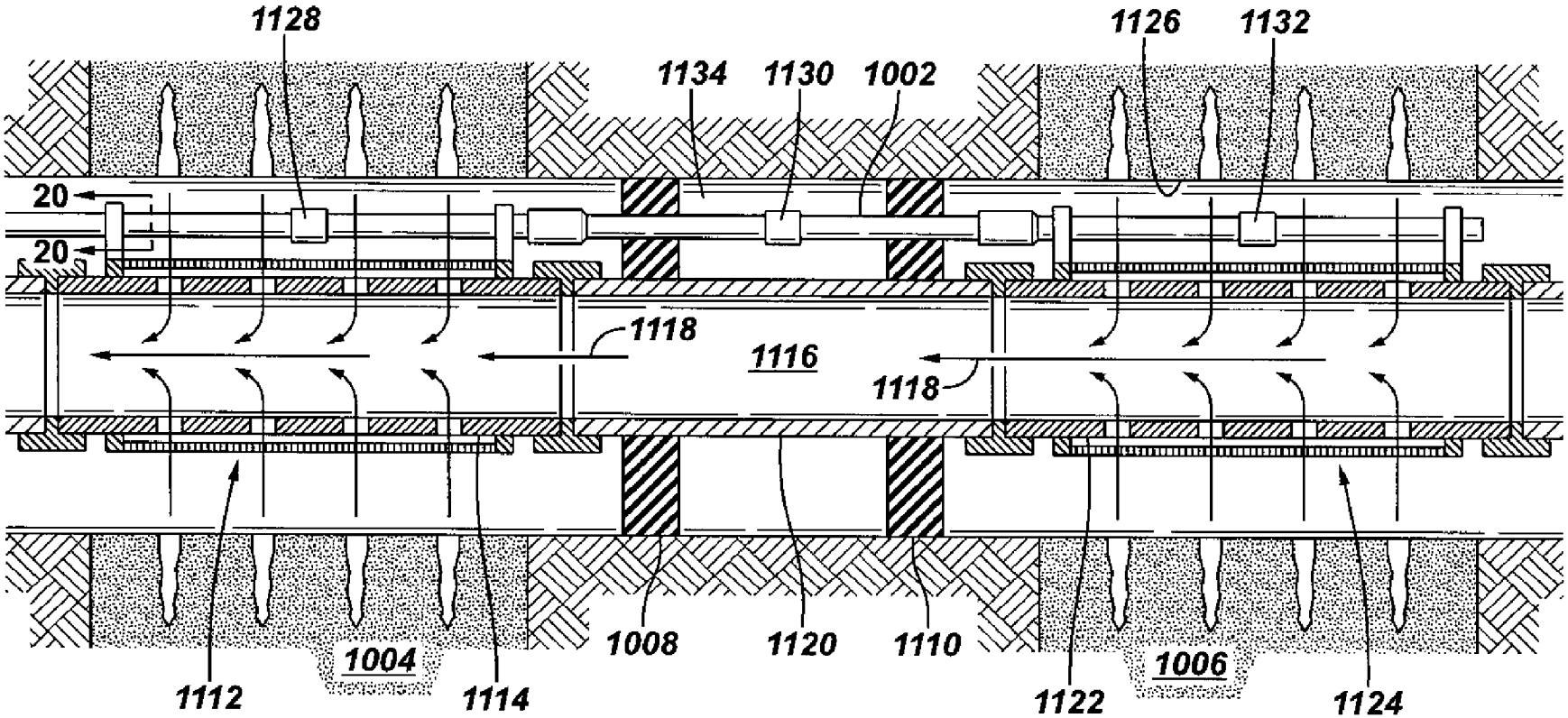
FIG. 19 is a longitudinal cross-sectional view of a completion system that includes a shunt tube to which a sensor cable is attached.

FIG. 19 shows a longitudinal cross-sectional view of another embodiment of a completion system that includes a shunt tube 1002 for carrying gravel slurry for gravel packing operations. The shunt tube 1002 extends from an earth surface location to the zones of interest. Two zones 1004 and 1006 are depicted in FIG. 19, with packers 1008 and 1010 used for zonal isolation.

In the first zone 1004, a screen assembly 1112 is provided around a perforated base pipe 1114. As depicted, fluid is allowed to flow from the reservoir in zone 1004 through the screen assembly 1112 and through perforations of the perforated pipe 1114 into an inner bore 1116 of the completion system depicted in FIG. 19. Once the fluid enters the inner bore 1116, fluid flows in the direction indicated by arrows 1118.

The perforated base pipe 1114 at its lower end is connected to a blank pipe 1120. The lower end of the blank pipe 1120 is connected to another perforated base pipe 1122 that is positioned in the second zone 1006. A screen assembly 1124 is provided around the perforated base pipe 1122 to allow fluid flow from the reservoir adjacent zone 1006 to flow fluid into the inner bore 116 of the completion system through the screen assembly 1124 and the perforated base pipe 1122.

The perforated base pipes 1114, 1122, and the blank pipe 1120 make up a production conduit that contains the inner bore 1116. The shunt tube 1002 is provided in an annular region between the outside of this production conduit and a wall 1126 of the wellbore. In FIG. 19, the wall 1126 is a sand face. Alternatively, the wall 1126 can be a casing or liner.

As further depicted in FIG. 19, sensors 1128, 1130, and 1132 are attached to the shunt tube 1002. The sensor 1128 is provided in the zone 1004 and the sensor 1132 is provided in the zone 1006. The sensors 1128 and 1132 are placed in radial flow paths of the respective zones 1004 and 1006. On the other hand, the sensor 1130 is positioned between packers 1008 and 1110, which is in a non-flowing area of the wellbore (no fluid flow in the radial direction or longitudinal direction in the space 1134 that is defined between the two packers 1008 and 1110 and between the blank pipe 1120 and the inner wall 1126 of the wellbore).

Figure 20:
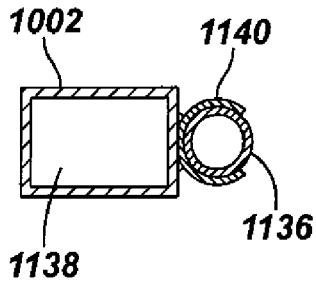
FIG. 20 is a cross-sectional view of the shunt tube and sensor cable of FIG. 19.

The sensors 1128, 1130, and 1132 are sensors on a sensor cable. A cross-sectional view of the shunt tube 1002 and a sensor cable 1136 is depicted in FIG. 20. The shunt tube 1002 has an inner bore 1138 in which gravel slurry is flowed when performing gravel packing operations. In a gravel packing operation, gravel slurry is pumped down the inner bore 1138 of the shunt tube 1002 to annular regions in the wellbore that are to be gravel packed. Attached to the shunt tube 1002 is a sensor holder clip 1140 (that is generally C-shaped in the example implementation). The sensor cable 1136 is held in place by the sensor holder clip 1140. The sensor holder clip 1140 is attached to the shunt tube 1002 by any one of various mechanisms, such as by welding or by some other type of connection. In an alternate embodiment, the shunt tubes can be omitted and a screen without shunt tube is used. The gravel is pumped in the annular cavity between the screen outer surface and wall of the well. A cable protector is attached to a screen base pipe between successive sections of the screen (or slotted or perforated pipe) for protecting the sensor and cable. In another embodiment, the sensor cable and sensors are secured to contact a base pipe such that the base pipe provides both an electrical ground for the sensor cable and sensors, and acts as a heat sink to allow dissipation of heat from the sensor cable and sensors to the base pipe.

Figure 21:
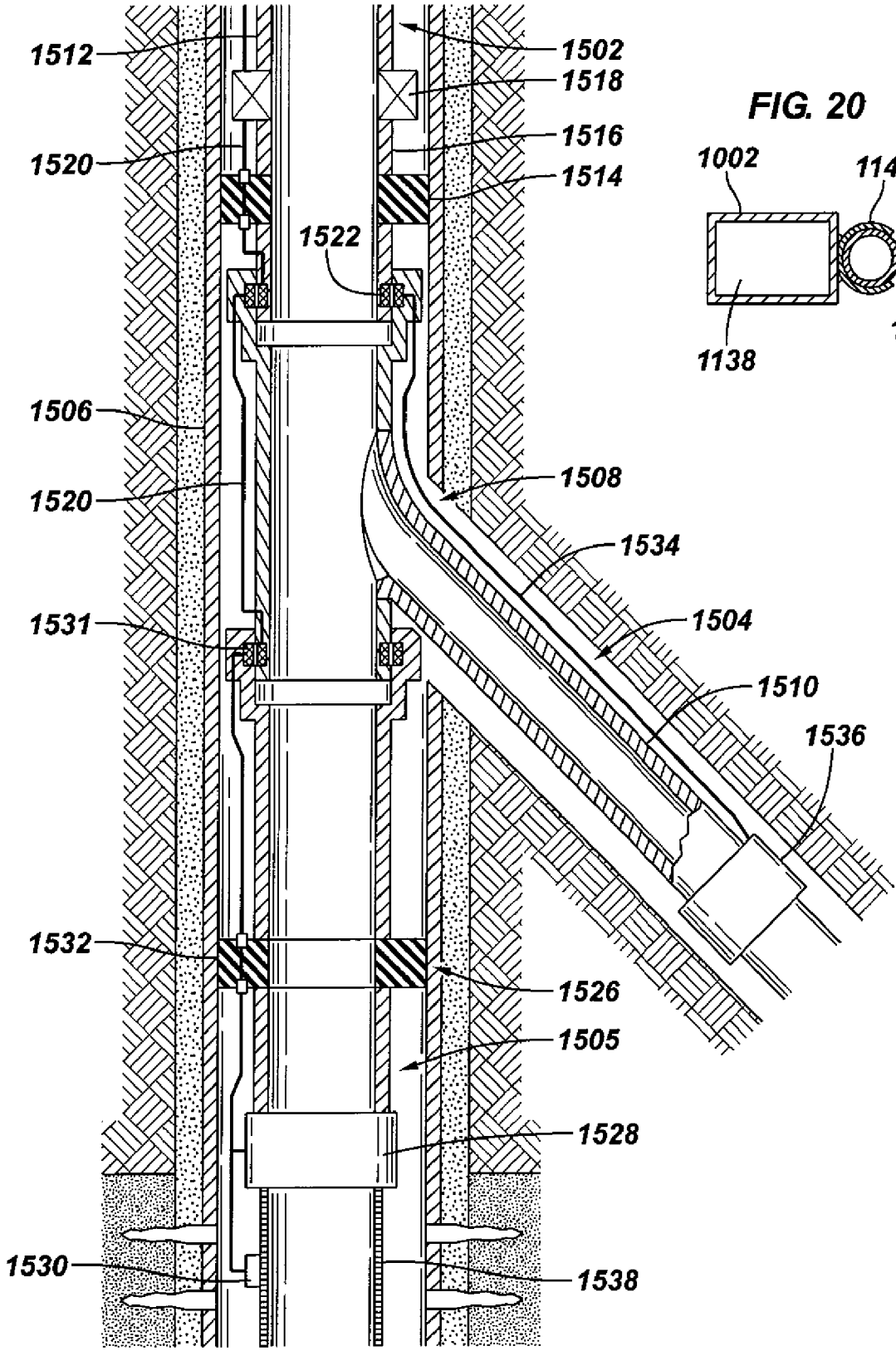
FIG. 21 illustrates a completion system for use in a multilateral well, according to another embodiment.

FIG. 21 shows an example completion system for use with a multilateral well. In the example of FIG. 21, the multilateral well includes a main wellbore section 1502, a lateral branch 1504, and a section 1505 of the main wellbore 1502 that extends below the lateral branch junction between the main wellbore 1502 and the lateral branch 1504.

As depicted in FIG. 21, the main wellbore 1502 is lined with casing 1506, with a window 1508 formed in the casing 1506 to enable a lateral completion 1510 to pass into the lateral branch 1504.

An upper completion section 1512 is provided above the lateral branch junction. The upper completion section 1512 includes a production packer 1514. Attached above the production packer 1514 is a production tubing 1516, to which a control station 1518 is attached. The control station 1518 is connected by an electric cable 1520 that passes through the production packer 1514 to an inductive coupler 1522 below the production packer 1514.

The completion in the main wellbore and the lateral is very similar to the FIG. 1A embodiment. In a variant of the FIG. 1A embodiment, flow control devices that are remotely controlled are provided. The power and communication from the main bore to lateral is accomplished though an inductive coupler 1522.

In turn, the electric cable 1520 (which is part of a lower completion section 1526) further passes through a lower packer 1532. The electric cable 1520 connects the inductive coupler 1522 to control devices (e.g., flow control valves) 1528 and sensors 1530. The lower completion section 1526 also includes a screen assembly 1538 to perform sand control. The sensors 1530 are provided proximate to the sand control assembly 1538. The lower completion may not include screen in some embodiments.

Depending on the multilateral junction construction and type an inductive coupler is run with the junction. A cable is run from junction inductive coupler to flow control valves and sensors in the junction completion similar to the FIG. 1A embodiment. The cable 1534 from inductive coupler 1522 connects to the flow control valve and sensor 1536 in the completion in the lateral section 1504.

As part of the lower completion section 1526, another inductive coupler 1531 is provided to allow communication between the electric cable 1520 and an electric cable of the main bore completion that extends into the main bore section 1505 to flow control devices and/or sensors 1528 and 1530 in the main bore section 1505.

Figure 22:
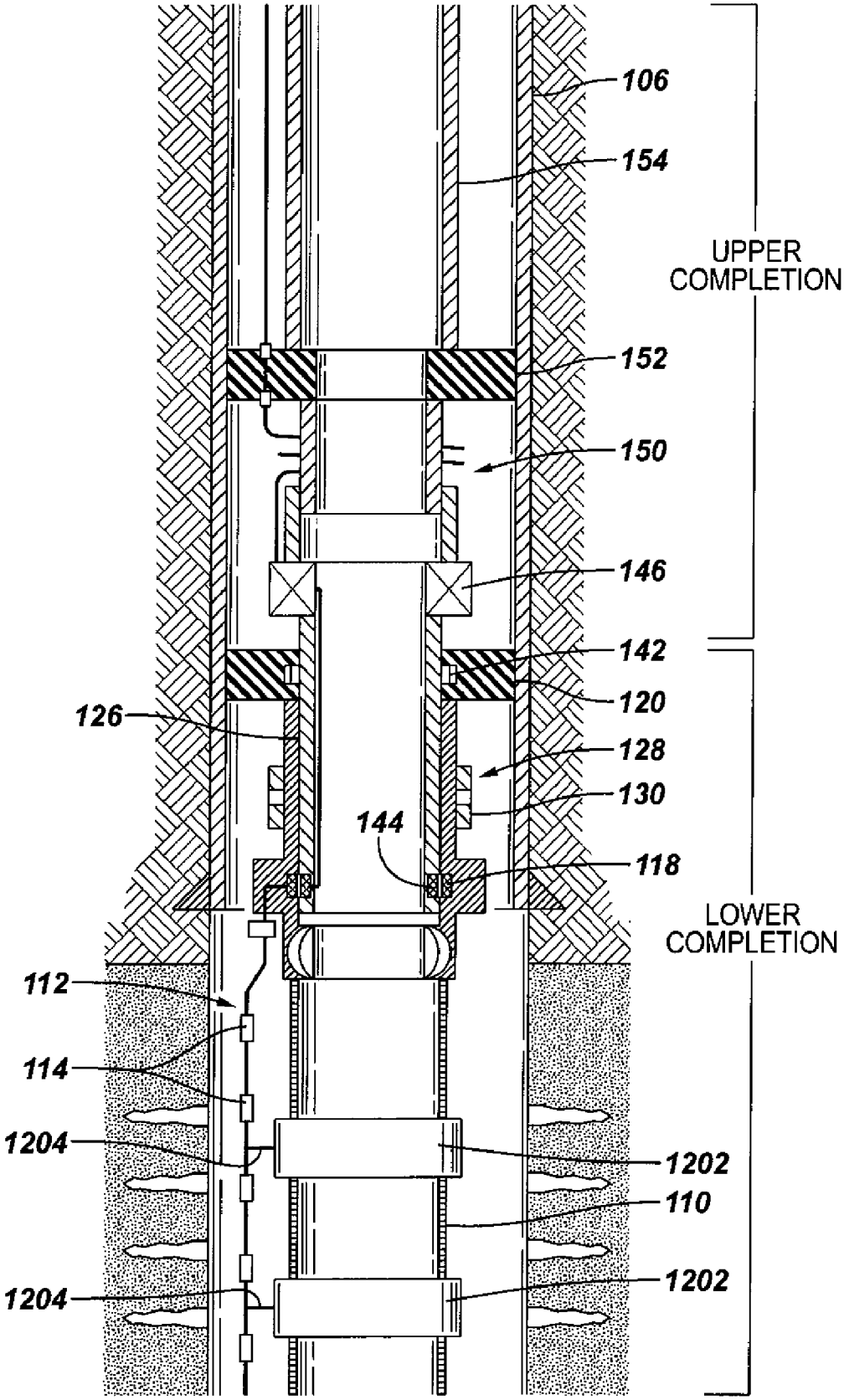
FIG. 22 illustrates a two-stage completion system that is a variant of the completion system of FIG. 1A, according to a further embodiment.

FIG. 22 shows another embodiment of a two-stage completion system that is a variant of the FIG. 1A embodiment. In the FIG. 22 embodiment, flow control devices 1202 (or other types of control devices that are remotely controllable) are provided with the sand control assembly 110. The flow control devices (or other remotely-controllable devices) are connected by respective electrical connections 1204 (such as in the form of electrical wires) to the sensor cable 112.

With this implementation, the sensor cable 112 not only is able to provide communication with sensors 114, but also is able to enable a well operator to control flow control devices (or other remotely-controllable devices) located proximate to a sand control assembly from a remote location, such as at the earth surface.

The types of flow control devices 1202 that can be used include hydraulic flow control valves (which are powered by using a hydraulic pump or atmospheric chamber that is controlled with power and signal from the earth surface through the control station 146); electric flow control valves (which are powered by power and signaling from the earth surface through the control station 146); electro-hydraulic valves (which are powered by power and signaling from the earth surface through the control station 146 and the inductive coupler); and memory-shaped alloy valves (which are powered by power and signaling from the earth surface through the control station and inductive coupler).

With electric flow control valves, a storage capacitance (in the form of a capacitor) or any other power storage device can be employed to store a charge that can be used for high actuation power requirements of the electric flow control valves. The capacitor can be trickle charged when not in use.

For electro-hydraulic valves, which employ pistons to control the amount of flow through the electro-hydraulic valves, signaling circuitry and solenoids can control the amount of fluid distribution within the pistons of the valves to allow for a large number of choke positions for fluid flow control.

A memory-shaped alloy valve relies on changing the shape of a member of the valve to cause the valve setting to change. Signaling is applied to change the shape of such element.

Figure 23:
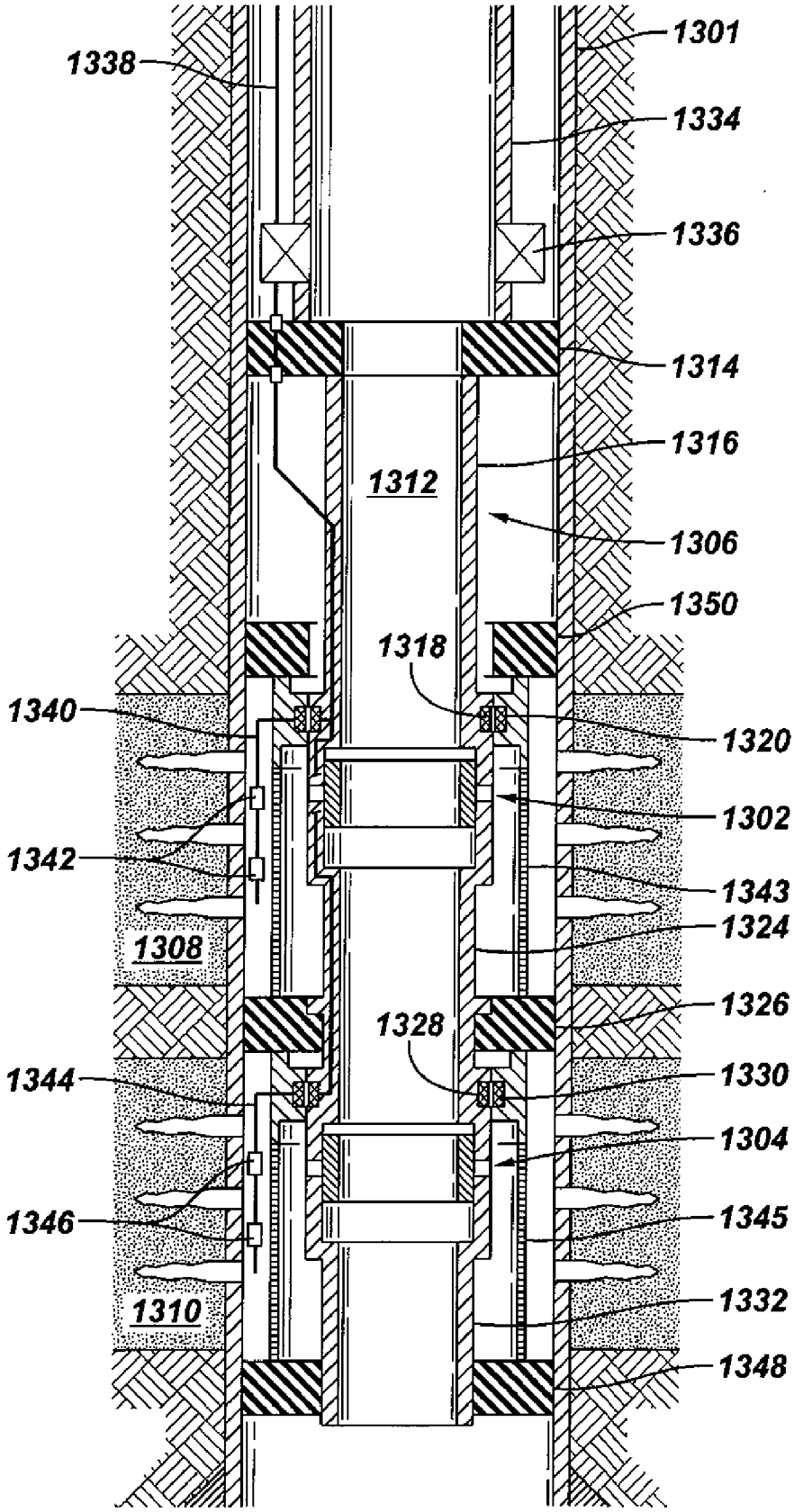
FIGS. 23-25 and 27-28 illustrate other embodiments of completion systems in which inductive couplers are used.

FIG. 23 depicts yet another arrangement of a two-stage completion system having an upper completion section 1306 and a lower completion section 1322. The upper completion section 1306 includes flow control valves 1302 and 1304, which are provided to control radial flow between respective zones 1308 (upper zone) and 1310 (lower zone) and an inner bore 1312 of the completion system. The flow control valve 1302 is an "upper" flow control value, and the flow control valve 1304 is a "lower" flow control valve. Cable 1338 from surface is electrically connected to flow control valves 1302 and 1304 through electrical conductors (not shown).

The upper completion section 1306 further includes a production packer 1314. A pipe section 1316 extends below the production packer 1314. A male inductive coupler portion 1318 is provided at a lower end of the pipe section 1316. The male inductive coupler portion 1318 interacts or axially aligns with a female inductive coupler portion 1320 that is part of the lower completion section 1322. The inductive coupler portions 1318 and 1320 together form an inductive coupler that provides an inductively coupled wet connect mechanism.

The upper completion section 1306 further includes a housing section 1324 to which the flow control valve 1302 is attached. The housing section 1324 is sealably engaged to a gravel packer 1326 that is part of the lower completion section 1322. At the lower end of the housing section 1324 is another male inductive coupler portion 1328, which interacts with another female inductive coupler portion 1330 that is part of the lower completion section 1322. Together, the inductive coupler portions 1328 and 1330 form an inductive coupler.

Below the inductive coupler portion 1328 is the lower flow control valve 1304 that is attached to a housing section 1332 of the upper completion section 1306 proximate to the lower zone 1310.

The upper completion section 1306 further includes a tubing 1334 above the production packer 1314. Also, attached to the tubing 1334 is a control station 1336 that is connected to an electric cable 1338. The electric cable 1338 extends downwardly through the production packer 1314 to electrically connect electrical conductors extending through the pipe section 1316 to the inductive coupler portion 1318, and to electric conductors extending through the housing section 1324 to the lower inductive coupler portion 1328. The flow control valves 1302 and 1304 in one embodiment can be hydraulically actuated. A hydraulic control line is run from surface to a valve for operating the valve. In yet another embodiment, the flow control valve can be electrically operated, hydroelectrically operated, or operated by other means.

In the lower completion section 1322, the upper inductive coupler portion 1320 is coupled through a controller cartridge (not shown) to an upper sensor cable 1340 having sensors 1342 for measuring characteristics associated with the upper zone 1308. Similarly, the lower inductive coupler portion 1330 is coupled through a controller cartridge (not shown) to a lower sensor cable 1344 that has sensors 1346 for measuring characteristics associated with the lower zone 1310.

At its lower end, the lower completion section 1322 has a packer 1348. The lower completion section 1322 also has a gravel pack packer 1350 at its upper end.

Figure 24:
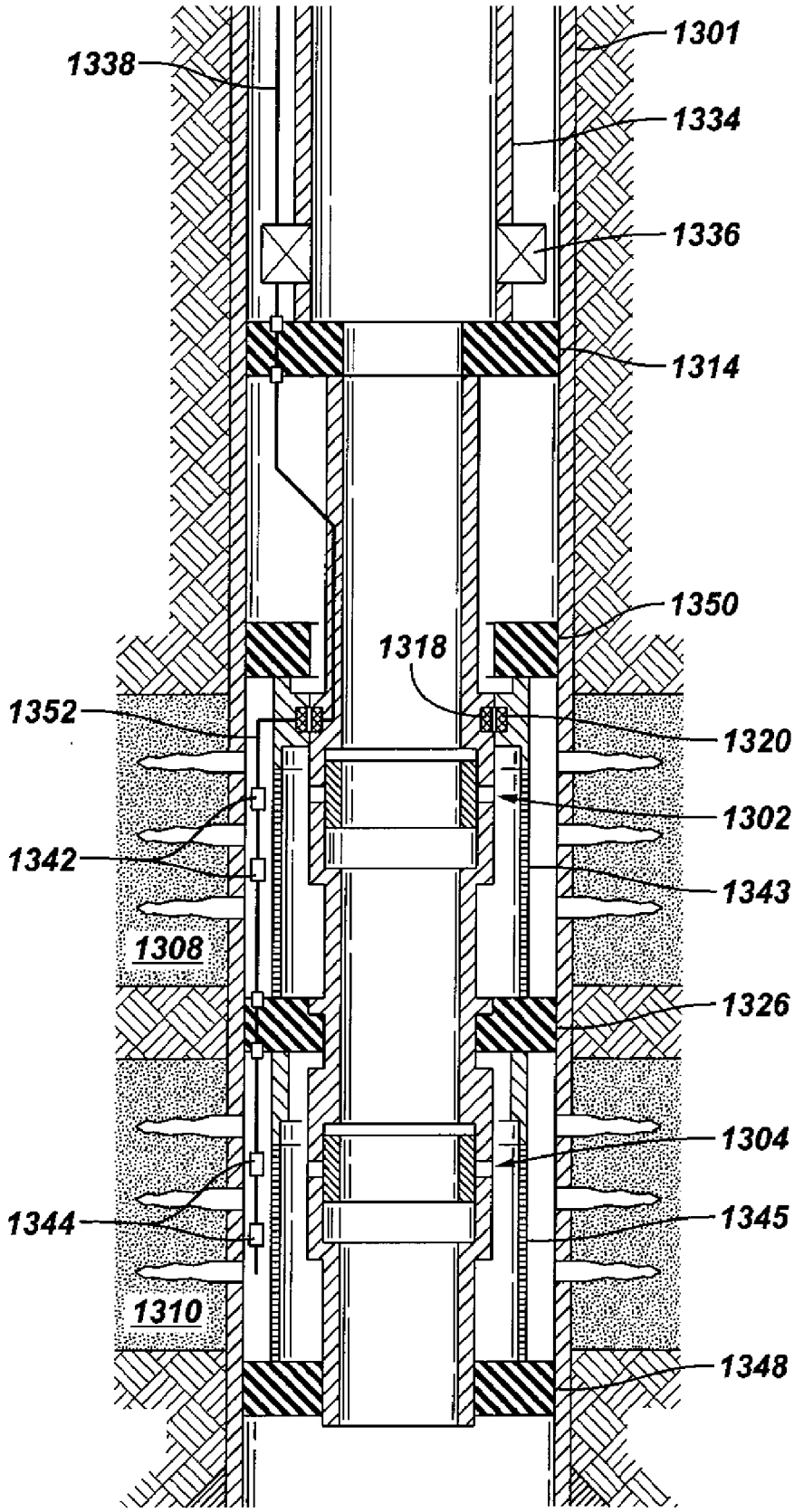

In the FIG. 23 embodiment, two inductive couplers are used for the sensor arrays 1342 and 1346, respectively. The cable 1338 is run to inductive coupler 1318 and also to flow control valve 1302 and 1304. In an alternative embodiment, as depicted in FIG. 24, a single inductive coupler is used that includes inductive coupler portions 1318 and 1320. In the FIG. 24 embodiment, a single sensor cable 1352 is provided in an annulus region between the casing 1301 and sand control assemblies 1343, 1345. The sensor cable 1352 extends through the isolation packer 1326 to provide sensors 1342 in upper zone 1308, and sensors 1346 in lower zone 1310.

Figure 25:
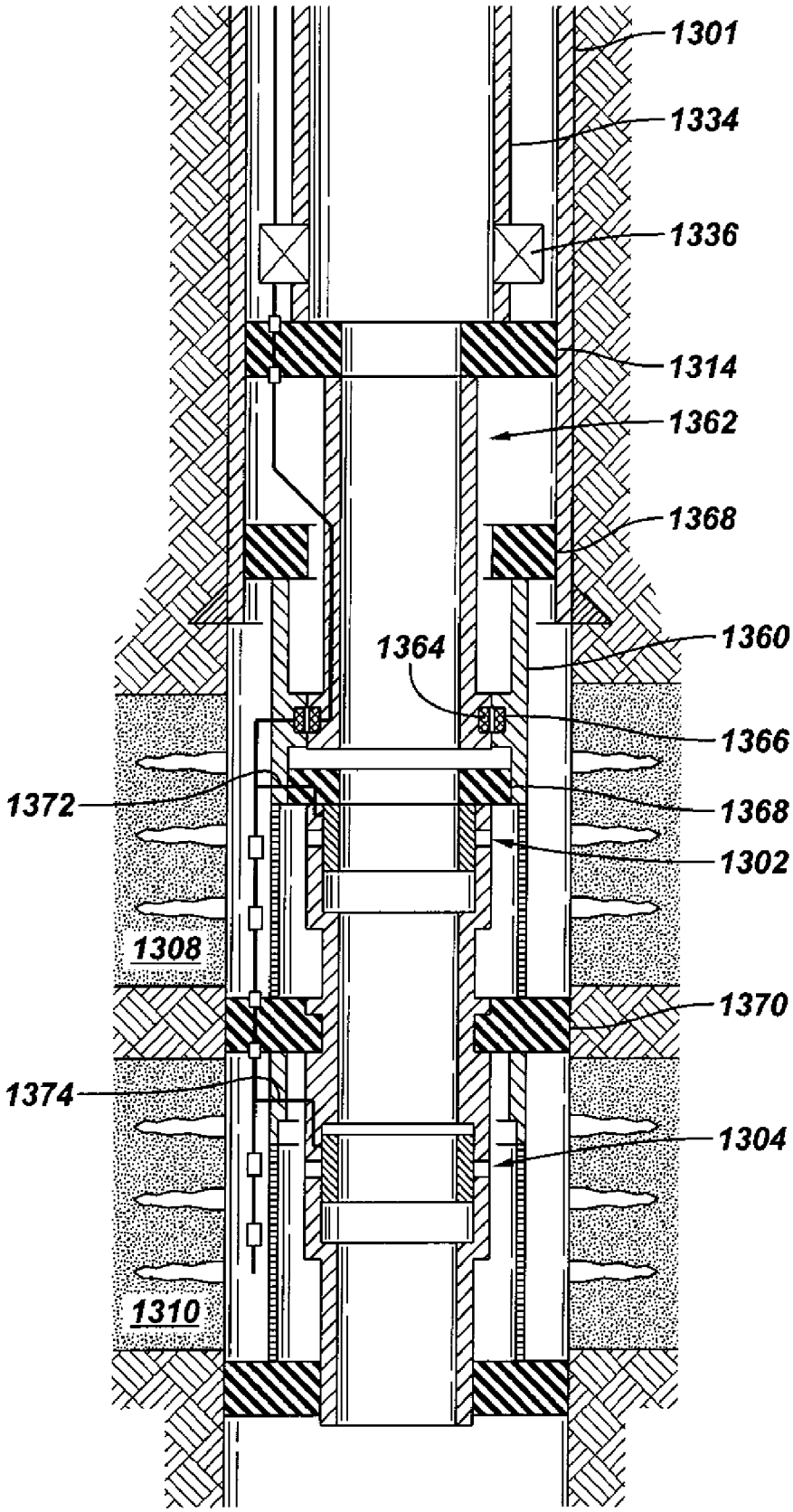

In the embodiments of FIGS. 23 and 24, flow control valves are provided as part of the upper completion section. In FIG. 25, on the other hand, the flow control valves 1302 and 1304 are provided as part of a lower completion section 1360. In the FIG. 25 embodiment, the upper completion section 1362 has a male inductive coupler portion 1364 that is able to communicate with a female inductive coupler portion 1366 that is provided as part of the lower completion section 1360. The lower completion section 1360 is attached by a screen hanger packer 1368 to casing 1301.

The inductive coupler portions 1364 and 1366 form an inductive coupler. The inductive coupler portion 1366 of the lower completion section 1362 is coupled through a controller cartridge (not shown) to a sensor cable 1368 that extends through an isolation packer 1370 that is also part of the lower completion section 1362. The isolation packer 1370 isolates the upper zone 1308 from the lower zone 1310.

The sensor cable 1368 is connected by cable segments 1372 and 1374 to respective flow control valves 1302 and 1304.

Figure 26:
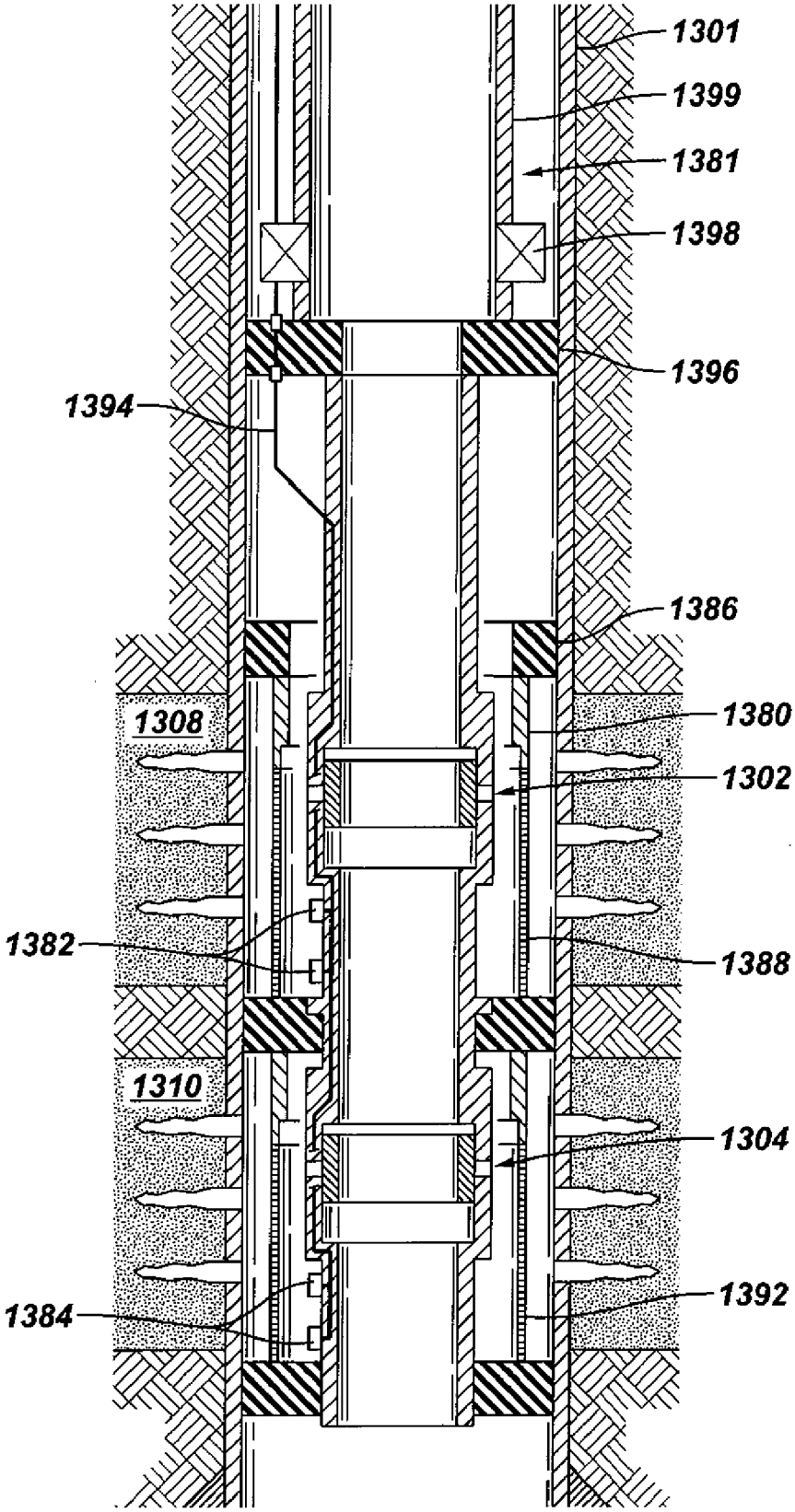
FIG. 26 illustrates another embodiment of a completion system in which an inductive coupler is not used.

FIG. 26 illustrates yet another embodiment of a completion system in which an inductive coupler is not used. The completion system of FIG. 26 includes an upper completion section 1381 and a lower completion section 1380. In this embodiment, sensors 1382 (for the upper zone 1308) and sensors 1384 (for the upper zone 1310) are part of the upper completion section 1381. The lower completion section 1380 does not include sensors or inductive couplers. The lower completion section 1380 includes a gravel pack packer 1386 connected to a sand control assembly 1388, which in turn is connected to an isolation packer 1390. The isolation packer 1390 is in turn connected to another sand control assembly 1392 for the lower zone 1310.

The sensors 1382, 1384 and flow control valves 1302, 1304 that are part of the upper completion section 1381 are connected by electric conductors (not shown) that extend to an electric cable 1394. The electric cable 1394 extends through a production packer 1396 of the upper completion section 1381 to a control station 1398. Control station 1398 is attached to tubing 1399.

Figure 27:
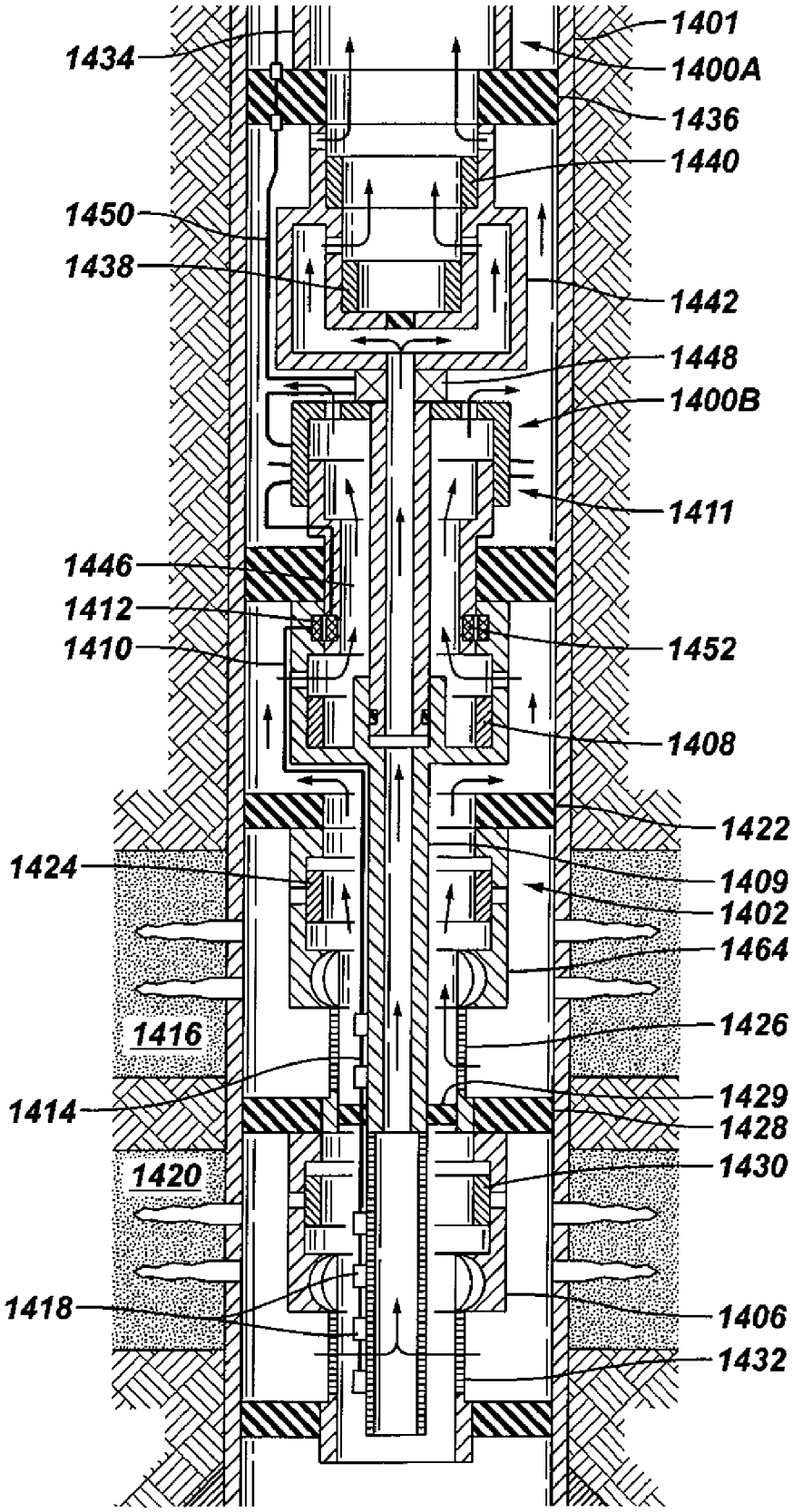

FIG. 27 shows yet another embodiment of a completion system having an upper completion section 1400A, an intermediate completion 1400B and a lower completion section 1402. The well of FIG. 27 is lined with casing 1401. In some embodiment the reservoir section may not be lined with casing but may be an open hole, an open hole with expandable screen, an open hole with stand alone screen, an open hole with slotted liner, an open hole gravel pack, or a frac-pack or resin consolidated open hole. The completion system of FIG. 27 includes formation isolation valves, including formation isolation valves 1404 and 1406 that are part of the lower completion section 1402. The lower completion section can be a single trip multi-zone or multiple trip multi-zone completion. Another formation isolation valve is an annular formation isolation valve 1408 to provide annular fluid loss control—the annular formation isolation valve 1408 is part of the intermediate completion section 1400B to provide formation isolation for the upper zone 1416 after the upper formation isolation valve 1404 is opened to insert the inner flow string 1409 inside the lower completion section 1402 In some embodiments, a formation isolation valve similar to 1404 can be run below the annular formation isolation valve 1408 as part of the intermediate completion 1400B to isolate the lower zone after the lower formation valve 1406 is opened to insert the inner flow string 1409 inside the lower zone 1420.

A sensor cable 1410 is provided as part of the intermediate completion section 1400B, and runs to a male inductive coupler portion 1452 that is also part of the upper completion section 1400A. A length compensation joint 1411 is provided between the production packer 1436 and the male inductive coupler 1452. The length compensation joint 1411 allows the upper completion to land out in the profile at the female inductive coupler portion 1412, with the production tubing or upper completion attached to the tubing hanger at the wellhead (at the top of the well). The length compensation joint 1411 includes a coiled cable to allow change in length of the cable with change in length of the compensation joint. The cable 1438 is joined to the coiled cable and the lower end of the coil is connected to the male inductive coupler 1452. The sensor cable 1410 is electrically connected to the female inductive coupler portion 1412 and runs outside of the inner flow string 1409. The sensor cable 1410 provides sensors 1414 and 1418. The cable 1410 between two zones 1416 and 1420 is fed through a seal assembly 1429. The seal assembly 1429 seals inside the packer bore or other polished bore of packer 1428.

The intermediate completion 1400B includes the female inductive coupler portion 1412, annular formation isolation valve 1408, inner flow string 1409, sensor cable 1414, and seal assembly 1429 with feed through is run on a separate trip. The inner flow string 1409, sensor cable 1414, and seal assembly 1429 are run inside (in an inner bore) the lower completion section 1402. The sensor cable 1414 provides sensors 1414 for the upper zone 1416, and sensors 1418 for the lower zone 1420.

Other components that are part of the lower completion section 1402 include a gravel pack packer 1422, a circulating port assembly 1424, a sand control assembly 1426, and isolation packer 1428. The circulating port assembly 1424, formation isolation valve 1404, and sand control assembly 1426 are provided proximate to the upper zone 1416.

The lower completion section 1402 also includes a circulating port assembly 1430 and a sand control assembly 1432, where the circulating port assembly 1430, formation isolation valve 1406, and sand control assembly 1432 are proximate to the lower zone 1420.

The upper completion section 1400A further includes a tubing 1434 that is attached to a packer 1436, which in turn is connected to a flow control assembly 1438 that has an upper flow control valve 1440 and a lower flow control valve 1442. The lower flow control valve 1442 controls fluid flow that extends through a first flow conduit 1444, whereas the upper flow control valve 1440 controls flow that extends through another flow conduit 1446. The flow conduit 1446 is in an annular flow path around the first flow conduit 1444. The flow conduit 1444 (which can include an inner bore of a pipe) receives flow from the lower zone 1420, whereas the flow conduit 1446 receives fluid flow from the upper zone 1416.

The upper completion section 1400A also includes a control station 1448 that is connected by an electric cable 1450 to the earth surface. Also, the control station 1448 is connected by electric conductors (not shown) to a male inductive coupler portion 1452, where the male inductive coupler portion 1452 and the female inductive coupler portion 1412 make up an inductive coupler.

Figure 28:
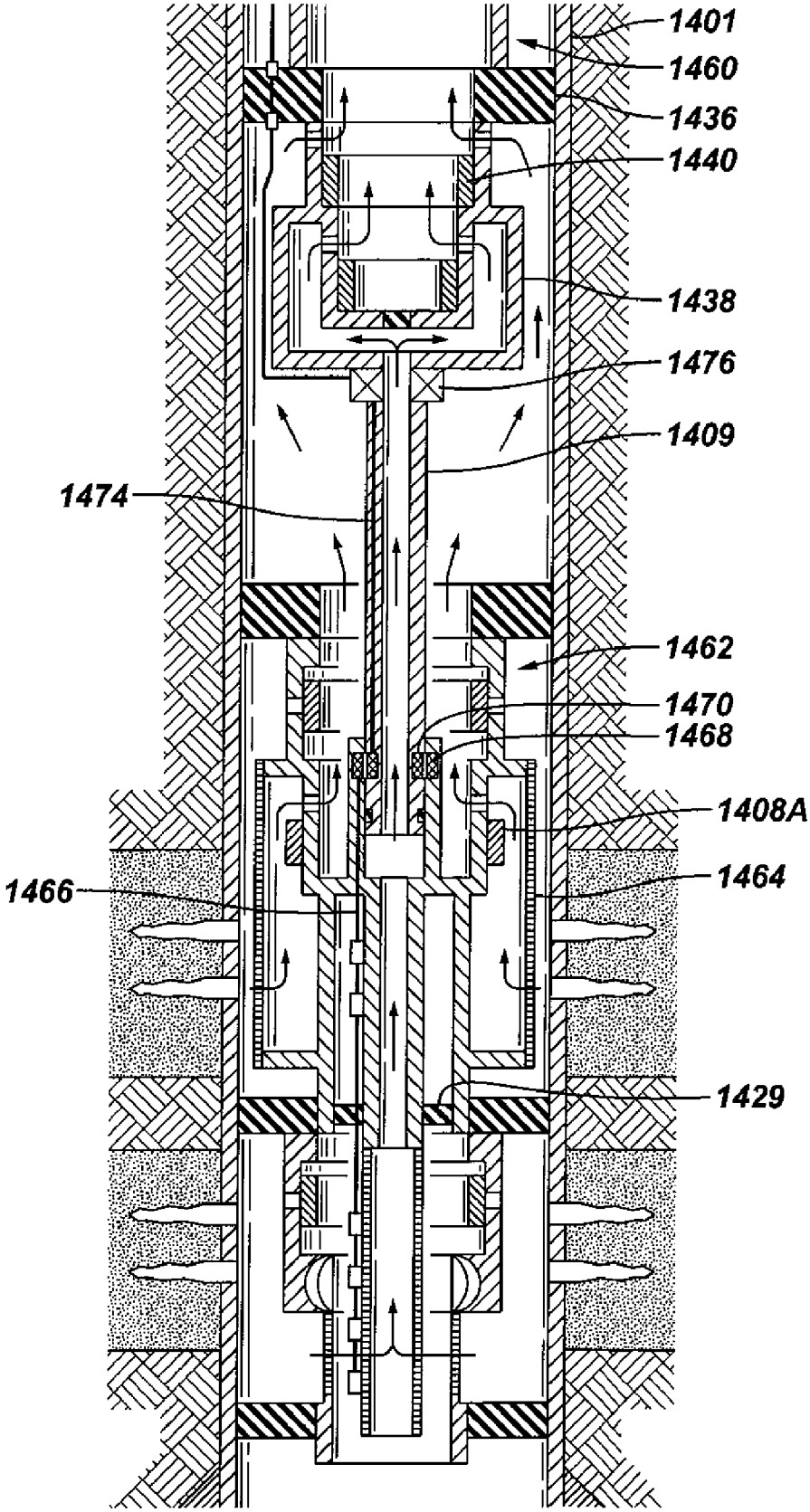

FIG. 28 shows yet another embodiment of a completion system that is a variant of the FIG. 27 embodiment that does not require an intermediate completion (1400B in FIG. 27) to deploy the annular formation isolation valve. The completion system of FIG. 28 includes an upper completion section 1460 and a lower completion section 1462. An annular formation isolation valve 1408A incorporated into a sand control assembly 1464 that is part of the lower completion section 1462.

A sensor cable 1466 extends from a female inductive coupler portion 1468. The female inductive coupler portion 1468 (which is part of the lower completion section 1462) interacts with a male inductive coupler portion 1470 to form an inductive coupler. The male inductive coupler portion 1470 is part of the inner flow string 1409 that extends from the upper completion section 1460 into the lower completion section 1462. An electric cable 1474 extends from the male inductive coupler portion 1470 to a control station 1476.

The upper completion section 1460 also includes the flow control assembly 1438 similar to that depicted in FIG. 27.

In various embodiments discussed above, various multi stage completion systems that include an upper completion section and a lower completion section and/or intermediate completion section have been discussed. In some scenarios, it may not be appropriate to provide an upper completion section after a lower completion section has been installed. This may be because of the well is suspended after the lower completion is done. In some cases, wells in the field are batch drilled and lower completions are batch completed and then suspended and then at later date upper completions are batch completed. Also in some cases it may be desirable to establish a thermal gradient across the formation for the purpose of comparison with changing temperature or other formation parameters before disturbing the formation to aid in analysis. In such cases, it may be desirable to take advantage of sensors that have already been deployed with the lower completion section of the two-stage completion system. To be able to communicate with the sensors that are part of the lower completion section, an intervention tool having a male inductive coupler portion can be lowered into the well so that the male inductive coupler portion can be placed proximate to a corresponding female inductive coupler portion that is part of the lower completion section. The inductive coupler portion of the intervention tool interacts with the inductive coupler portion of the lower completion section to form an inductive coupler that allows measurement data to be received from the sensors that are part of the lower completion section.

The measurement data can be received in real-time through the use of a communication system from the intervention tool to the surface, or the data can be stored in memory in the intervention tool and downloaded at a later time. In the case that a real-time communication is used, this could be via a wireline cable, mud-pulse telemetry, fiber-optic telemetry, wireless electromagnetic telemetry or via other telemetry procedures known in the industry. The intervention tool can be lowered on a cable, jointed pipe, or coiled tubing. The measurement data can be transmitted during an intervention process to help monitor the state of that intervention.

The intervention tool can be a gravel pack service tool that is lowered in place while the lower completion is deployed into the wellbore. The memory tool is below the gravel pack and above shifting mechanism that can move a formation isolation valve. Then, after gravel packing, the intervention tool is pulled up into position A which closes the formation isolation valve and then up slightly further into position B so that the inductors are mating. Feedback mechanism to the surface indicates that the inductors are in position. That tool is left in place for a while to allow a series of measurements to be taken over time. Those measurements, in particular, can be of temperature along the sandface, in which case the measurements will indicate where the gravel-pack fluid went while it was being pumped. The interpretation methodology is called "warm-back" and is disclosed in U.S. Pat. No. 7,055,604 entitled, "THE USE OF DISTRIBUTED SENSORS DURING WELLBORE TREATMENTS", which issued on Jun. 6, 2006 and is hereby incorporated by reference in its entirety. All of this temperature data is stored into memory. The memory data is dumped as the tool is returned to the surface. As an extension, some, or all of the data can also be communicated to the surface in real-time using any appropriate telemetry device.

For possible communication devices, note that once the formation isolation valve is closed, then it is possible to pump down the tool and up the annulus (or vice versa), so standard mud-pulse telemetry can be used. This could be used to power the downhole electronics (with turbine) or else battery power can be used.

Figure 29:
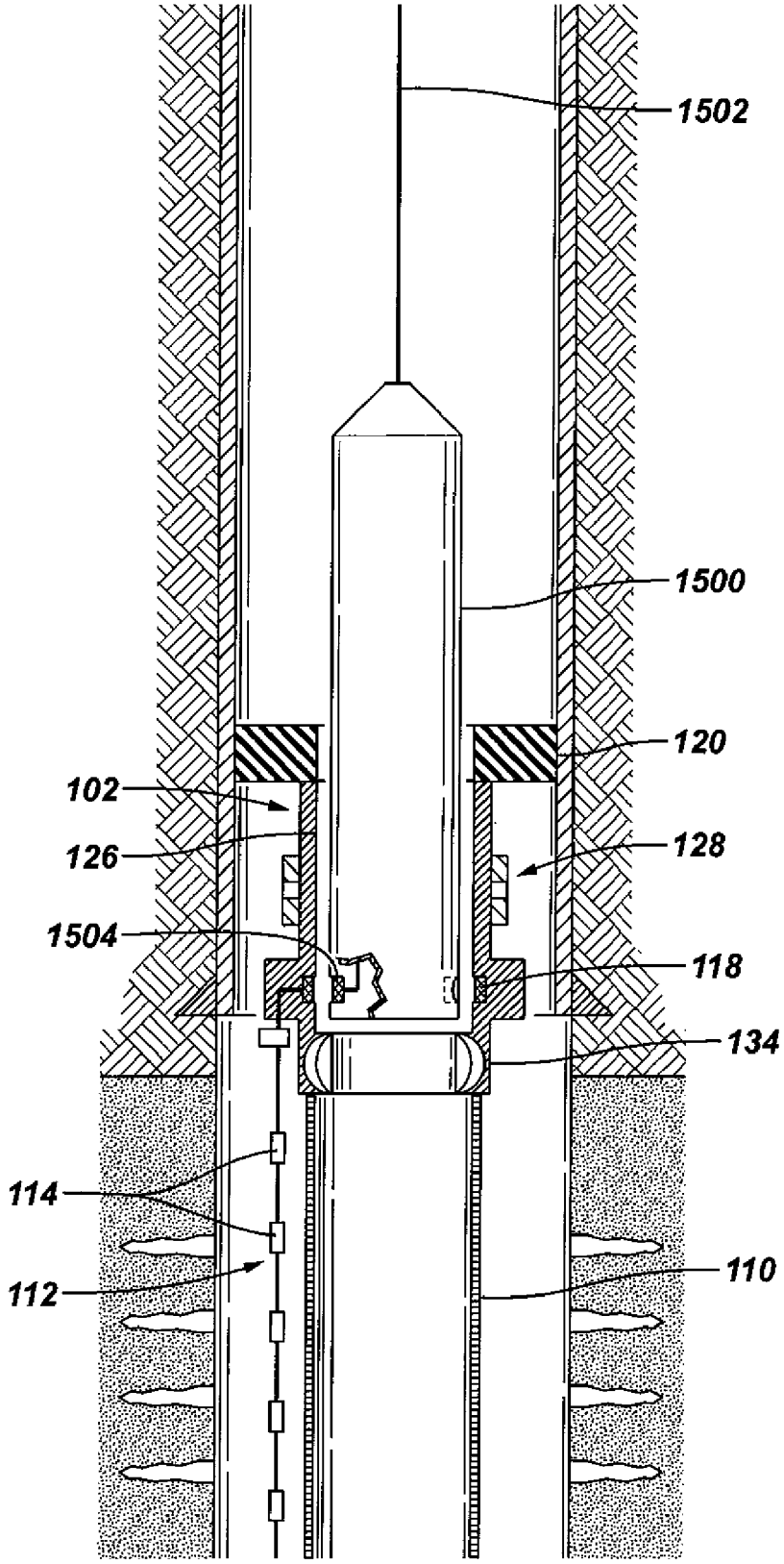
FIG. 29 illustrates an arrangement including a lower completion section and an intervention tool capable of communicating with the lower completion section using an inductive coupler, according to another embodiment.

FIG. 29 shows an example of such an arrangement. The lower completion section depicted in FIG. 29 is the same lower completion section of FIG. 2 discussed above. In the FIG. 29 arrangement, the upper completion section has not yet been deployed. Instead, an intervention tool 1500 is lowered on a carrier line 1502 into the well. The intervention tool 1500 has an inductive coupler portion 1504 that is capable of interacting with the inductive coupler portion 118 in the lower completion section 102.

The carrier line 1502 can include an electric cable or a fiber optic cable to allow communication of data received through the inductive coupler portions 118, 1504 to an earth surface location.

Alternatively, the intervention tool 1500 can include a storage device to store measurement data collected from the sensors 114 in the lower completion section 102. When the intervention tool 1500 is later retrieved to the earth surface, the data stored in the storage device can be downloaded. In this latter configuration, the invention tool 1500 can be lowered on a slickline, with the intervention tool including a battery or other power source to provide energy to enable communication through the inductive coupler portions 118, 1504 with the sensors 114.

A similar intervention-based system can also be used for coiled tubing operation. During the coiled tubing operation, it may be beneficial to collect sand face data to help decide what fluids are being pumped into the wellbore through the coiled tubing and at what rate. Measurement data collected by the sensors can be communicated in real time back to the surface by the intervention tool 1500.

In another implementation, the intervention tool 1500 can be run on a drill pipe. With a drill pipe, however, it is difficult to provide an electric cable along the drill pipe due to joints of the pipe. To address this, electric wires can be embedded within the drill pipe with coupling devices at each joint provided to achieve a wired drill pipe. Such a wired drill pipe is able to transmit data and also allow for fluid transmission through the pipe.

The intervention-based system can also be used to perform drillstem testing, with measurement data collected by the sensors 114 transmitted to the earth surface during the test to allow the well operator to analyze results of the drillstem testing.

The lower completion section 102 can also include components that can be manipulated by the intervention tool 1500, such as sliding sleeves that can be opened or closed, packers that can be set or unset, and so forth. By monitoring the measurement data collected by the sensors 114, a well operator can be provided with real-time indication of the success of the intervention (e.g., sliding sleeve closed or open, packer set or unset, etc.).

In an alternative implementation, the lower completion section 102 can include multiple female inductive coupler portions. The single male inductive coupler portion (e.g., 1504 in FIG. 29) can then be lowered into the well to allow communication with whichever female inductive coupler portion the male inductive coupler portion is positioned proximate to.

Note that the intervention tool 1500 depicted in FIG. 29 can also be used in a multilateral well that has multiple lateral branches. For example, if one of the lateral branches is producing water, the intervention tool 1500 can be used to enter the lateral branch with coil tubing to allow pumping of a flow inhibitor into the lateral branch to stop the water production. Note that surface measurements would not be able to indicate which lateral branch was producing water; only downhole measurements can perform this detection.

Each of the lateral branches of the multilateral well can be fitted with a measurement array and an inductive coupler portion. In such an arrangement, there would be no need for a permanent power source in each lateral branch. During intervention, the intervention tool can access a particular lateral branch to collect data for that lateral branch, which would provide information about the flow properties of the lateral branch. In some implementations, the sensors or the controller cartridge associated with the sensors in each lateral branch can be provided with an identifying tag or other identifier, so that the intervention tool will be able to determine which lateral branch the intervention tool has entered.

Note also that tags within the measurement system can change properties based on results of the measurement system (e.g., to change a signal if the measurement system detects significant water production). The intervention tool can be programmed to detect a particular tag, and to enter a lateral branch associated with such particular tag. This would simplify the task of knowing which lateral branch to enter for addressing a particular issue.

Figure 30:
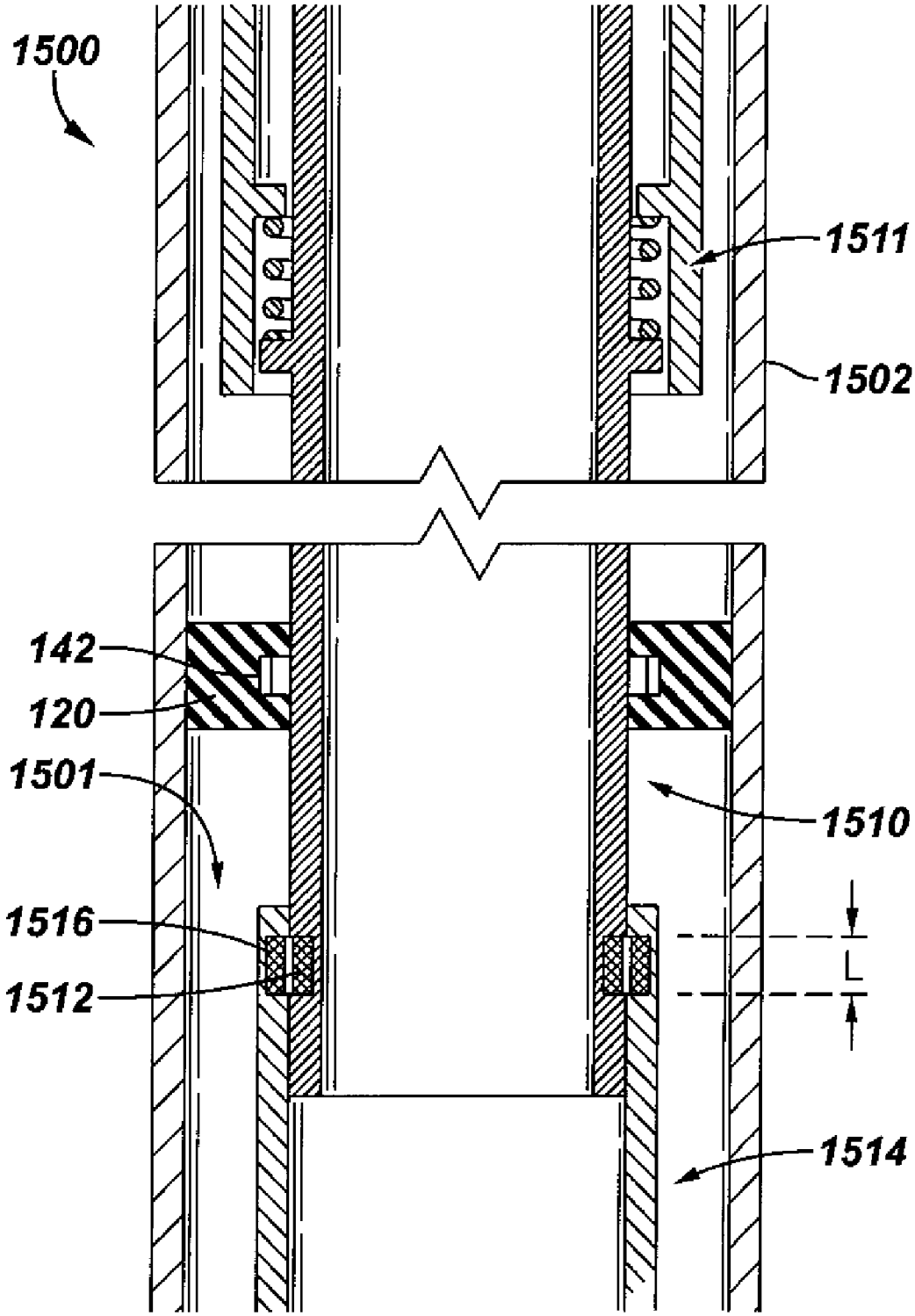
FIG. 30 is a cross-sectional view of upper and lower completion sections illustrating alignment of inductive couplers according to an embodiment of the invention.

Referring to FIG. 30, in accordance with embodiments of the invention described herein, a well (a subsea well or a subterranean well) includes inductive couplers and a mechanism to guide the installation of well equipment for purposes of precisely aligning inductive couplers of the equipment. More specifically, in accordance with embodiments of the invention described herein, the inductive couplers, such as exemplary inductive couplers 1512 and 1516 that are pare of system 1500 are constructed to wirelessly communicate with each other in the well for purposes of communicating data and/or power. As depicted in FIG. 30, each inductive coupler 1512, 1516 has approximately the same axial length (called "L" in FIG. 30). Each inductive coupler 1512, 1516 has a coil that is wound around an axis that is coaxial with the longitudinal axis of the upper completion equipment assembly 1510 (for the inductive coupler 1512) or lower completion equipment assembly 1514 (for the inductive coupler 1516). By having substantially the same axial length L, the efficiency of the inductive coupling is maximized, in that the generated magnetic field is concentrated inside the coils of the inductive couplers 1512 and 1516 and, in general, does not extend into nearby tubing, or pipe, which dissipates power Such efficiency may be particularly advantageous in a subsea well in which the maximum power budget for the well may be relatively small, such as a power budge on the order of five to ten Watts (W), as a non-limiting example.

Because the inductive couplers 1512 and 1516 have approximately the same axial length L, it may be challenging to substantially align the inductive couplers 1512 and 1516, due to the inherent tolerances of the completion equipment. As an example, exact alignment may be considered to occur when the top ends of the inductive couplers 1512 and 1516 are co-located and when the bottom ends of the inductive couplers 1512 and 1516 are co-located. "Substantial alignment" means that the inductive couplers are exactly aligned or nearly aligned, such as (as non-limiting examples) when the inner inductive coupler 1512 is 10 percent, 20 percent, 30 percent, 40 percent, or 50 or more percent contained within the outer inductive coupler 1516.

In accordance with embodiments of the invention described herein, feedback, which indicates whether the inductive couplers 1512 and 1516 are substantially aligned, allows the operator at the surface of the well to precisely position the inductive coupler 1512 (which is run later into the well, as further described below) with respect to the inductive coupler 1516 (which is run first into the well, as further described below).

More specifically, in accordance with embodiments of the invention described herein, the inductive coupler 1516 may be part of a lower completion assembly 1514, which is installed in a wellbore 1501 prior to the running of an upper completion assembly 1510. It is noted that the wellbore 1501 may or may not be cased by a casing string 1502 (a string that lines and supports the wellbore 1501), depending on the particular embodiment of the invention. As depicted in FIG. 30, the lower completion assembly 1514 may be first run in and installed in the wellbore 1501. After the lower completion assembly 1514 is installed, the upper completion assembly 1510 is run into the well; and, as further described herein, during the running of the upper completion assembly 1510, feedback is generated, which allows the operator to precisely position the upper completion assembly 1510 for purposes of substantially aligning the inductive coupler 1512 of the upper completion assembly 1510 with the inductive coupler 1516 of the lower completion assembly 1514.

As a non-limiting example, in accordance with some embodiments of the invention, the inductive coupler 1512 may be part of a straddle seal assembly (of the upper completion assembly 1510), and the inductive coupler 1516 may be part of a seal bore assembly (of the lower completion assembly 1514), such that the straddle seal assembly is received in the seal bore assembly upon installation of the upper completion assembly 1510 in the well.

As also depicted in FIG. 30, in accordance with some embodiments of the invention, the upper completion assembly 1510 may include a telescoping joint 1511, which allows relative expansion and contraction of the upper completion assembly 1510 with respect to the lower completion assembly 1514.

As a first example of a feedback mechanism, the snap latch connector assembly 142 (see also FIG. 1A), which is part of a packer 120 for this example, may be used to provide a mechanical indication of whether the inductive couplers 1512 and 1516 are substantially aligned. More specifically, the snap latch connector assembly 142 is constructed to form a releasable connection between the upper 1510 and lower 1514 completion assemblies; and when this connection is formed, the inductive couplers 1512 and 1516 are substantially aligned, as depicted in FIG. 30. Thus, when female and male portions of the snap latch connector assembly 142 engage to restrict downward travel of the upper completion assembly 1510, the resulting weight offset, may be detected by an operator at the surface of the well. The engagement of the snap latch connector assembly 142, which is first detectable by the weight offset may be confirmed by the operator lifting up on the upper completion assembly 1510 such that the snap latch connection resists the upper travel by the upper completion assembly 1510.

Figure 31:
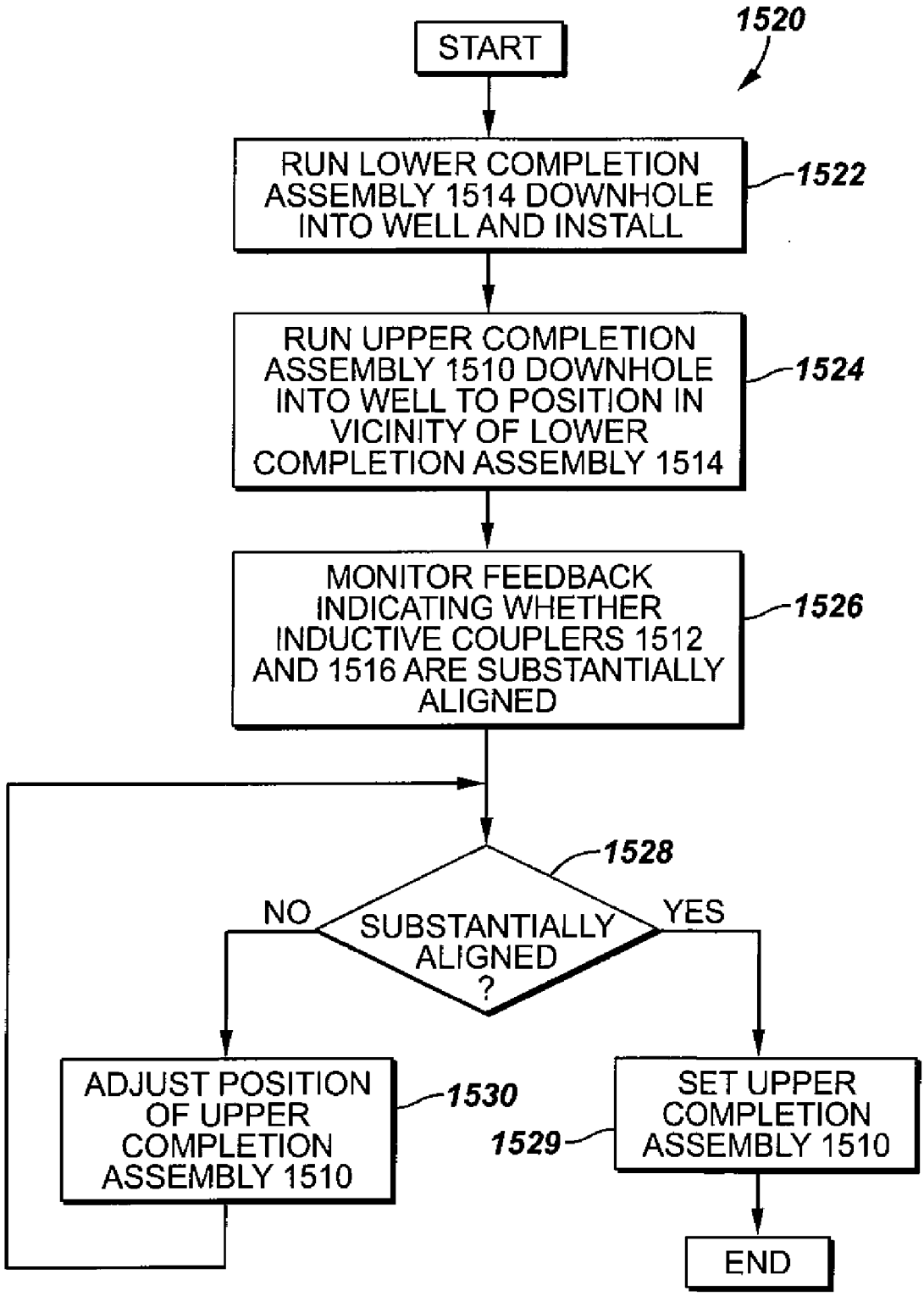
FIG. 31 is a flow diagram depicting a technique to align inductive couplers according to an embodiment of the invention.

As further described herein, other mechanisms may be used to provide mechanical, electrical, resistive, optical and/or other feedback to the surface of the well for purposes of substantially aligning the inductive couplers 1512 and 1516. Therefore, referring to FIG. 31, in accordance with embodiments of the invention described herein, a technique 1520 includes running the lower completion assembly 1514 downhole into the well and installing the lower completion assembly 1514. Next, the upper completion assembly 1510 is run downhole into the well, pursuant to block 1524, to a position that is in the vicinity of the lower completion assembly 1514.

The technique 1520 subsequently involves a feedback process to precisely position the upper completion assembly 510 for purposes of substantially aligning the inductive couplers 1512 and 1516. More specifically, in accordance with some embodiments of the invention, this feedback process includes monitoring (block 1526) feedback, which is indicative of whether the inductive couplers 1512 and 1516 are substantially aligned. Based on the feedback, if a determination is made (diamond 1528) that the inductive couplers 1512 and 1516 are substantially aligned, then the upper completion assembly 1512 is set into position, pursuant to block 1529. For example, slips and a packer seal of the upper completion assembly may be radially expanded to anchor the upper completion assembly 1510 in position. Otherwise, if the feedback does not indicate that the inductive couplers 1512 and 1516 are substantially aligned, the axial position of the upper completion assembly 1510 is adjusted, pursuant to block 1530, and control returns to block 1526. Thus, the feedback loop continues by positioning the upper completion assembly and monitoring the feedback until the inductive couplers 1512 and 1516 are substantially aligned.

Figure 32:
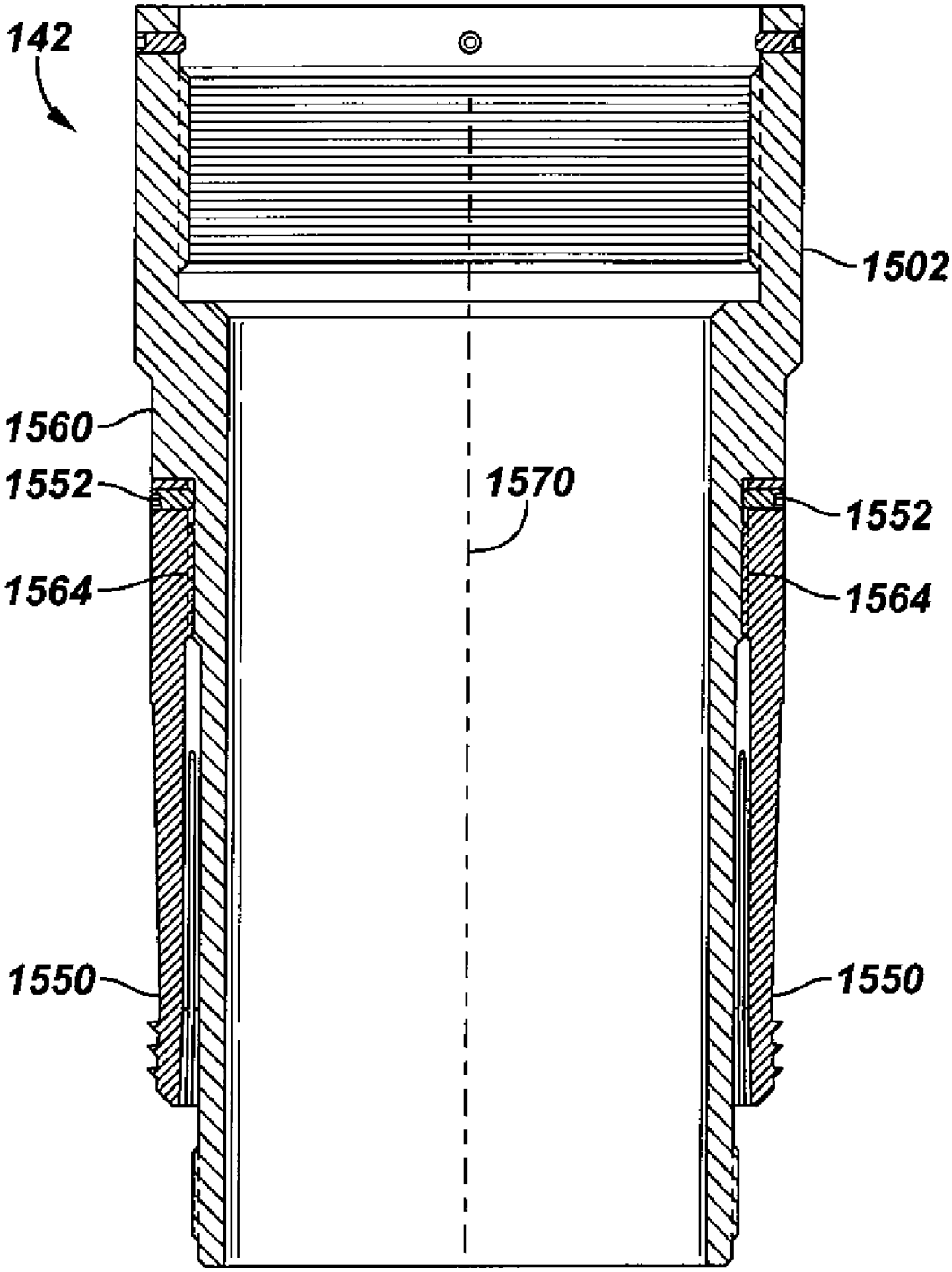
FIG. 32 is a schematic diagram of a snap latch connector assembly according to an embodiment of the invention.

In accordance with some embodiments of the invention, the snap latch connector assembly 142 may have a form that is depicted in FIG. 32. Referring to FIG. 32, for this embodiment, the snap latch connector assembly 142 includes a male tubular connector 1560 that is connected to the upper completion assembly 1510 and generally circumscribes an axis 1570 that is coaxial with the longitudinal axis of the upper completion assembly 1510. The male connector 1560 is, in general, designed to be received by collet fingers 1550 of the tubular female portion of the snap latch connector assembly 142. As depicted in its latched state in FIG. 32, when the male portion 1560 is fully received in the collet fingers 1550, pins 1552, which are located in the upper ends of the collet fingers 1550, slide past corresponding radial protrusions 1564 of the male connector portion 1560 to effectively latch the male and female portions of the snap latch connector assembly 142 together.

It is noted that in accordance with other embodiments of the invention, another snap latch connector assembly, latch-type connector assembly or other mechanical feature may be used for purposes of providing feedback to the operator at the surface of the well regarding whether the inductive couplers 1512 and 1516 are substantially aligned. For example, in accordance with other embodiments of the invention, the lower completion assembly 1514 may include a no go shoulder for purposes of limiting the downward travel of the upward completion assembly 1510. Therefore, when the operator at the surface of the well determines that the upper completion assembly has "landed" on the no go shoulder (via the detected weight offset), this feedback is used to determine that the inductive couplers 1512 and 1516 are substantially aligned.

It is noted that the feedback provided by a latch may be more advantageous than the no go shoulder, in accordance with some embodiments of the invention, in that a latch-type connector, such as the snap latch connector assembly 142, allows the operator at the surface of the well to lift up on the upper completion assembly 1512 to confirm that the position of the inductive coupler 1512. This is to be contrasted with, for example, the scenario in which debris in the lower completion assembly 1514 precludes the upper completion assembly 1510 from properly seating in the lower completion assembly 1514. Therefore, the presence of debris or another obstruction may cause inaccurate feedback to be provided to the operator at the surface of the well. It is noted that other snap latch and non-snap latch connector assemblies may be used to provide a mechanical feedback indication to the surface of the well regarding the alignment of the inductive couplers 1512 and 1516, in accordance with other embodiments of the invention.

Other embodiments are contemplated and are within the scope of the appended claims. For example, in accordance with other embodiments of the invention, other mechanical devices, electrical devices, optical devices, electroresistive devices, electromechanical devices, etc. may be used for purposes of providing feedback indicative of whether the inductive couplers 1512 and 1516 are substantially aligned. As another example, in accordance with some embodiments of the invention, an electromechanical switch may be used to sense the relative position of the upper completion assembly 1510 with respect to the lower completion assembly 1514. An example of such an electromechanical switch is described in U.S. Provisional Patent Application Ser. No. 61/013,542, entitled, "DETECTING MOVEMENT IN WELL EQUIPMENT FOR MEASURING RESERVOIR COMPLETION," which was filed on Dec. 13, 2007. In this example, the electromechanical switch may be used for other purposes, such as sensing the compaction of the upper and lower completion equipment assemblies.

Figure 33:
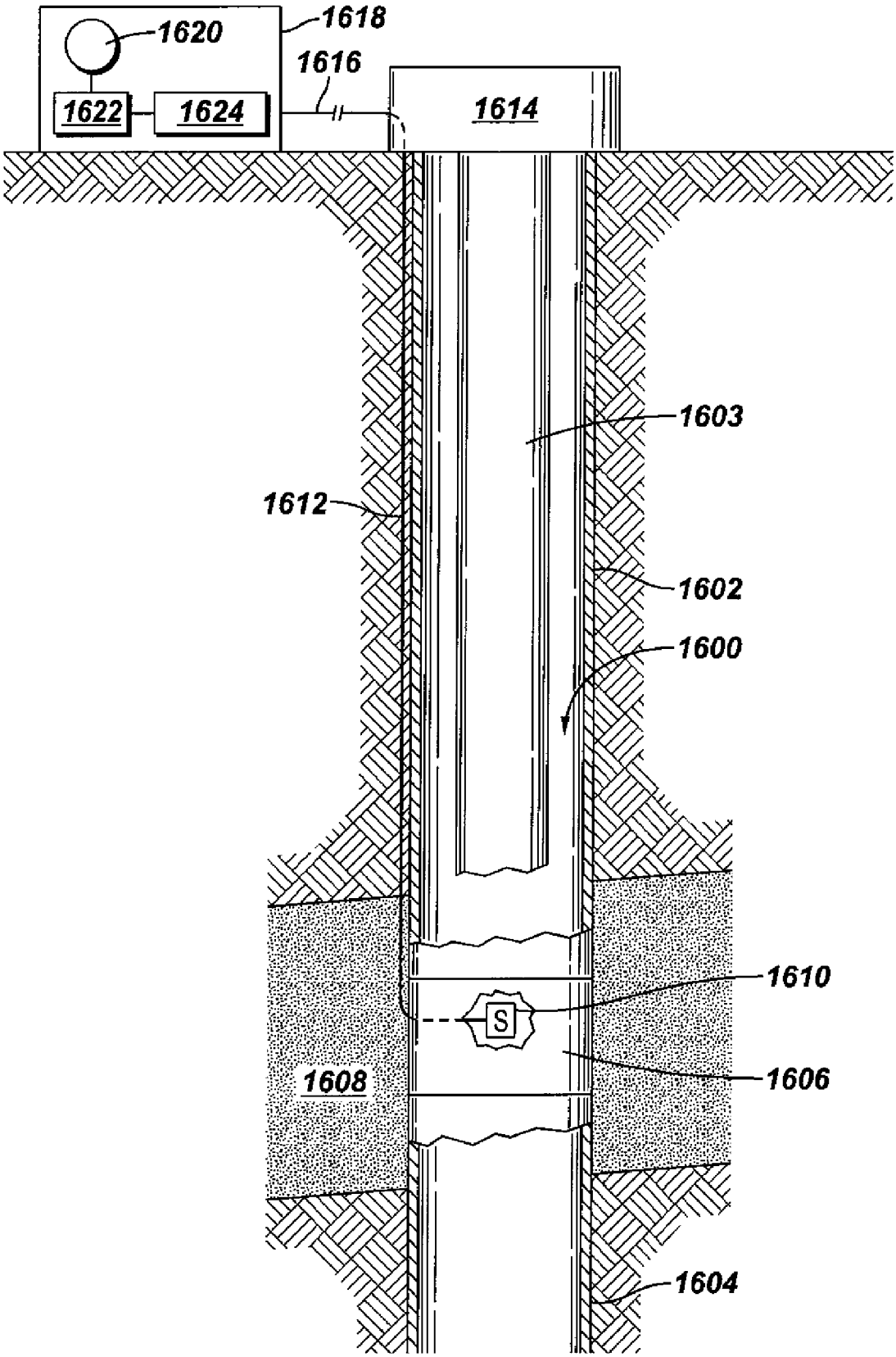
FIG. 33 illustrates example well equipment disposed in a wellbore having first and second equipment assemblies connected by a telescoping connection mechanism, and a sensor to detect movement of the telescoping connection mechanism, according to an embodiment of the invention.

As a more specific example, FIG. 33 illustrates an exemplary arrangement that includes well equipment installed in a wellbore 1600. The well equipment includes a first assembly 1602 and a second assembly 1604, which are interconnected by a telescoping connection mechanism 1606. In one example, the well equipment assembly 1602 includes a first casing segment, and the well equipment assembly 1604 includes a second casing segment. A "casing" is a structure, normally formed of metal that lines the wall of the wellbore. The telescoping connection mechanism 1606 allows for relative axial movement of the first and second casing segments 1602 and 1604. In other examples, other forms of tubular structures (e.g., pipes, tubing, etc.) can be connected to the telescoping connection mechanism 1606. Generally, a "telescoping connection mechanism" refers to any mechanism that interconnects two members while allowing relative axial movement of the two members. For example, the telescoping connection mechanism can be a contracting joint or an expansion joint.

The wellbore 1600 depicted in FIG. 33 extends to a reservoir 1608, which may contain a desirable fluid such as hydrocarbon, fresh water, and so forth. Production equipment 1603 can be provided inside the wellbore to extract the fluid from the reservoir 1608 as part of a production operation.

The first and second casing segments 1602, 1604 are connected to the formation adjacent the wellbore. If reservoir compaction occurs, one or both of the casing segments 1602, 1604 may shift as a result of the compaction. This shifting can cause the casing segments 1602, 1604 to move axially relative to each other at the telescoping connection mechanism 1606.

In accordance with some embodiments, a sensor assembly 1610 is associated with the telescoping connection mechanism 1606. The sensor assembly 1610 is connected to a communications link 1612 that extends to well surface equipment 1612. The communications link 1612 can include an electrical cable, a fiber optic cable, or some other type of link (e.g., wireless link, such as an acoustic link, pressure pulse link, electromagnetic link, etc.). The communications link 1612 passes through the wellhead 1614 to connect to a controller 1618 provided at the well surface.

The controller 1618 (which can be implemented with a computer, for example) is able to receive measurement data from the sensor assembly 1610, and to process the measurement data to provide an indication regarding one or more properties of the wellbore 1600 and reservoir 1608. The one or more properties can include indications of whether the reservoir 1608 has experienced compaction, and the extent of such compaction. Other well or reservoir properties that can be indicated by the controller 1618 include pressure, temperature, reservoir resistivity, and so forth.

In the example of FIG. 33, the controller 1618 includes processing software 1620 executable on one or more central processing units CPU(s) 1622, which is (are) connected to storage 1624. The storage 1624 can be used to store measurement data as well as instructions of the software 1620.

Figure 34:
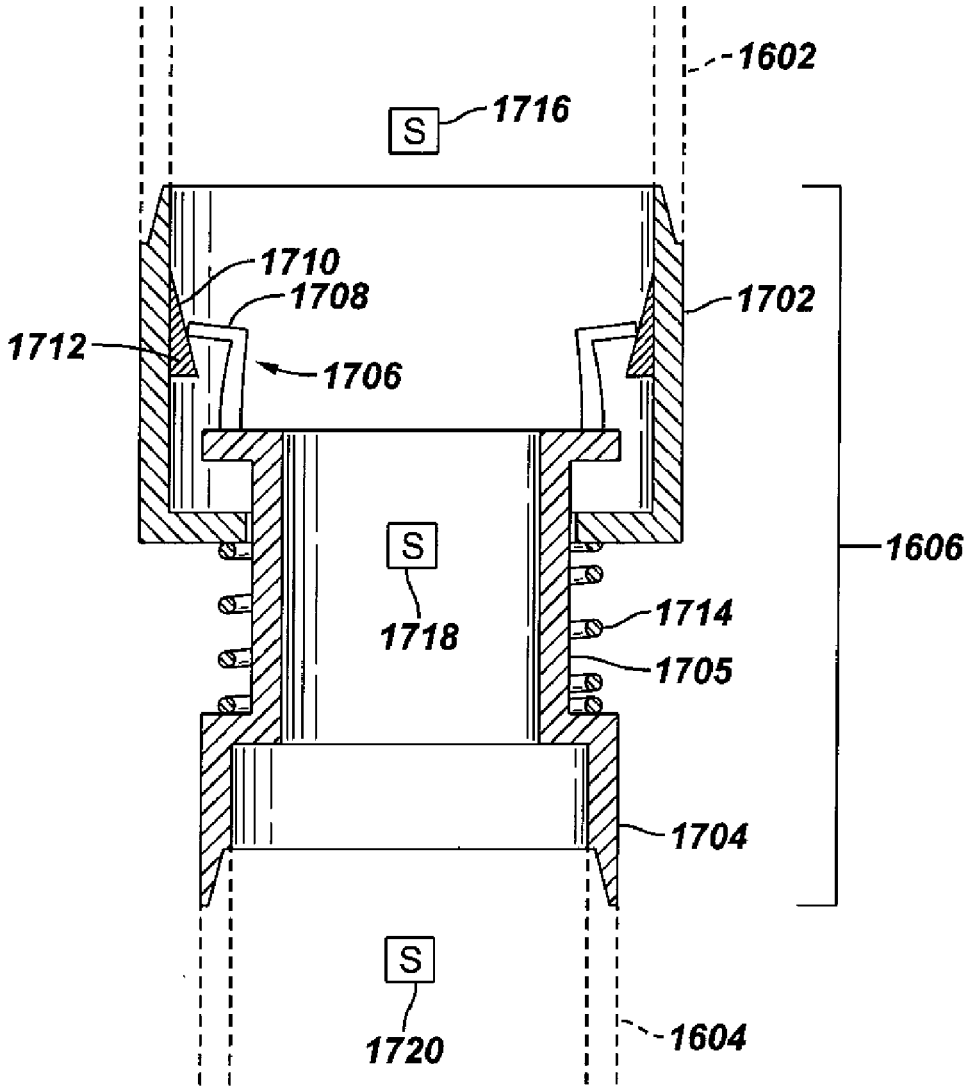
FIG. 34 illustrates a telescoping connection mechanism and an associated sensor assembly, according to an embodiment of the invention.

An example of the telescoping connection mechanism 1606 is depicted in FIG. 34. The telescoping connection mechanism 1606 includes a first connection segment 1702 (which is connected to the first casing segment 1602), and a second connection segment 1704 (which is connected to the second casing segment 1604). Note that in some implementations, the second casing segment 1604 along with the second connection segment 1704 (part of a lower completion assembly) can be deployed into the wellbore first, followed later by deployment of the first casing segment 1602 along with the first connection segment 1702 (part of an upper completion assembly). In such multi-part deployment, the later deployed first connection segment 1702 is landed with the second connection segment 1704 that was previously installed.

Alternatively, the first casing segment 1602, second casing segment 1604, and the telescoping connection mechanism 1606 can be deployed into the wellbore together.

The second connection segment 1704 has a portion 1705 of reduced diameter relative to the first connection segment 1702. As a result, the reduced diameter portion 1705 can move axially inside the first connection segment. Each of the first and second connection segments 1702 and 1704 can be generally tubular in shape, so that the reduced diameter portion 1705 is concentrically arranged inside (and is moveable with respect to) the first connection segment 1702.

In some implementations, it may be desirable to run a cable or control line (arranged outside the casing segments 1602 and 1604) through the telescoping connection mechanism 1606. To do so, such a cable or control line can be wound around the outside of the connection segments 1702 and 1704.

As further depicted in FIG. 34, a motion or position detector 1706, which is part of the sensor assembly 1610 of FIG. 33, is provided as part of the telescoping connection mechanism 1606. The motion detector 1706 has a radial protrusion 1708 (a mechanical probe member) that engages with a slanted surface 1710 provided by a feature (which can have a conical shape, for example, or some other shape) inside the first connection segment 1702.

A biasing element 1714, such as a spring, is provided to push the first connection segment 1702 away from the second connection segment 1704. However, due to compaction of the surrounding reservoir, the first and second connection members 1702 and 1704 may either be pushed towards each other or pushed further away from each other. Assuming that the second connection segment 1704 (and the second casing segment 1604) are fixed in position, then relative movement of the first and second connection segments 1702 and 1704 will cause axial movement of the first connection segment 1702. This will cause the radial protrusion 1708 of the motion detector 1706 to ride along the slanted surface 1710 of the conical feature 1712. Movement along the slanted surface 1710 by the radial protrusion 1708 causes radial movement (displacement) of the radial protrusion 1708.

As depicted in FIG. 34, if the radial protrusion 1708 were to move downwardly relative to the first connection segment 1702, then the radial protrusion 1708 will be pushed radially inwardly by the slanted surface 1710. On the other hand, if the radial protrusion 1708 were to move upwardly relative to the first connection segment 202, then the radial protrusion 1708 will move radially outwardly.

The motion detector 1706 is able to detect the radial movement of the radial protrusion 1708, and to communicate the extent of such radial movement over the communications link 1612 (FIG. 33) to the earth surface controller 1618 for processing.

In another embodiment, a motion detector similar to 1706 can also be provided to engage with the second connection segment 1704 so that movement of the second connection segment 1704 can be detected.

The motion detector 1706 can provide continuous measurement of movement, corresponding to continuous movement of the radial protrusion 1708 relative to the slanted surface 1710. Such detected continuous movement can be reported continuously to the earth surface controller 1618. Alternatively, instead of continuous measurement data, the motion detector 1706 can report discrete movement measurements to the controller 1618.

Note that the sensor assembly 1610 can include one or more other sensors, such as 1716, 1718, 1720, and so forth. Some of these sensors can be provided as part of the telescoping connection mechanism 1606, while other sensors are provided outside the connection mechanism 1606. The sensors can include pressure sensors, temperature sensors, resistivity sensors, and so forth.

The motion detector 1706 of FIG. 34 is effectively a position sensor that is used to detect changes in position of a mechanical component, in this case the first connection segment 1702.

In a different implementation, a position sensor can be implemented using an optical, resistive, electrical, electrostatic, or magnetic mechanism. For example, a position sensor can include an optical detector that uses the Faraday effect, a photo-activated ratio detector, a resistive contacting sensor, an inductively coupled ratio detector, a variable reluctance device, a capacitively coupled ratio detector, a radio wave directional comparator, or an electrostatic ratio detector.

An optical detector can use a position sensing detector to determine the position of an optical probe light that is incident upon a surface of the moveable device. The probe light can be directed to an optically reflective surface that is attached to the moveable member. The laser beam is reflected from the optically reflective surface. The optical detector may be constructed using photodetectors, such as photo-diodes or PIN-diodes, to detect the reflected laser beam.

A capacitance-based position sensor uses a variable capacitor having a value that varies with relative position of a pair of objects. In such systems, the relative position of the objects can be determined by measuring the capacitance.

A magnetic sensor to detect motion typically relies upon permanent magnets to detect the presence or absence of a magnetically permeable object within a certain predefined detection zone relative to the sensor. As one example, the magnetic sensor can be a Hall effect sensor. A Hall effect occurs when a current-carrying conductor is placed into a magnetic field, where a voltage is generated that is perpendicular to both the current and the field. Alternatively, the magnetic sensor can include a magnetoresistive sensor, which uses a magnetoresistive effect to detect a magnetic field. Relative movement of members can be detected based on measured magnetic fields.

The other sensors used to measure other properties can provide additional information to allow for more accurate detection of whether reservoir compaction has occurred. For example, temperature measurement can be used to provide an indication of compaction, since as pressure within a zone of the reservoir lowers, the granular components within the reservoir are forced into closer contact and may ultimately be fused together. Such action lowers the permeability of the zone and may result in a decrease of flow from that zone. Reduced flow will cause a reduction in temperature, which is an indication of possible reservoir compaction. Such data in combination with the position sensor used to detect relative movement of different segments of well equipment can be used to confirm that reservoir compaction has occurred.

Note that another possible application of the sensor that is associated with the telescoping connection mechanism 1606 is that the sensor assembly 1610 can provide an indication that the two different segments of the well equipment have successfully landed into the correct position.

Figure 35:
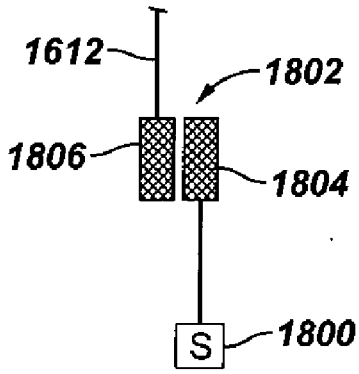
FIG. 35 illustrates use of an inductive coupler with a system incorporating an embodiment of the invention.

In implementations where the first equipment segment and the second equipment segment are deployed at different times, it may be difficult to provide a wired connection from a sensor of the sensor assembly 1610 to the earth surface. In such implementations, as depicted in FIG. 35, an inductive coupler mechanism 1802 can be provided. A sensor 1800, which can be part of the sensor assembly 1610 of FIG. 33, is connected to a first inductive coupler portion 1804, which is positioned proximate a second inductive coupler portion 1806 when the upper well equipment segment is landed with the lower well equipment segment. In one embodiment, the second inductive coupler portion 1806 can be a female inductive coupler portion, while the first inductive coupler portion 1804 may be a male inductive coupler portion. When positioned proximate to each other, the inductive coupler portions 1804 and 1806 are able to communicate both power and signaling such that the sensor 1800 can be powered using power provided over the link 1612, and further, measurement data by the sensor 1800 can be communicated through the inductive coupler 1802 to the link 1612 for communication to the surface.

Alternatively, instead of using an inductive coupler, acoustic telemetry or electromagnetic (EM) telemetry can be used.

In addition to detecting the degree of compaction, the motion sensor 1706 (see FIG. 34) may also be used for purposes of providing feedback that indicates whether the inductive couplers are substantially aligned. Thus, a certain detected range of positions indicates whether the inductive couplers are substantially aligned.

Figure 36:
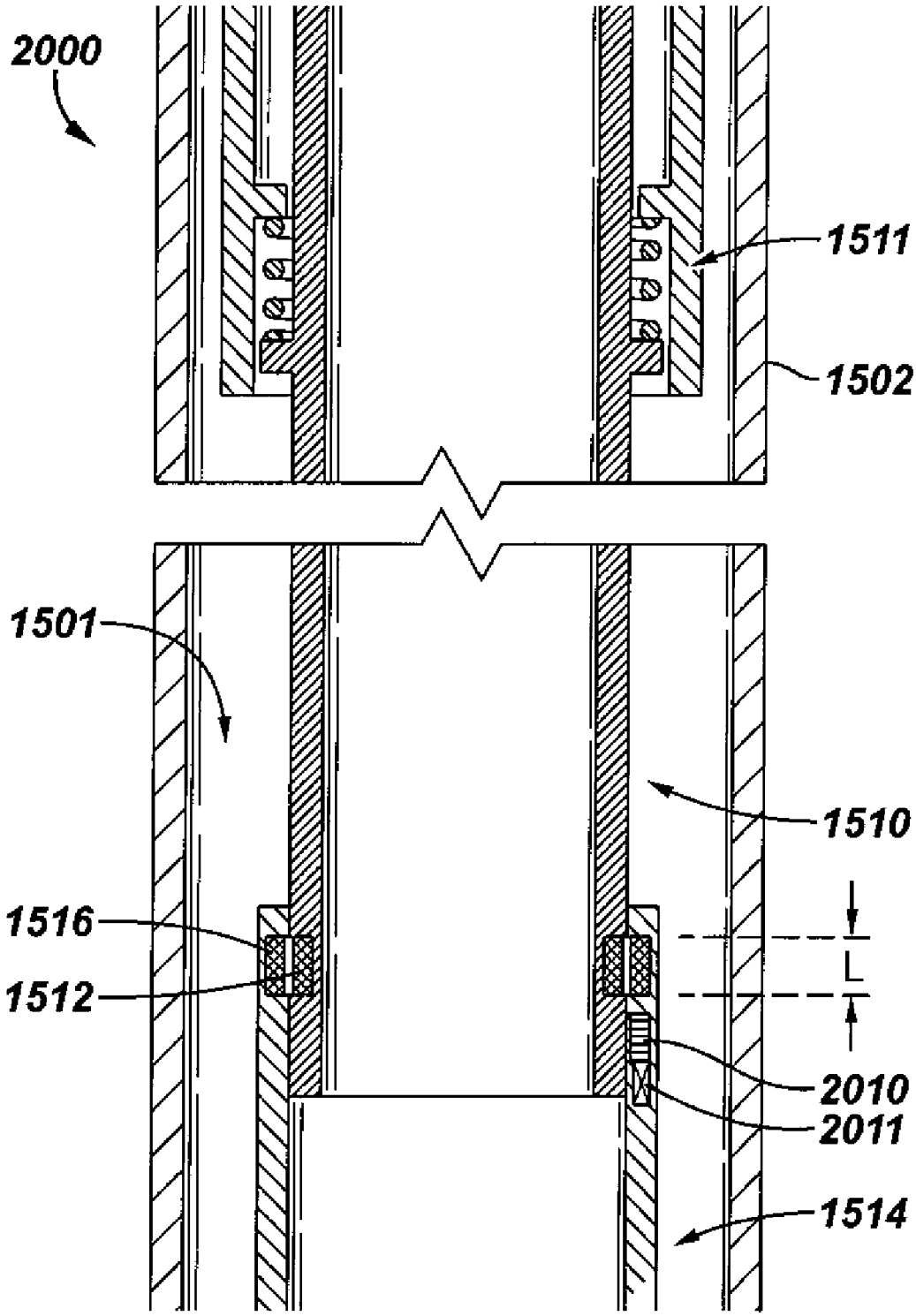
FIG. 36 is a cross-sectional view of upper and lower completion sections illustrating alignment of inductive couplers using a Hall effect sensor according to an embodiment of the invention.

It is noted that the feedback indication may be alternatively provided by an optical, electroresistive, electrical or electromagnetic device, in accordance with other embodiments of the invention. As a more specific example, FIG. 36 depicts a system 2000, which includes an upper completion assembly 1510 and a lower completion assembly 1514. Similar references are used in FIG. 36 to denote similar components to those described above.

The lower completion assembly 1514 includes a Hall effect sensor 2010, which generates a signal that is indicative of whether the inductive couplers 1512 and 1516 are substantially aligned.

More specifically, in accordance with some embodiments of the invention, the Hall effect sensor 2010 provides a voltage, which is indicative of whether or not the inductive couplers 1512 and 1516 are substantially aligned. For example, the inductive coupler 1512 may be energized when the upper completion assembly 1510 is in the vicinity of the lower completion assembly 1514. The energization of the inductive coupler 1512 produces a corresponding magnetic field that influences a voltage that is generated by the Hall effect sensor 2010, as the inductive coupler 1512 approaches the Hall effect sensor 2010. Thus, a particular voltage threshold, voltage signature, etc., appears across the Hall effect sensor 2010 when the inductive couplers 1512 and 1516 are substantially aligned.

In accordance with some embodiments of the invention, the lower completion assembly 1514 may include a transducer 2011 that generates a signal indicative of the signal that is produced by the Hall effect sensor 2010. In this regard, transducer 2011 may generate a wired or wireless stimulus (an electromagnetic wave, fluid pulse(s), electrical signal, acoustic signal, etc.) that propagates to the surface of the well, as can be appreciated by one of skill in the art. In accordance with some embodiments of the invention, the transducer 2011 may process the signal that is furnished by the Hall effect sensor 2010 for purposes of recognizing when the inductive couplers 1512 and 1516 are substantially aligned. However, in accordance with other embodiments of the invention, the transducer 2011 may merely reproduce the signal produced by the Hall effect sensor 2010 and transmit a signal indicative of the signal produced by the Hall effect sensor 2010 to the surface of the well for monitoring by an operator and possible analysis by surface-located equipment.

Additionally, although FIG. 36 depicts by way of example the Hall effect sensor 2010 and the transducer 2011 as being located in the lower completion assembly 1514, these components may be all or partially located in the upper completion assembly 1510, in accordance with other embodiments of the invention. Thus, many variations are contemplated and are within the scope of the appended claims.

Figure 37:
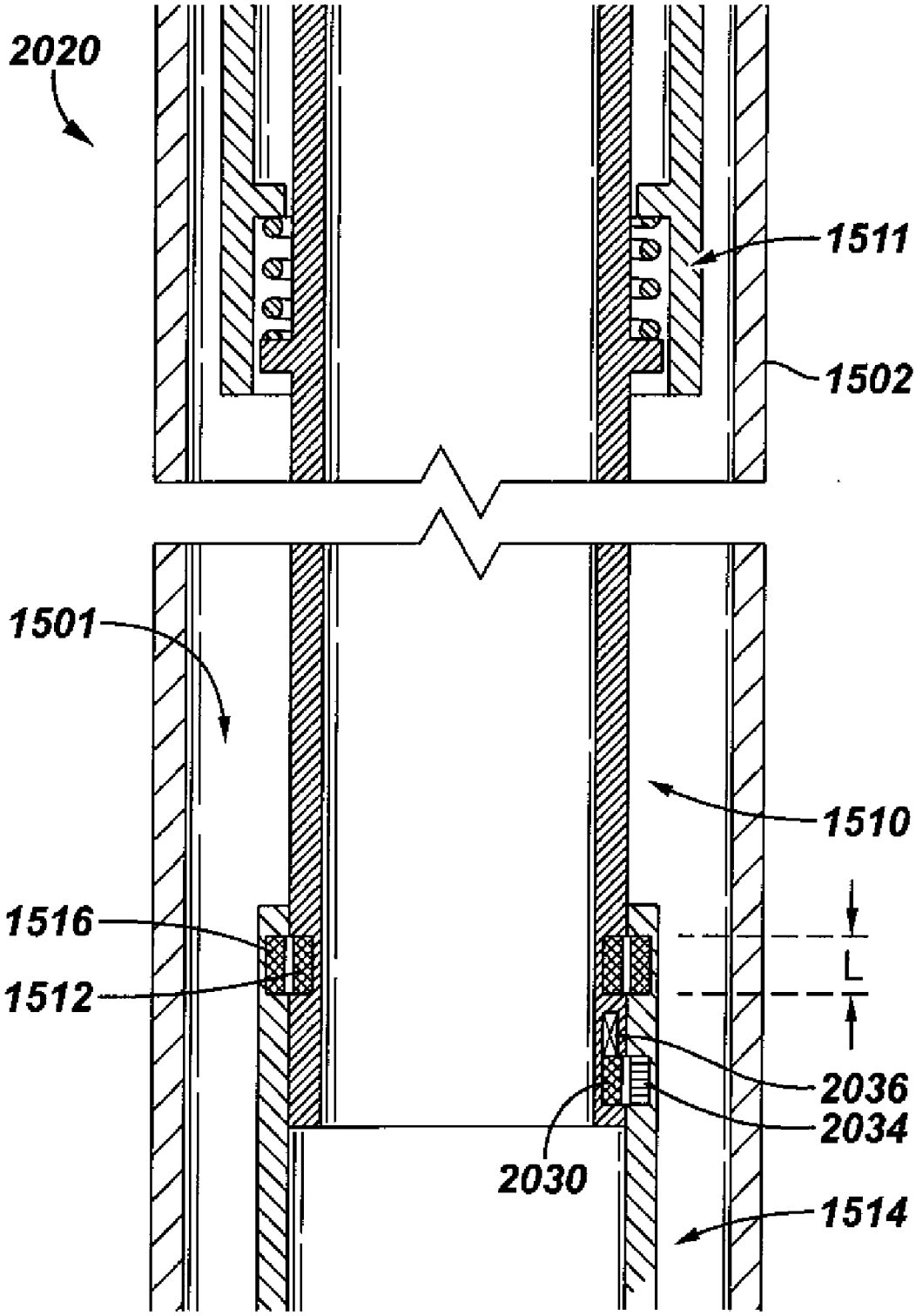
FIG. 37 is a cross-sectional view of upper and lower completion sections illustrating the use of a radio frequency tag to align inductive couplers according to an embodiment of the invention.

As another example, FIG. 37 illustrates a system 2020 in accordance with another embodiment of the invention. Similar reference numerals have been used in FIG. 37 to denote components that are described above. In general, the system 2020 uses a radio frequency (RF) tag 2034 for purposes of detecting when the inductive couplers 1512 and 1516 are substantially aligned. For the example shown in FIG. 37, in accordance with some embodiments of the invention, the RF tag 2034 may be part of the lower completion assembly 1514 and may be positioned to align with an RF tag reader 2030 (which may be part of the upper completion assembly 1512) when the inductive couplers 1512 and 1516 are substantially aligned. Thus, as the upper completion assembly 1510 is being lowered into the well, the RF tag reader 2030 attempts to read information from the RF tag 2034. However, the information is unreadable until the RF tag reader 2030 is aligned with the RF tag 2034, a scenario that occurs when the inductive couplers 1512 and 1516 are substantially aligned. Therefore, when the RF tag reader 2030 is able to read predetermined information from the RF tag 2034, an operator at the surface of the well then determines that the inductive couplers 1512 and 1516 are substantially aligned.

As a more specific example, in accordance with some embodiments of the invention, a downhole transducer 2036 may be electrically coupled to the RF tag reader 2030 for purposes of communicating wired or wireless stimuli to the surface of the well. For example, the transducer 2036 may communicate information that is sensed by the RF tag reader 2030 to the surface of the well so that an operator at the surface of the well may recognize when the inductive couplers 1512 and 1516 are substantially aligned. In accordance with other embodiments of the invention, the transducer 2036 may generate a predetermined signal when the RF tag reader 2030 is able to read the predetermined information from the RF tag 2034. Furthermore, although FIG. 37 depicts the reader 2030 and transducer 2036 as being on the upper completion assembly 1512 and the RF tag 2034 as being on the lower completion assembly, these components may be located on the other completion assembly 1510, 1514, depending on the particular embodiment of the invention.

In other embodiments of the invention, the system 2020 may contain multiple RF tags 2034 that are positioned at different longitudinal positions in the well (at different axial positions along the lower completion assembly 1514, for example) for purposes of indicating how close the inductive couplers 1512 and 1516 are to being substantially aligned. For example, the uppermost RF tag 2034 may contain data that indicates that the inductive couplers 1512 and 1516 are one meter (m) apart, a lower adjacent next RF tag 2034 may contain data that indicates the inductive couplers 1512 and 1516 are 0.5 m apart, etc.

Figure 38:
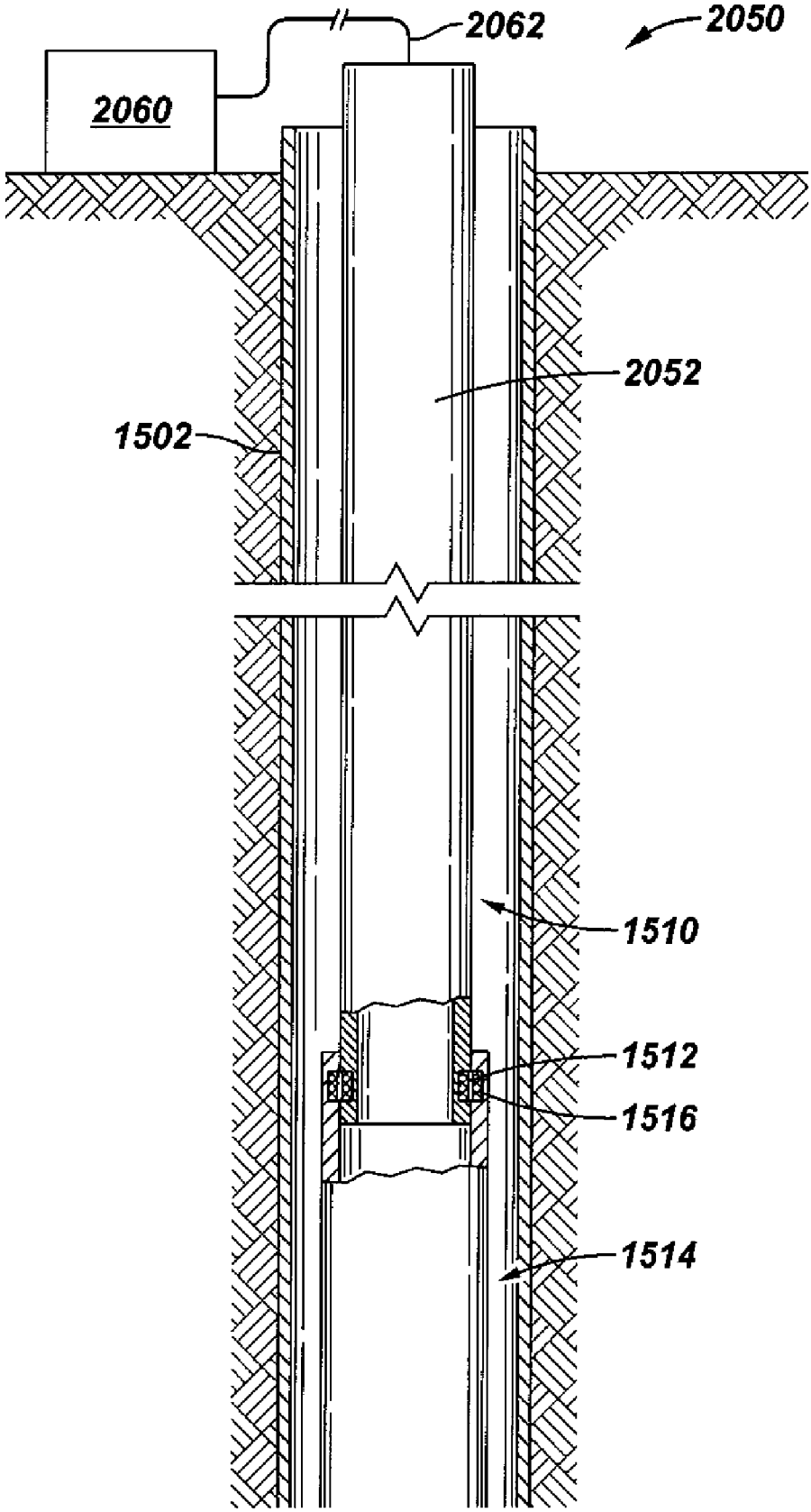
FIG. 38 is a cross-sectional view of upper and lower completion sections illustrating the use of impedance monitoring to align inductive couplers according to an embodiment of the invention.

The mechanism to provide feedback as to whether the inductive couplers 1512 and 1516 are substantially aligned may in general be located at the surface of the well, in accordance with some embodiments of the invention. For example, FIG. 38 depicts a system 2050 that includes a surface-located impedance monitor 2060 for purposes of detecting alignment of the inductive couplers 1512 and 1516. It is noted that similar reference numerals have been used in FIG. 38 to depict components that are otherwise described herein.

Figure 39:
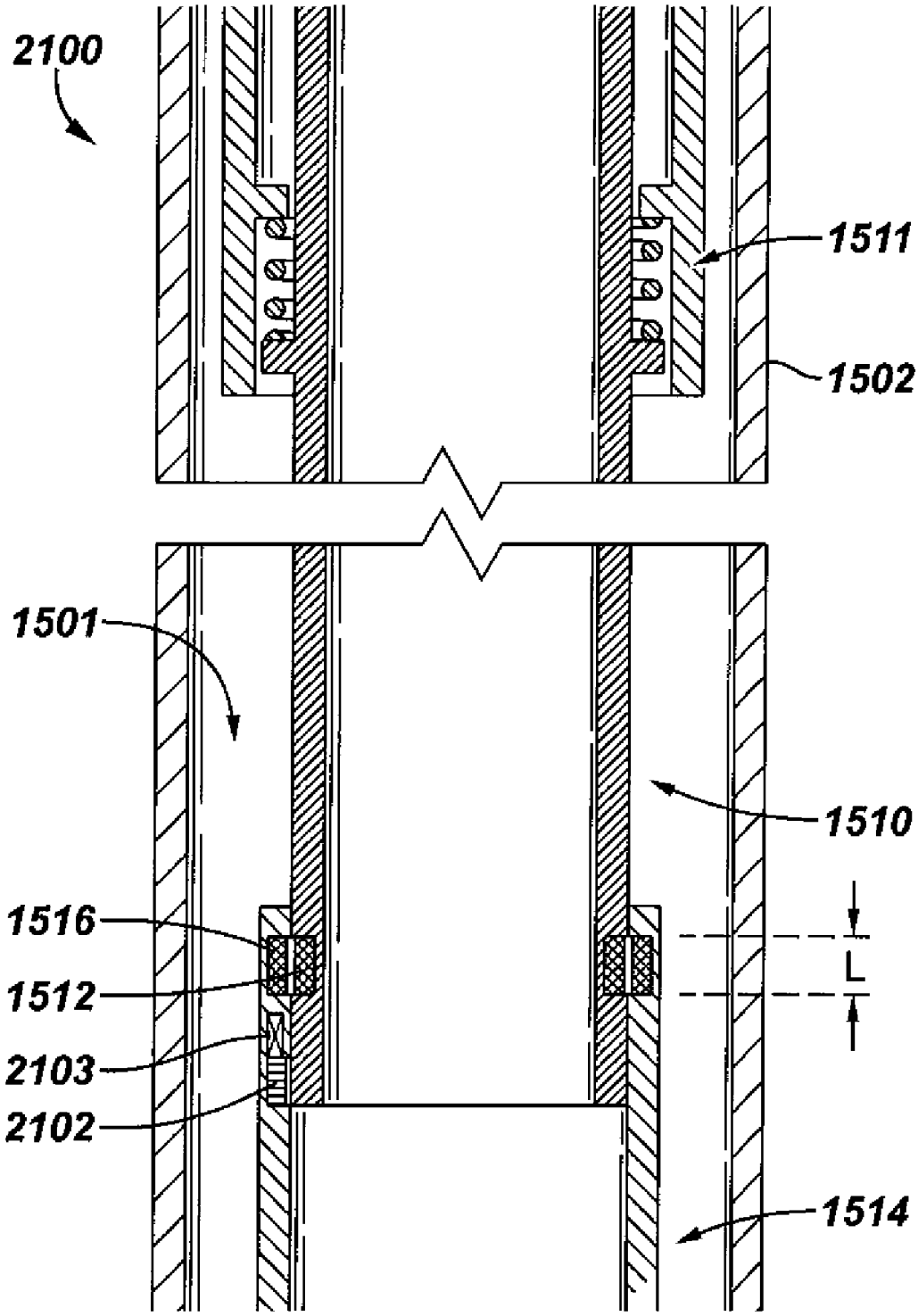
FIG. 39 is a cross-sectional view of upper and lower completion sections illustrating the use of a device that is activated to indicate alignment of inductive couplers according to an embodiment of the invention.

In general, the impedance monitor 2060 is electrically coupled (via electrical lines 2062) to the inductive coupler 1512 of the upper completion assembly 1510. When the upper completion assembly 1510 is run downhole (via a tubing string 2052) and is in the vicinity of the lower completion assembly 1514, the impedance monitor 2060 may energize the inductive coupler 1512 and monitor the voltage and current of the inductive coupler 1512 for purposes of analyzing the coupler's impedance. When the inductive coupler 1512 is away from the inductive coupler 1516, the magnetic field of the inductive coupler 1512 experiences more impedance, thereby reflecting in the impedance measurement by the impedance monitor 2060. However, when the inductive couplers 1512 and 1516 become substantially aligned, the impedance is minimized or has a recognizable value, as the magnetic field of the inductive coupler 1512 is concentrated by the magnetic material present in the inductive coupler 516. It is noted that a threshold impedance, an impedance signature, etc. may be monitored for purposes of determining when the inductive couplers 1512 and 1516 are substantially aligned. As yet another variation, FIG. 39 depicts a system 2100 in accordance with other embodiments of the invention. In general, similar reference numerals are used to denote components similar to the ones described above. The system 2100 includes a device 2102, which is activated in response to the inductive couplers 1512 and 1516 becoming substantially aligned. In this regard, the device 2102 may contain, for example, a coil, Hall effect sensor or other magnetic or proximity sensing device that activates a particular electric circuit when the inductive couplers 1512 is in a predetermined position. Upon receiving this indication, the electric circuit of the device 2102 transitions from a deactivated, or powered down state, to an activated, or powered up, state and via a transducer 2103, for example, the device 2102 generates a signal that is communicated to the surface of the well for purposes of alerting the operator that the inductive couplers 1512 and 1516 are substantial alignment. It is noted that the signal that is generated by the transducer 2103 may a wired signal, a wireless signal, or, in general, any type of stimulus, depending on the particular embodiment of the invention. Furthermore, although FIG. 39 depicts the device 2102 and the transducer 2103 being located in the lower completion assembly 1514, these components may be located partially or entirely in the upper completion assembly 1510, in accordance with other embodiments of the invention. Thus, many variations are contemplated and are within the scope of the appended claims.

Other embodiments are within the scope of the appended claims. For example, the techniques and system that are disclosed herein may be applied to well equipment (test equipment, production equipment, etc.) other than completion equipment. As another example, in other embodiments of the invention, the inductive couplers may not be nested when aligned.

As another example, in embodiments of the invention in which mechanical feedback is used to monitor inductive coupler alignment, the well may have features that permits an operator at the surface to discriminate between the mechanical feedback associated with inductive coupler alignment and other mechanical feedback that is attributable to the landing of another device. For example, in a subsea well 2200 (FIG. 40), the snap latch connector assembly 142 (described above) is used to provide feedback to indicate whether the inductive couplers (not shown) are substantially aligned, as described above. In addition to installing the inductive couplers, completion of the subsea well 2220 involves landing a tubing hanger 2210 in a wellhead 2210. As described below, the subsea well 2210 has features that allows an operator at the surface of the well to distinguish the feedback that is generated due to the landing of the tubing hanger 2210 from the feedback that is attributable to the engagement of the mating pieces of the snap latch connector assembly 142.

Figure 40:
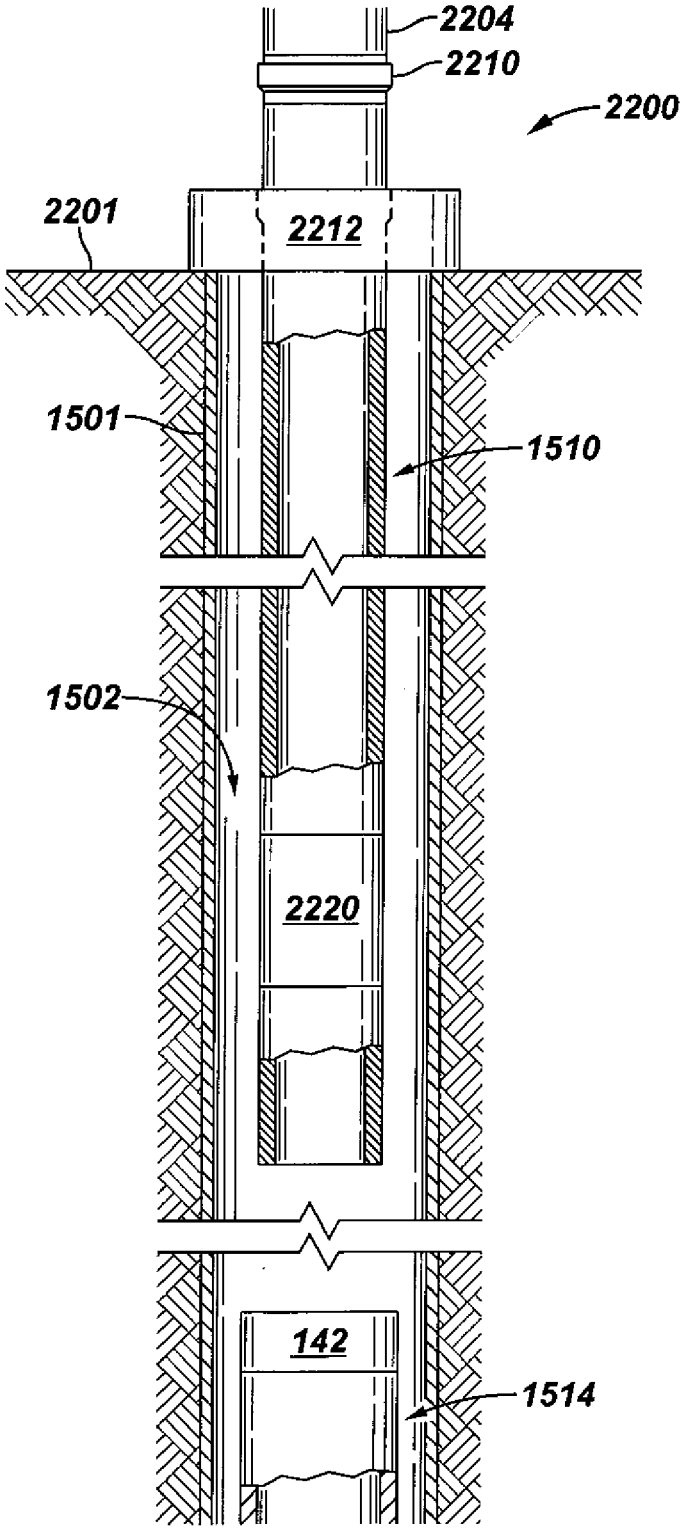
FIG. 40 is a schematic diagram of a subsea well according to an embodiment of the invention.

It is noted that similar reference numerals have been used in FIG. 40 to denote components that are described above. In general, the subsea well 2200 includes the wellhead 2212 and a wellbore 1501 that extends beneath the seabed 2201. The wellbore 1501 may be cased by a casing string 1502 that lines and supports the wellbore 1501. An exemplary tubing string 2204 is depicted in FIG. 40. The tubing string 2204 extends into the wellhead 2212 and wellbore 1501, and above the wellhead 2212, the tubing string 2204 extends inside a marine riser (not shown in FIG. 40) from a sea surface-located rig. In general, the string 2204 includes an upper completion assembly 1510 and a lower completion assembly 1514, which are described above. For the state of the well 2200, which is depicted in FIG. 40, the tubing hanger 2210 has not been landed in the wellhead 2212.

There is a potential conflict caused by the multiple mechanical landings: without the features that are described herein, an operator at the surface of the well is unable to discriminate if the resistance encountered during the running of the tubing string 2204 is due to the landing of the tubing hanger 2210 or the engagement of the mating components of the snap latch connector assembly 142. Furthermore, landing two components may cause excessive buckling of the tubing in between the tubing hanger 2210 and the snap latch connector assembly 142. In some cases, the forces required to buckle the tubing may be so large as to significantly damage a component in the well. Therefore, in accordance with embodiments of the invention, the tubing string 2204 includes a contraction joint 2220, which is located between the tubing hanger 2210 and the snap latch connector assembly 142 to allow axial movement between these components.

Figure 41:
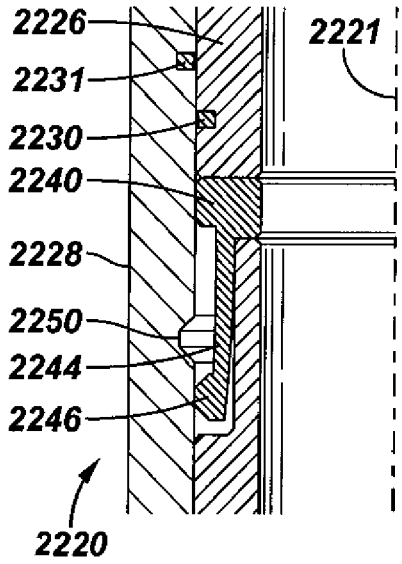
FIG. 41 is a partial cross-sectional view of a contraction joint of the well of FIG. 40 according to an embodiment of the invention.

FIG. 41 depicts a partial cross-sectional diagram of the contraction joint 2220 taken along a longitudinal axis 2221 of the joint 2200. It is noted that the contraction joint 2220 includes the left hand side depicted in FIG. 41 along with a mirroring right hand side that is not depicted in FIG. 41.

Referring to FIG. 41, in conjunction with FIG. 40, in accordance with some embodiments of the invention, the contraction joint 2220 contains a connector, such as one or more shear pins (one exemplary shear pin being depicted as being sheared into two pieces 2230 and 2231 in FIG. 41) that initially prevent the contraction joint 2220 from moving for purposes allowing the mating components of the snap latch connector assembly 142 to engage.

More specifically, the contraction joint 2220 includes an upper tubular member 2226 that is connected to the portion of the upper completion assembly 1510 above the contraction joint 2220 and a lower tubular member 2228 that is connected to the portion of the upper assembly 1510 below the contraction joint 2220. When unrestrained, the tubular members 2226 and 2228 slide relative to each other to permit axial movement between the tubing hanger 2210 and the snap latch connector assembly 142. In the initial run-in-hole state of the contraction joint 2220, however, the shear pins connect the tubular members 2226 and 2228 together to prevent this axial movement.

The components of the string 2204 are spaced so that when the shear pins of the contraction joint 2220 are in tact, the mating components of the snap latch connector assembly 142 engage each other before the tubing hanger 2210 lands in the wellhead 2212. When the tubing string 2204 is run into the well 2200, the operator at the surface is able to determine, based on the mechanical feedback, when the mating components of the snap latch connector assembly 142 are engaged. Thus, when the corresponding weight offset is detected, the operator pulls up on the tubing string 2204 to confirm that the snap latch connector assembly 142 is engaged (and thus to confirm that the inductive couplers are substantially aligned).

After engagement of the snap latch connector assembly 142 is confirmed, the operator may then push downwardly on the tubing string 2204 to shear the shear pins of the contraction joint 2220. After the shear pins shear (as depicted in FIG. 41), the portion of the upper completion assembly 1510 that is above the contraction joint 2220 is allowed to move relative to the snap latch connector assembly 142 to permit the landing of the tubing hanger 2210.

The above scenario may encounter problems if there is a misalignment of the tubing hanger 2210 or debris that prevents proper landing of the tubing hanger 2210. Thus, it is conceivable that the operator may be unable to land the tubing hanger 2210 in the wellhead 2212. When this occurs, the tubing hanger 2210 may need to be pulled uphole for another try, or the entire tubing hanger 2210 may be pulled out of the well 2200 back up to the rig and replaced. In either case, the snap latch connector assembly 142 is disengaged. Because the operator generally does not want to pull the entire upper completion assembly 1510 out, the upper completion assembly 1510 may be left in the riser (not shown) while the tubing hanger 2210 is replaced or serviced. Once the tubing hanger 2210 problem is resolved, the tubing string 2204 is run back downhole; and thus, another attempt is made at engaging the mating components of the snap latch connector assembly 142 and landing the tubing hanger 2210.

For the above-described scenario, it may be quite difficult, if not impossible, to confirm the engagement of the components of the snap latch assembly 142 when the tubing string 2204 is run back downhole, because the shear pins of the contraction joint 2220 have already been sheared. Therefore, if not for the features described below, there may be no way for the operator to determine if the inductive couplers are substantially aligned. In fact, the snap-in force of the snap latch connector assembly 142 may be large enough to contract the contraction joint 2220, thereby precluding the operator from determining whether the tubing hanger 2204 has landing or whether the mating components of the snap latch connector assembly 142 have engaged.

In accordance with embodiments of the invention, the contraction joint 2220 includes a connector, such as a collet 2240, which is capable of re-locking the contraction joint 2220 for additional runs downhole. It is noted that, depending on the particular embodiment of the invention, the contraction joint 2220 may have solely the collet 2240 without the shear pins or a combination of the collet 2240 and the shear pins. Thus, many variations are contemplated and are within the scope of the appended claims.

For the above-described scenario in which the tubing hanger 2210 is pulled out of hole, ends 2246 of collet fingers 2244 (one collet finger 2244 being depicted in FIG. 41) of the collet 2240 engage an annular groove 2250, which is formed in the interior surface of the tubular member 2228. At this point, the tubing hanger 2210 may then be retrieved and fixed and/or replaced. When the tubing hanger 2210 is now run back downhole and engages the remaining portion of the tubular string 2204, the engagement of the collet 2240 with the groove 2250 allows enough downward force to push the components of the snap latch connector assembly 142 back into engagement. Thus, when engagement of the components of the snap latch connector assembly 142 is detected and confirmed at the surface of the well 2200, a larger downward force may be applied to force the release the collet fingers 2244 from the groove 2250 so that the contraction joint 2220 once again permits axial movement and thus, allows the landing of the tubing hanger 2210. It is noted that the force to push the mating components of the snap latch connector assembly 142 into engagement is less than the force to release the collet 2240; and conversely, the force to set the collet 2240 is less than the force to disengage the snap latch connector assembly 142.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus usable with a well, comprising:

a first equipment section comprising a first inductive coupler;

a second equipment section comprising a second inductive coupler and being adapted to be run downhole into the well after the first equipment section is run downhole into the well to engage the first equipment section;

a mechanism to indicate when the first inductive coupler is substantially aligned with the second inductive coupler and;

wherein one of the first and second equipment sections comprises a telescoping joint to prevent relative movement between the first and second equipment sections comprising first and second inductive couplers after the second equipment section engages the first equipment section.

2. The apparatus of claim 1, wherein the first and second inductive couplers have approximately the same axial length.

3. The apparatus of claim 1, wherein the first and second equipment sections comprise completion equipment assemblies.

4. The apparatus of claim 1, wherein the mechanism is adapted to provide a mechanical feedback at the surface of the well indicating whether the first and second inductive couplers are substantially aligned.

5. The apparatus of claim 4, wherein the mechanism comprises a snap latch or a no go shoulder.

6. The apparatus of claim 4, wherein the first equipment section comprises a device to provide other mechanical feedback at the surface of the well when the device engages a feature of the well, the apparatus further comprising: a contraction joint to allow an operator at the surface of the well to discriminate between the mechanical feedback provided by the mechanism and the other mechanical feedback.

7. The apparatus of claim 6, wherein the device comprises a tubing hanger.

8. The apparatus of claim 6, further comprising: a connector to lock the contraction joint in place until the mechanism provides the mechanical feedback at the surface of the well indicating that the first and second inductive couplers are substantially aligned.

9. The apparatus of claim 8, wherein the connector comprises a collet.

10. The apparatus of claim 8, wherein the connector comprises a shear pin.

11. The apparatus of claim 1, wherein the mechanism comprises an electrical device to generate an electrical signal indicative of whether the first and second inductive couplers are substantially aligned.

12. The apparatus of claim 11, wherein the electrical device comprises a Hall effect sensor, a switch or a radio frequency identification tag.

13. The apparatus of claim 11, wherein the electrical device is adapted to transition from an inactivated state to an activated state in response to the first and second inductive couplers becoming substantially aligned and in the activated state, cause the generation of a stimulus that is detectable at the surface of the well.

14. The apparatus of claim 11, wherein the electrical device is coupled to one of the first and second inductive couplers to provide a signal indicative of an impedance of said of the first and second inductive couplers to indicate when the first inductive coupler is substantially aligned with the second inductive coupler.

15. The apparatus of claim 1, wherein the well comprises a subsea well.

16. A method usable with a well, comprising:

after a first equipment section is installed in the well, running a second equipment section downhole to engage the first equipment section;

providing a telescoping joint to limit relative movement between the first and second inductive couplers after the second equipment section engages the first equipment section; and providing feedback indicative of whether a first inductive coupler of the first equipment is substantially aligned with a second inductive coupler of the second equipment section.

17. The method of claim 16, further comprising:

receiving the feedback at the surface of the well.

18. The method of claim 16, wherein the first and second inductive couplers have approximately the same axial length.

19. The method of claim 16, wherein the first and second equipment sections comprise completion equipment sections.

20. The method of claim 16, wherein the act of providing the feedback comprises providing a mechanical stimulus at the surface of the well to indicate whether the first inductive coupler is substantially aligned with the second inductive coupler.

21. The method of claim 16, wherein the act of providing the feedback comprises generating an electrical signal indicative of whether the first inductive coupler is substantially aligned with the second inductive coupler.

22. The method of claim 16, wherein the act of providing the feedback comprises activating an electrical device in response to the first inductive coupler becoming aligned with the second inductive coupler.

23. The method of claim 16, wherein the act of providing the feedback comprises providing an indication of an impedance of one of the first and second inductive couplers.

* * * * *